US011833821B2

(12) United States Patent
Sugawara

(10) Patent No.: US 11,833,821 B2
(45) Date of Patent: Dec. 5, 2023

(54) LIQUID EJECTING HEAD, METHOD FOR PRODUCING THE SAME, AND LIQUID EJECTING APPARATUS

(71) Applicant: SEIKO EPSON CORPORATION, Tokyo (JP)

(72) Inventor: Yoshiki Sugawara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/158,068

(22) Filed: Jan. 26, 2021

(65) Prior Publication Data

US 2021/0229443 A1 Jul. 29, 2021

(30) Foreign Application Priority Data

Jan. 29, 2020 (JP) ..... 2020-012246

(51) Int. Cl.
*B41J 2/145* (2006.01)
*B41J 2/14* (2006.01)

(52) U.S. Cl.
CPC ..... *B41J 2/145* (2013.01); *B41J 2/14201* (2013.01); *B41J 2/14233* (2013.01); *B41J 2002/14362* (2013.01); *B41J 2202/19* (2013.01); *B41J 2202/20* (2013.01)

(58) Field of Classification Search
CPC .... B41J 2/145; B41J 2/14201; B41J 2/14233; B41J 2002/14362; B41J 2202/19; B41J 2202/20
See application file for complete search history.

(56) References Cited

U.S. PATENT DOCUMENTS

| | | | | |
|---|---|---|---|---|
| 10,464,344 | B2 * | 11/2019 | Sugawara | B41J 2/245 |
| 2012/0044307 | A1 | 2/2012 | Hagiwara et al. | |
| 2018/0170048 | A1 | 6/2018 | Sugiwara et al. | |
| 2020/0122462 | A1 | 4/2020 | Hagiwara | |

FOREIGN PATENT DOCUMENTS

| | | | | |
|---|---|---|---|---|
| JP | S56-143613 | | 11/1981 | |
| JP | 2012-040731 | A | 3/2012 | |
| JP | 2018-094854 | A | 3/2018 | |
| JP | 2020-066130 | A | 4/2020 | |
| WO | WO 2010/136135 | A1 * | 12/2010 | F16B 35/04 |

* cited by examiner

*Primary Examiner* — Geoffrey S Mruk
(74) *Attorney, Agent, or Firm* — WORKMAN NYDEGGER

(57) ABSTRACT

Provided is a liquid ejecting head including a nozzle surface, a shaft portion, and a housing portion. The nozzle surface has nozzles configured to eject liquid in a first direction. The shaft portion includes a shaft main body extending in the first direction. The housing portion has a through-hole in which the shaft portion is inserted. The first shaft portion has a first external thread and a first internal thread on a first side to which the first direction leads.

20 Claims, 26 Drawing Sheets

LIQUID EJECTING HEAD, METHOD FOR PRODUCING THE SAME, AND LIQUID EJECTING APPARATUS

The present application is based on, and claims priority from JP Application Serial Number 2020-012246, filed Jan. 29, 2020, the disclosure of which is hereby incorporated by reference herein in its entirety.

BACKGROUND

1. Technical Field

The present disclosure relates to a liquid ejecting head that ejects ink, a method for producing the same, and a liquid ejecting apparatus. More specifically, the present disclosure relates to an ink jet recording head that discharges ink in liquid form, a method for producing the same, and an ink jet recording apparatus.

2. Related Art

Liquid ejecting apparatuses incorporate liquid ejecting heads from which various types of liquid may be ejected (discharged) in the form of liquid droplets. Examples of liquid ejecting apparatuses include image recording apparatuses such as ink jet printers and ink jet plotters. Such a liquid ejecting apparatus offers an advantage in that a slight amount of liquid may be ejected precisely onto a target position. The liquid ejecting apparatuses thus recently find use as various types of production apparatuses. For example, the liquid ejecting apparatuses find use as display production apparatuses that produce color filters for liquid crystal displays, as apparatuses for forming electrodes that are to be incorporated in organic electroluminescent (EL) displays or field emission displays (FEDs), and as chip production apparatuses that produce biochips. The image recording apparatuses incorporate recording heads that eject liquids containing coloring materials. The display production apparatus incorporates coloring material ejecting heads that eject liquids containing coloring materials in, for example, red (R), green (G), and blue (B). The apparatuses for forming electrodes incorporate electrode material ejection heads that eject liquids containing materials of electrodes. The chip production apparatus incorporate bioorganic matter ejecting heads that eject liquids containing bioorganic matter.

A liquid ejecting apparatus known in the art incorporates a unitized body including a plurality of liquid ejecting heads that are arranged side by side and are fixed to a holding member (see, for example, JP-A-2012-040731). JP-A-2012-040731 describes that the liquid ejecting heads are fixed to the holding member (i.e., a sub carriage) via intermediate members screwed to the holding member. The intermediate members are screwed to the liquid ejecting heads in advance. The intermediate members with the liquid ejecting heads fastened thereto are then fixed to the holding member. The intermediate members are fixed to the holding member in the following manner: fastening members including external threads such as bolts or screws are inserted into securing holes extending through a bottom portion of the holding member. The direction in which the fastening members are inserted is from surfaces opposite to nozzle surfaces of the liquid ejecting heads to the liquid ejecting heads. Fastening the liquid ejecting heads to the holding member using fastening members such as screws may be hereinafter referred to as a screwing process where appropriate. The screwing process may be performed not only for production of liquid ejecting apparatuses but also for repair to or replacement of the liquid ejecting heads held on the holding member.

The screwing process is performed from one side or the other side in a first direction crossing a nozzle surface in which nozzles of a liquid ejecting head are formed; that is, the screwing process is performed from the nozzle surface side or the side opposite to the nozzle surface. The way in which liquid ejecting heads are fixed to a holding member (i.e., fixation state) varies depending on the specifications and the internal structure of a liquid ejecting apparatus. The side from which the screwing process is performed is determined according to, for example, the fixation state or requirements concerning the screwing process needed for production or repair. In recent years, there has been a demand that provisions be made for both the screwing process from one side and the screwing process from the other side.

SUMMARY

According to an aspect of the present disclosure made to solve the problems described above, a liquid ejecting head includes a nozzle surface, a first shaft portion, and a housing portion. The nozzle surface has nozzles from which liquid is ejected in a first direction. The first shaft portion includes a shaft main body extending in the first direction. The housing portion has a first through-hole in which the first shaft portion is inserted. The first shaft portion has a first external thread and a first internal on a first side to which the first direction leads.

According to another aspect of the present disclosure is a liquid ejecting head including a nozzle surface, a first shaft portion, and a housing portion. The nozzle surface has nozzles from which liquid is ejected in a first direction. The first shaft portion includes a shaft main body extending in the first direction. The housing portion has a first through-hole in which the first shaft portion is inserted. The shaft main body has a first external thread on a first side to which the first direction leads. The first external thread is configured to fit in a first internal thread for fastening of the shaft main body to a cylindrical member that is hollow and that has an inner circumferential surface. The first internal thread is provided on the inner circumferential surface of the cylindrical member. The first external thread is to be used to fix the liquid ejecting head to a first holding member for holding the liquid ejecting head or to fasten the cylindrical member and the shaft main body to each other. The first internal thread is to be used to fasten the cylindrical member and the shaft main body to each other and to fix the liquid ejecting head to a second holding member for holding the liquid ejecting head.

According to still another aspect of the present disclosure, a liquid ejecting apparatus includes the liquid ejecting head according to the aspect above and a first holding member having a screw hole in which the first external thread fits. The liquid ejecting head is held on the first holding member.

According to still another aspect of the present disclosure, a liquid ejecting apparatus includes the liquid ejecting head according to the aspect above, a screw that fits in the first internal thread, and a second holding member having a second through-hole in which the screw is inserted. The liquid ejecting head is held on the second holding member.

According to still another aspect of the present disclosure, a liquid ejecting apparatus includes the liquid ejecting head according to the aspect above, a screw that fits in the first internal thread, and a second holding member having a second through-hole in which the screw is inserted. The liquid ejecting head is held on the second holding member. The outside diameter of the cylindrical member is greater than the inside diameter of the second through-hole.

According to still another aspect of the present disclosure, a method for producing the liquid ejecting head according to the aspect above includes fastening the cylindrical member onto the shaft main body inserted in the first through-hole.

DESCRIPTION OF EXEMPLARY EMBODIMENTS

Hereinafter, the present disclosure will be described in detail by way of embodiments. The following description is given of an aspect of the present disclosure, and any change may be made within the scope of the present disclosure. Note that members denoted by the same reference sign in the accompanying drawings are identical to each other, and description thereof will be omitted where appropriate. In each drawing, three spatial axes orthogonal to one another are denoted by X, Y, and Z, respectively. The directions of these axes are herein referred to as the X direction, the Y direction, and the Z direction, respectively. The directions of arrows in each drawing are referred to as positive (+) directions, and directions opposite to the directions of the respective arrows are referred to as negative (−) directions.

Embodiment 1

Figure 1:
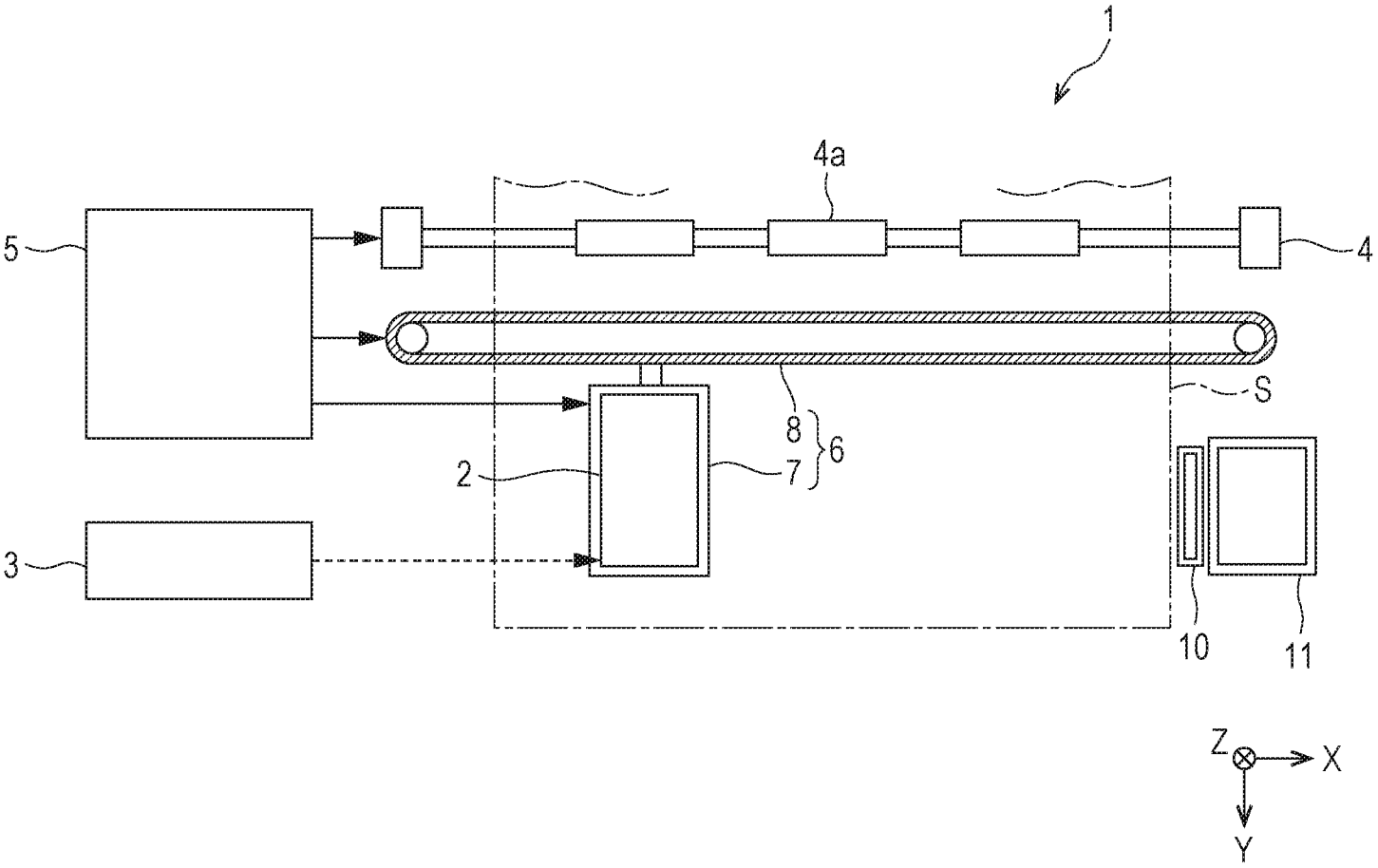
FIG. 1 is a schematic diagram an ink jet recording apparatus according to Embodiment 1.

FIG. 1 schematically illustrates an ink jet recording apparatus that is an example of a liquid ejecting apparatus according to Embodiment 1.

Referring to FIG. 1, an ink jet recording apparatus 1 is an example of the liquid ejecting apparatus and is a printing apparatus that ejects ink, which is a kind of liquid, or more specifically, ejects ink droplets onto a medium S, such as a sheet of printing paper, and forms dot patterns on the medium S to print an image or the like. The medium S may be a sheet of recording paper, a resin film, a piece of cloth, or any other material.

The three spatial axes denoted by X, Y, and Z are defined as follows. The X axis refers to the direction in which a head unit 2 moves (i.e., a primary scanning direction). The head unit 2 will be described later. The Y axis refers to the direction in which the medium S is transported, that is, the direction orthogonal to the primary scanning direction. A plane parallel to a nozzle surface of the head unit 2, that is, parallel to a surface in which nozzles 35 are formed is referred to as an X-Y plane. The Z axis refers to a direction crossing the nozzle surface, that is, a direction crossing the X-Y plane. In the present embodiment, the Z axis refers to a direction orthogonal to the nozzle surface, that is, a direction orthogonal to the X-Y plane. Ink droplets are ejected along the Z axis, or more specifically, in the +Z direction. The +Z direction in the present embodiment corresponds to a first direction specified in the present disclosure, and the −Z direction corresponds to a second direction specified in the present disclosure. The +Y direction in the present embodiment corresponds to a third direction specified in the present disclosure, and the −Y direction corresponds to a fourth direction specified in the present disclosure. The −X direction in the present embodiment corresponds to a fifth direction specified in the present disclosure, and the +X direction corresponds to a sixth direction specified in the present disclosure.

The ink jet recording apparatus 1 includes a liquid container 3, a transport mechanism 4, a control unit 5, a mobile mechanism 6, and the head unit 2. The transport mechanism 4 transports the medium S. The control unit 5 is a controller.

Different types of ink (e.g., inks in different colors) that may be ejected from the head unit 2 are individually stored in the liquid container 3. The liquid container 3 is, for example, a cartridge removably attached to the ink jet recording apparatus 1, a sac-like ink pack made of a flexible film, or a refillable ink tank. Different types of ink or inks in different colors (not illustrated) are stored in the liquid container 3.

The control unit 5 includes a control device (not illustrated) such as a central processing unit (CPU) or a field programmable gate array (FPGA) and a storage device (not illustrated) such as a semiconductor memory. The storage device stores programs, and the control unit 5 executes these programs to perform centralized control of the individual components of the ink jet recording apparatus 1, such as the transport mechanism 4, the mobile mechanism 6, and the head unit 2.

The transport mechanism 4 is controlled by the control unit 5 and transports the medium S in the Y direction. The transport mechanism 4 includes, for example, transport rollers 4*a*. In place of the transport rollers 4*a*, a belt or a drum may be included in the transport mechanism 4 to transport the medium S.

The mobile mechanism 6 is controlled by the control unit 5 and causes the head unit 2 to reciprocate in the ±X directions. The ±X directions in which the head unit 2 is prompted by the mobile mechanism 6 to reciprocate cross the −Y direction in which the medium S is transported.

Specifically, the mobile mechanism 6 in the present embodiment includes a transport body 7 and a transport belt 8. The transport body 7 is a structure that is substantially box-shaped to accommodate the head unit 2; that is, the transport body 7 is a carriage. The transport body 7 is fixed to the transport belt 8. The transport belt 8 is an endless belt laid in the ±X directions. The transport belt 8 circulates under the control of the control unit 5 such that the head unit 2 and the transport body 7 reciprocate in the ±X directions along a guide rail (not illustrated). Together with the head unit 2, the liquid container 3 may be incorporated in the transport body 7.

A wiper 10 is disposed on one side in the primary scanning direction of the head unit 2, that is, on one side in the ±X directions. In the present embodiment, the wiper 10 is disposed on the +X side. The wiper 10 is a wipe member that wipes a nozzle surface in which openings are defined by the nozzles 35 of the head unit 2. The nozzle surface will be described later. The wiper 10 includes an elastic, flexible member made of rubber or an elastomer. The wiping motion of the wiper 10 is as follows: the wiper 10 and the nozzle surface are moved relative to each other, with a tip portion of the wiper 10 being in contact with the nozzle surface. The wiper 10 wipes the nozzle surface accordingly. Various well-known products such as a sheet-shaped wiper made of a nonwoven fabric may be used as the mechanism for wiping the nozzle surface.

The wiper 10 is adjacent to a cap 11, which is disposed on the +X side at a home position for the transport body 7 on standby. The cap 11 has the shape of a tray such that the nozzle surface of the head unit 2 can come into contact with the cap 11. The space in the cap 11 is a sealing cavity in which the nozzles 35 of the head unit 2 may be inserted, and the nozzle surface of the head unit 2 can come into intimate contact with the cap 11 accordingly. The cap 11 is connected to a pump via a waste liquid tube (not illustrated). The pump may be driven to generate negative pressure in the sealing cavity of the cap 11.

Figure 2:
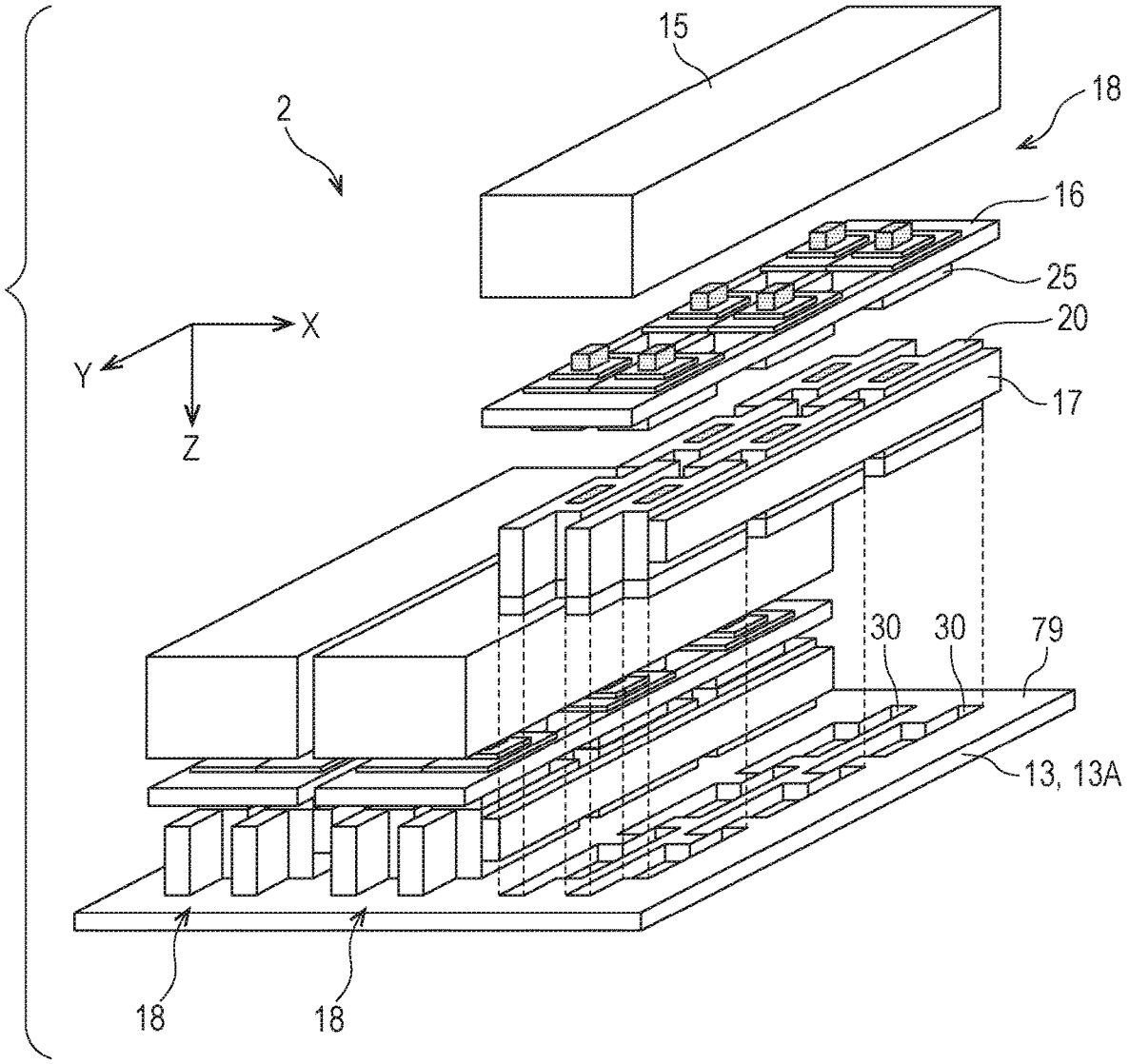
FIG. 2 is a perspective view of a head unit according to Embodiment 1.

The following describes the head unit 2 in the present embodiment with reference to FIG. 2. FIG. 2 is a perspective view of an example of the head unit according to the present disclosure. FIG. 2 illustrates three head modules, one of which is presented in an exploded view.

The head unit 2 includes a holding member 13 and head modules 18. The holding member 13 in the present embodiment is a plate-like member that supports the head modules 18. The holding member 13 is fixed to the transport body 7. The head modules 18 are arranged side by side in the X direction and are fixed to the holding member 13. The holding member 13 and the transport body 7 may be a single member. Specifically, the holding member 13 may be a bottom wall (i.e., a wall on the +Z side) of the transport body 7 that is a substantially box-shaped structure.

The head modules 18 each include a connection unit 15, a support member 16, distribution channels 17, and ink jet recording heads 20, which are liquid ejecting heads. In the present embodiment, each head module 18 includes six ink jet recording head 20. The ink jet recording heads 20 may be hereinafter also referred to as recording heads 20 for short. The number of head modules 18 constituting each head unit 2 and the number of recording heads 20 constituting each head module 18 are not limited to these values. The holding member 13 may be a first holding member 13A or a second holding member 13B (see FIGS. 15, 21, and 26). The first holding member 13A has fastening screw holes 62, into which shaft portions of the recording heads 20 are screwed in. The shaft portions will be described later. The second holding member 13B has second through-holes 86, into which fastening screws are inserted. The fastening screws will be described later. The head modules 18 can be fixed to either of the two holding members, namely, the first holding member 13A and to the second holding member 13B. This will be described in detail later. As an example of the holding member, the first holding member 13A is illustrated in FIG. 2.

Figure 3:
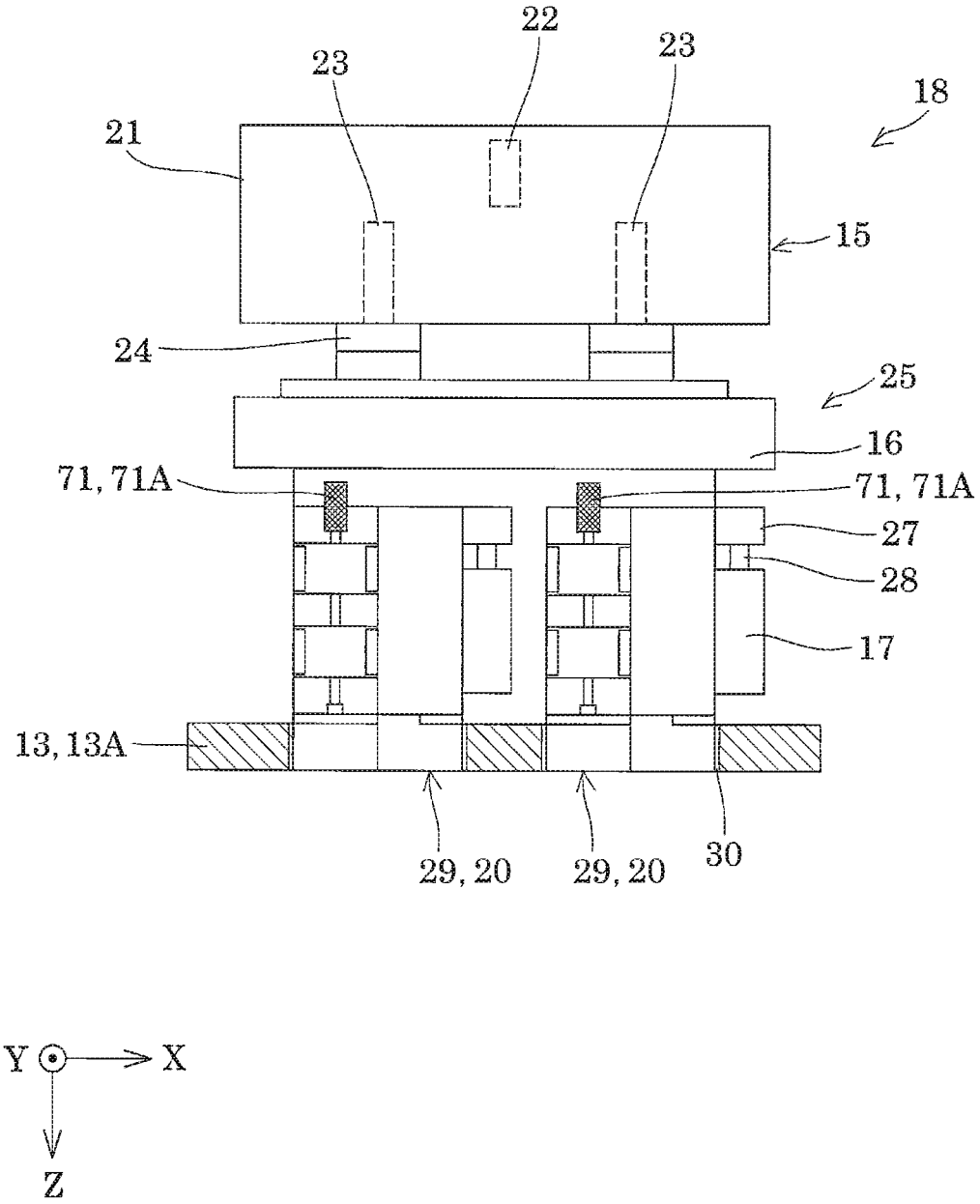
FIG. 3 is a front view of a head module according to Embodiment 1.
Figure 4:
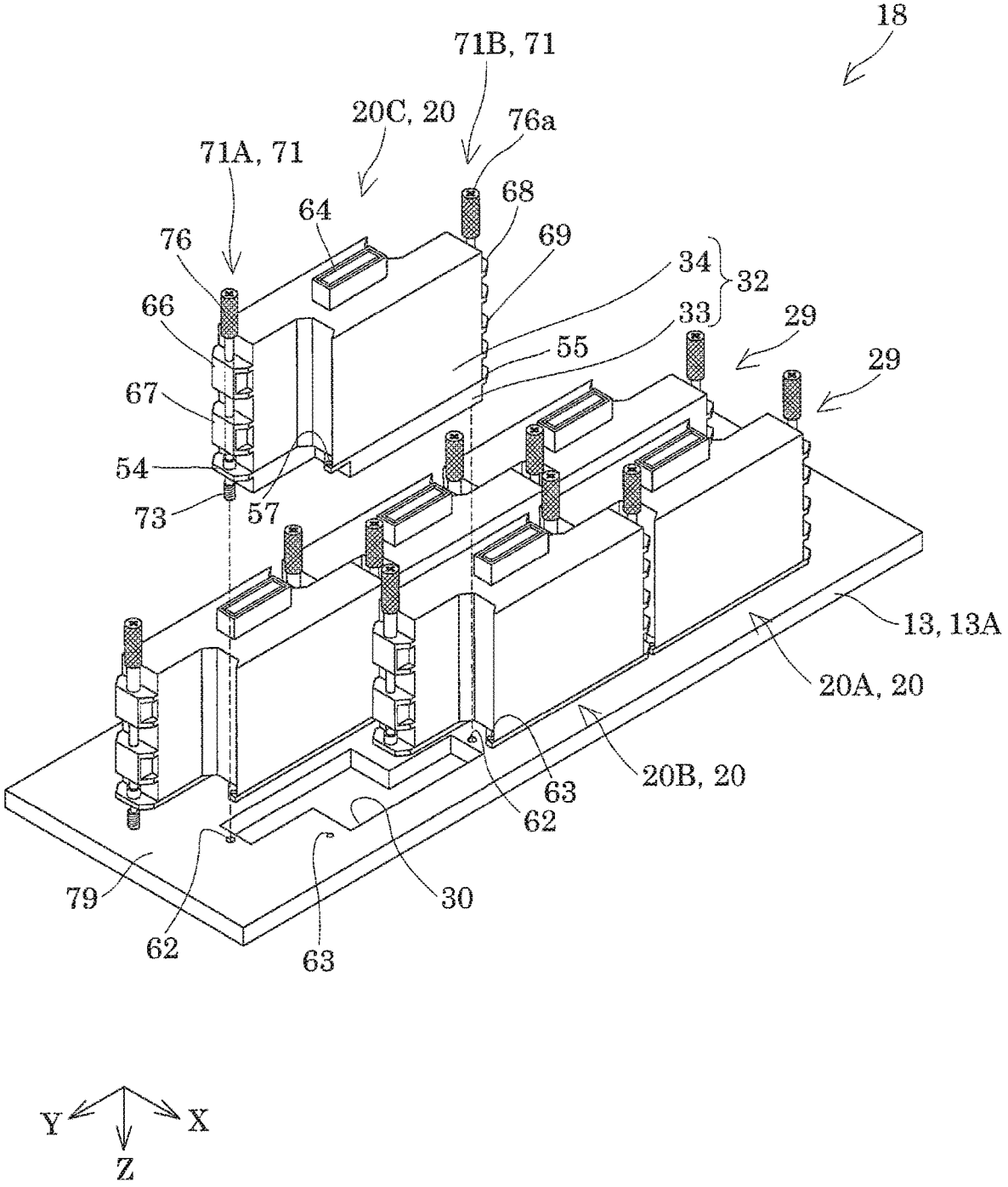
FIG. 4 is a perspective view of the head module according to Embodiment 1.

The following describes the head module 18 in the present embodiment with reference to FIGS. 3 and 4. FIG. 3 is a front view of an example of the head module 18. FIG. 4 is a perspective view of the head module 18. The recording heads of the head module and the holding member are illustrated in FIG. 4, from which the other constituent members of the head module are omitted. The head module illustrated in FIGS. 3 and 4 is representative of the head modules, which all have the same structure.

Each head module 18 in the present embodiment is structured as follows. Two rows of recording heads are arranged side by side in the +X direction and are disposed on the support member 16 adjacent to the connection unit 15 on the +Z side. The distribution channels 17 extend along sides of the recording heads. Each distribution channel 17 is a constituent member including flow paths through which ink fed from the liquid container 3 is distributed to the recording heads 20 of the head module 18. Each distribution channel 17 in the present embodiment is long in the Y direction and is shared by three recording heads 20.

The connection unit 15 includes a casing 21, a relay substrate 22, and drive substrates 23. The casing 21 is a structure that is substantially box-shaped to accommodate the relay substrate 22 and the drive substrates 23. The drive substrates 23 are wiring substrates, each of which is provided for the correspond one of the recording heads. The drive substrates 23 each have a signal generating circuit mounted thereon. The signal generating circuit generates a drive signal for driving piezoelectric actuators 43, which will be described later. Together with the drive signal, a control signal and power supply voltage are applied to the head module 18 by the drive substrate 23. The control signal is generated to specify, for each nozzle, whether ink is to be discharged. It is not always required that the signal generating circuits be provided on the respective drive substrates 23. The signal generating circuits may be provided on head chips 38, which will be described later. The relay substrate 22 is a wiring substrate that relays electrical signals and power supply voltage between the control unit 5 and each drive substrate 23. The relay substrate is shared by the recording heads. The casing 21 is provided with connectors 24, which are disposed on a bottom surface of the casing 21 and are electrically coupled to the respective drive substrates 23.

The head module 18 includes the recording heads 20 and a joint unit 25. The recording heads 20 ejects, onto the medium S, ink fed from the liquid container 3 through the distribution channels 17. The recording heads 20 in the present embodiment are provided with valve mechanism units 27. The valve mechanism units 27 each include a valve mechanism that controls the opening and closing of a flow path of ink fed through the distribution channel 17. Each valve mechanism unit 27 protrudes in the +X direction from a side surface of the corresponding recording head 20. The valve mechanism unit 27 has, on a bottom surface thereof, an introducer needle 28, which projects in the +Z direction, that is, toward the nozzle surface of the recording head 20. The introducer needles 28 are inserted into the distribution channel 17. The introducer needles 28 and the distribution channel 17 are adjacent to the side surfaces of the recording heads 20. The flow paths in the distribution channel 17 communicate with the flow paths in the valve mechanism units 27 through the introducer needles 28. In some embodiments, each introducer needle 28 may protrude from the corresponding valve mechanism unit 27 in the −Z direction, that is, toward the side opposite to the nozzle surface and may be inserted in the distribution channel 17 disposed above the valve mechanism unit 27.

The holding member 13 is a plate-like member that supports the recording heads 20 constituting the head module 18. The holding member 13 in the present embodiment is the first holding member 13A. The recording heads 20 aligned in the +Y direction constitute a head group 29. Two head groups 29 are arranged side by side in the +X direction and are fixed to the holding member 13. In the present embodiment, each head group 29 includes three recording heads 20, and two head groups 29 are fixed to the holding member 13. The number of recording heads 20 included in each head group 29 and the number of head groups 29 fixed to the holding member 13 are not limited to these values. Three recording heads 20 included in one head group 29 are herein referred to as a first recording head 20A, a second recording head 20B, and a third recording head 20C, respectively.

The holding member 13 has apertures 30, each of which is provided for the corresponding one of the recording heads 20. Each aperture 30 extends through the holding member 13 in the +Z direction, that is, in the thickness of the holding member 13. Each aperture 30 is large enough for the nozzle surface of the corresponding recording head 20 to pass through. The nozzles 35 from which ink droplets are discharged are provided in the nozzle surface as will be described later. The apertures 30 are provided for the respective recording heads 20 and are discretely separated from each other. Specifically, three apertures 30 corresponding to the recording heads 20 are arranged in a matrix with two rows in the +Y direction and three columns in the +X direction. In some embodiments, each aperture 30 may be shared by more than one recording head 20; that is, the recording heads 20 arranged side by side in the +X direction may be exposed through the aperture 30.

The recording heads 20 are fixed to the holding member 13, with the nozzle surface side of each recording head 20 being inserted in the corresponding aperture 30 from the −Z side of the holding member 13. That is, the nozzle surfaces of the recording heads 20 are exposed in the +Z direction through the apertures 30 of the holding member 13. The recording heads 20 positioned as above are fixed to the holding member 13 through screw fitting. This positioning enables the recording heads 20 to eject liquid, or more specifically, ink droplets in the +Z direction.

Figure 5:
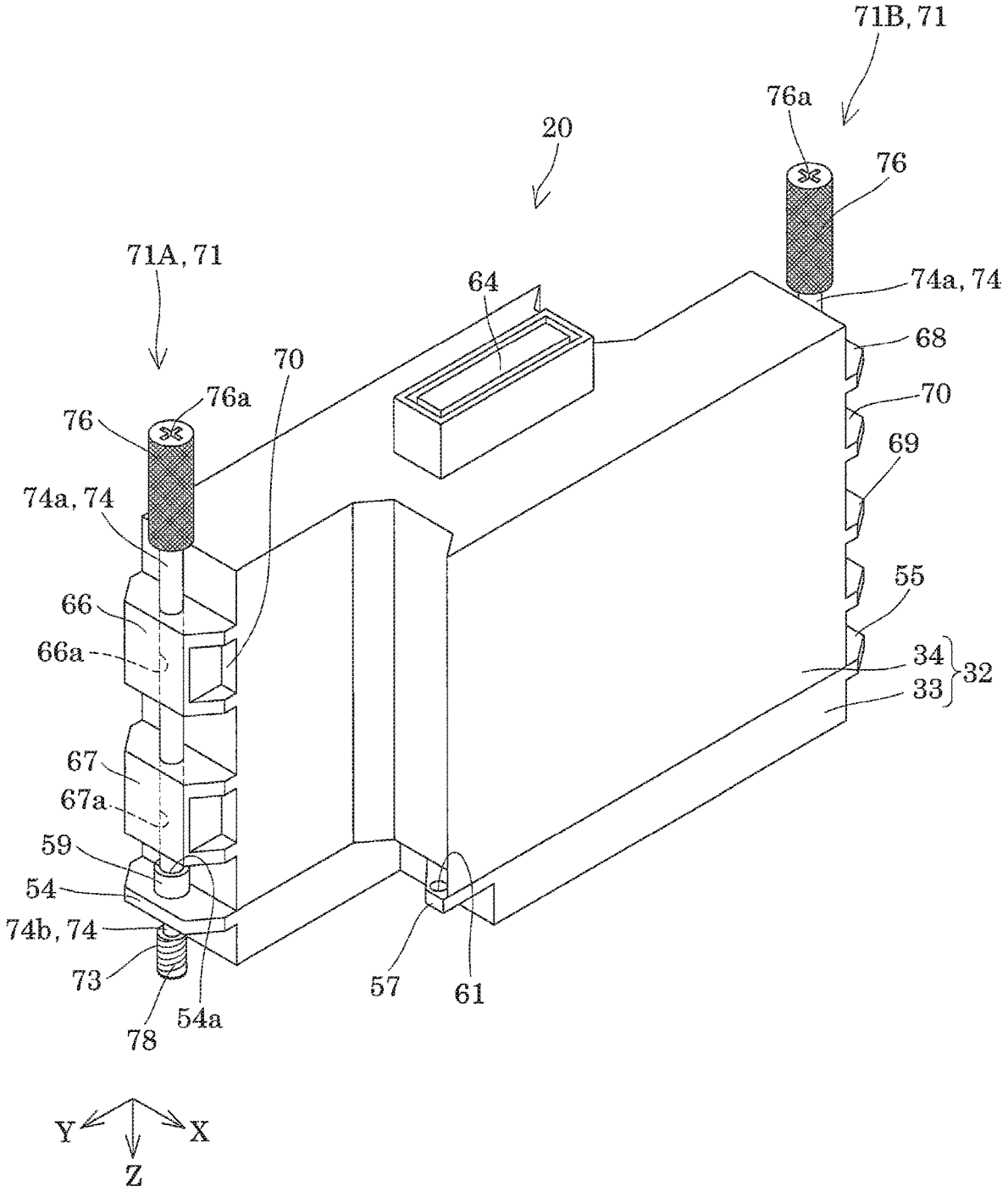
FIG. 5 is a perspective view of a recording head according to Embodiment 1.
Figure 6:
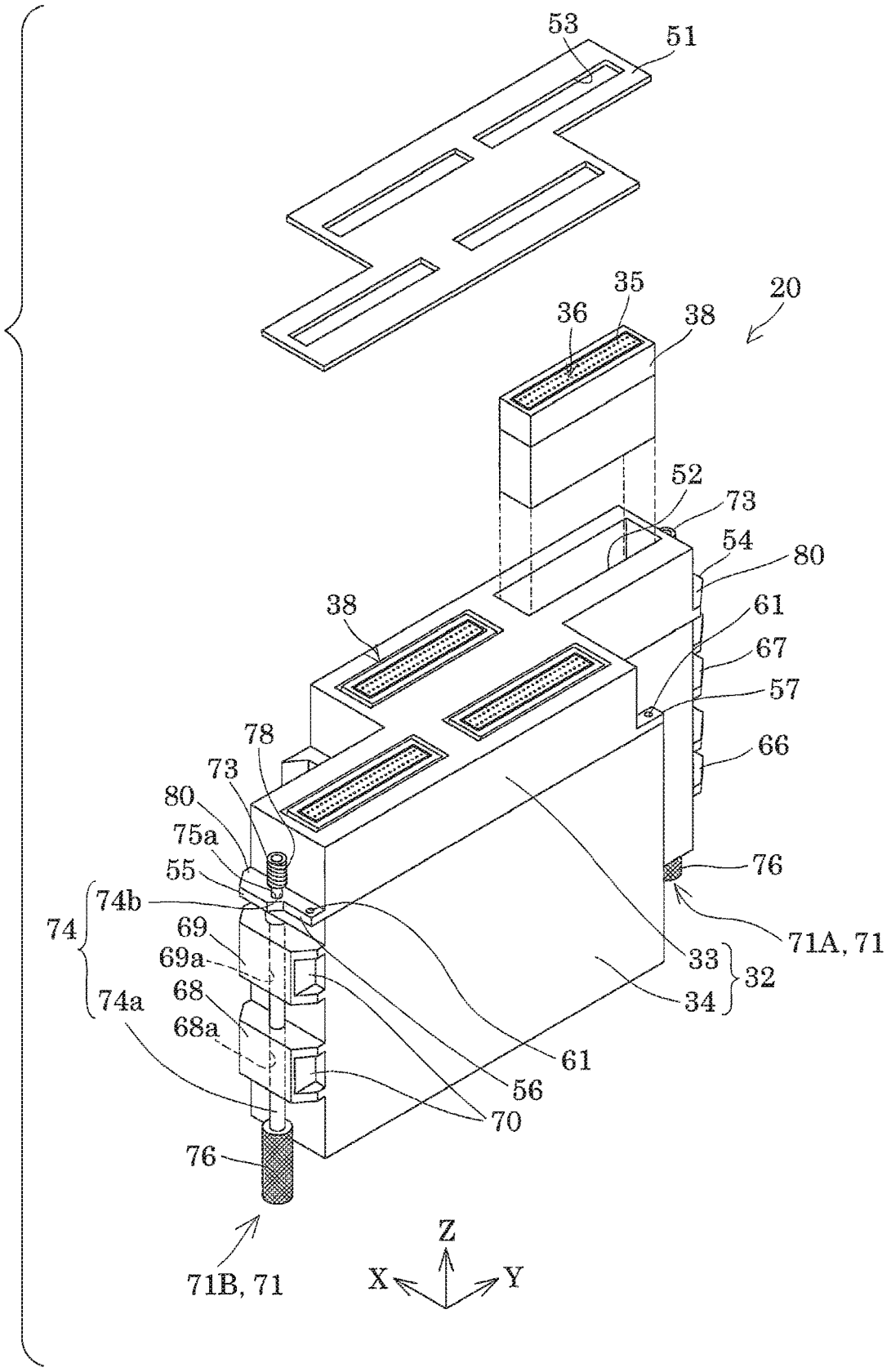
FIG. 6 is an exploded perspective view of the recording head according to Embodiment 1.
Figure 7:
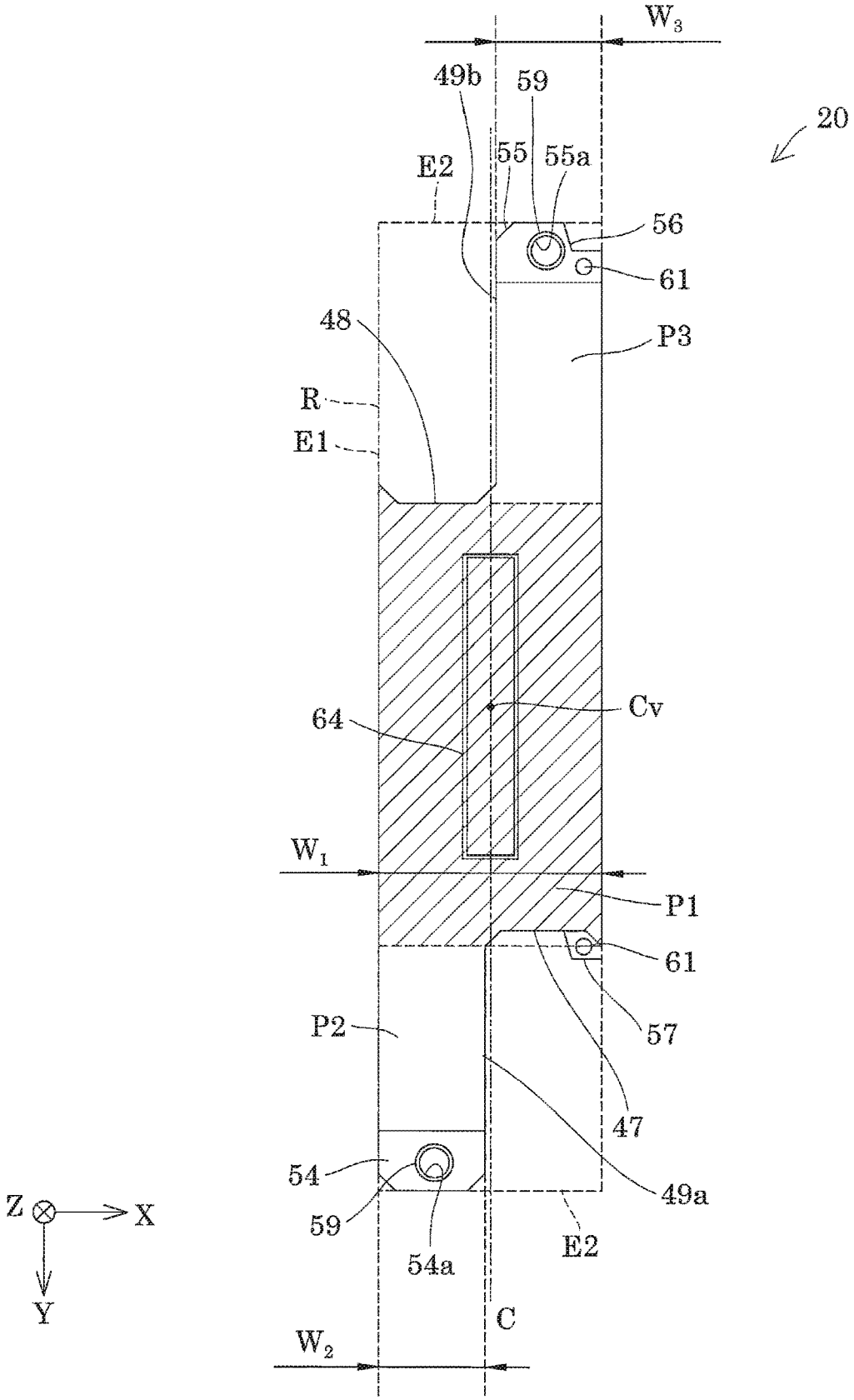
FIG. 7 is a plan view of the recording head according to Embodiment 1.
Figure 8:
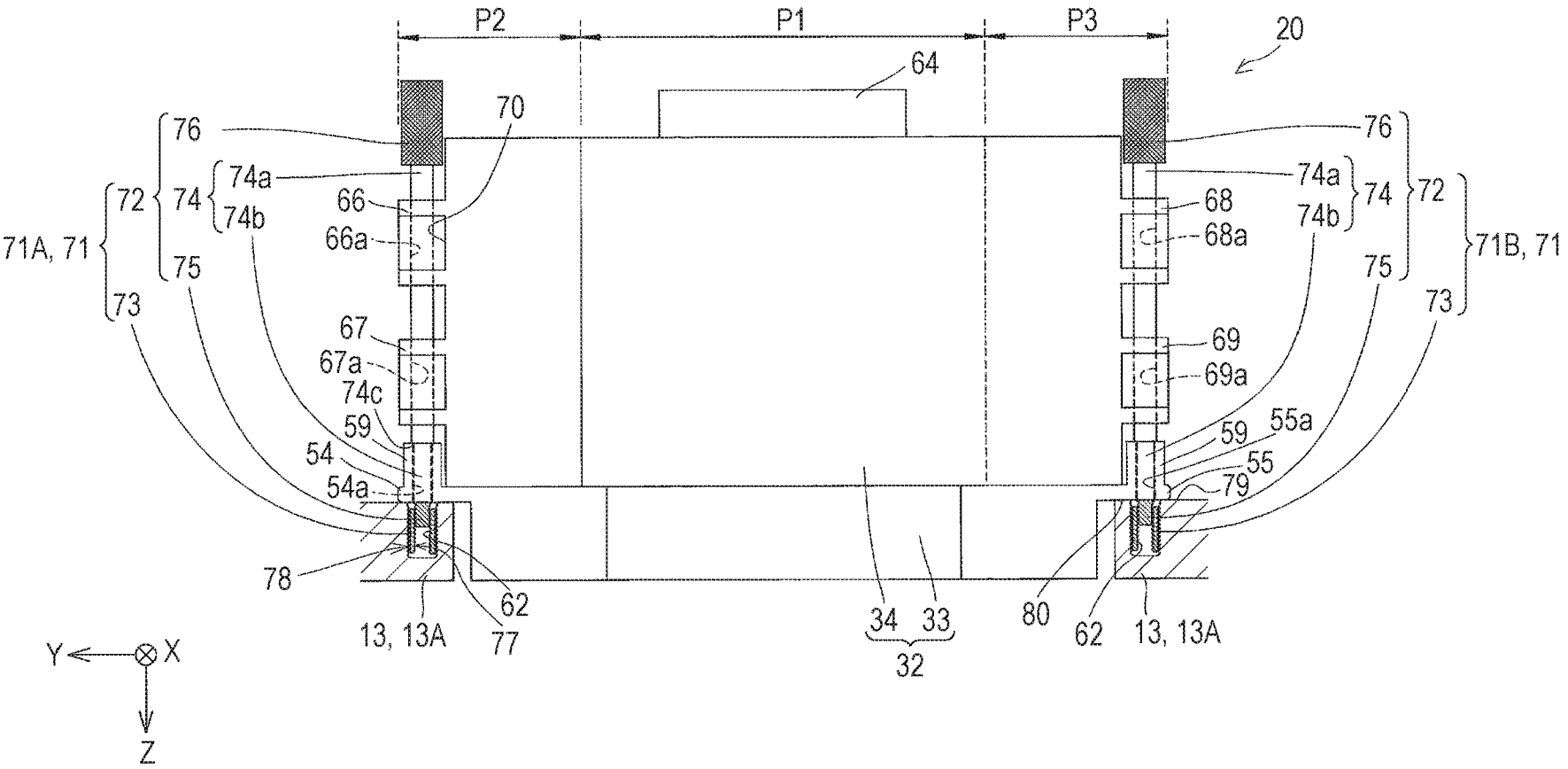
FIG. 8 is a side view of the recording head according to Embodiment 1.
Figure 9:
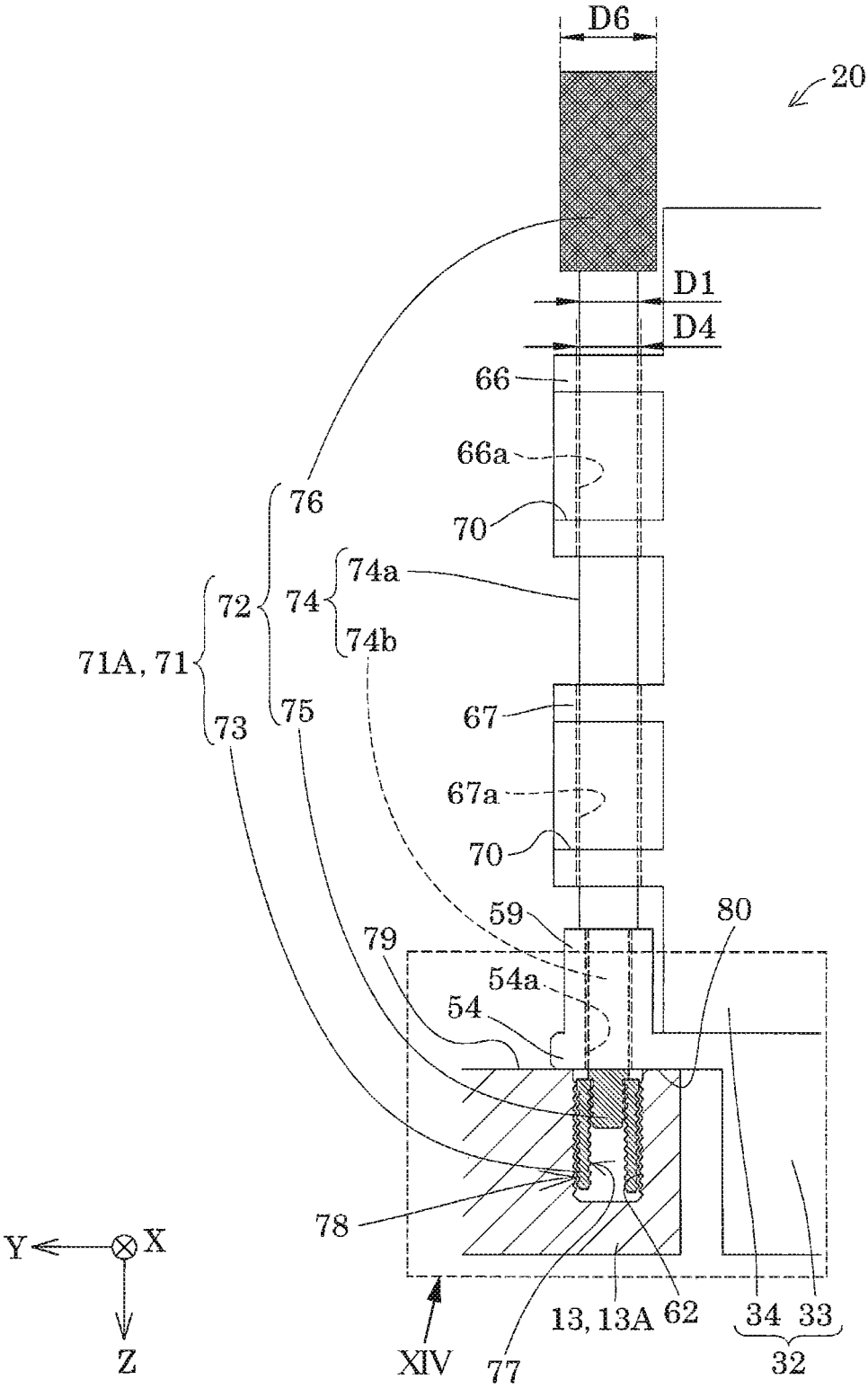
FIG. 9 is an enlarged side view of a principal portion of the recording head according to Embodiment 1.

The following describes the recording head 20 in the present embodiment with reference to FIGS. 5 to 9. FIG. 5 is a perspective view of the recording head seen obliquely from above. FIG. 6 is a perspective view of the recording head seen obliquely from below. FIG. 7 is a top view of the recording head. FIG. 8 is a side view of the recording head. FIG. 9 is an enlarged view of a first shaft portion 71A in FIG. 8 and structuring elements adjacent thereto. Protrusions 66, 67, 68, and 69 and shaft portions 71, which will be described later, are omitted from FIG. 7.

The recording head 20 includes a head case 32 composed of a first case 33 and a second case 34, which is stacked in the −Z direction on top of the first case 33. In the present embodiment, the head case 32 corresponds to a housing portion in the present disclosure. The first case 33 in the present embodiment is disposed on the +Z side to which the +Z direction leads. The +Z direction corresponds to a first direction in the present disclosure. The second case 34 in the present embodiment is disposed on the −Z side to which the −Z direction leads. The −Z direction corresponds to a second direction in the present disclosure. The second direction is opposite to the first direction. As illustrated in FIG. 6, the head chips 38 are accommodated in the first case 33. Each head chip 38 includes a nozzle plate 36, in which the nozzles 35 are formed. When the head unit 2 is standing still, ink is discharged from the nozzles 35 onto the medium S in the +Z direction.

Figure 10:
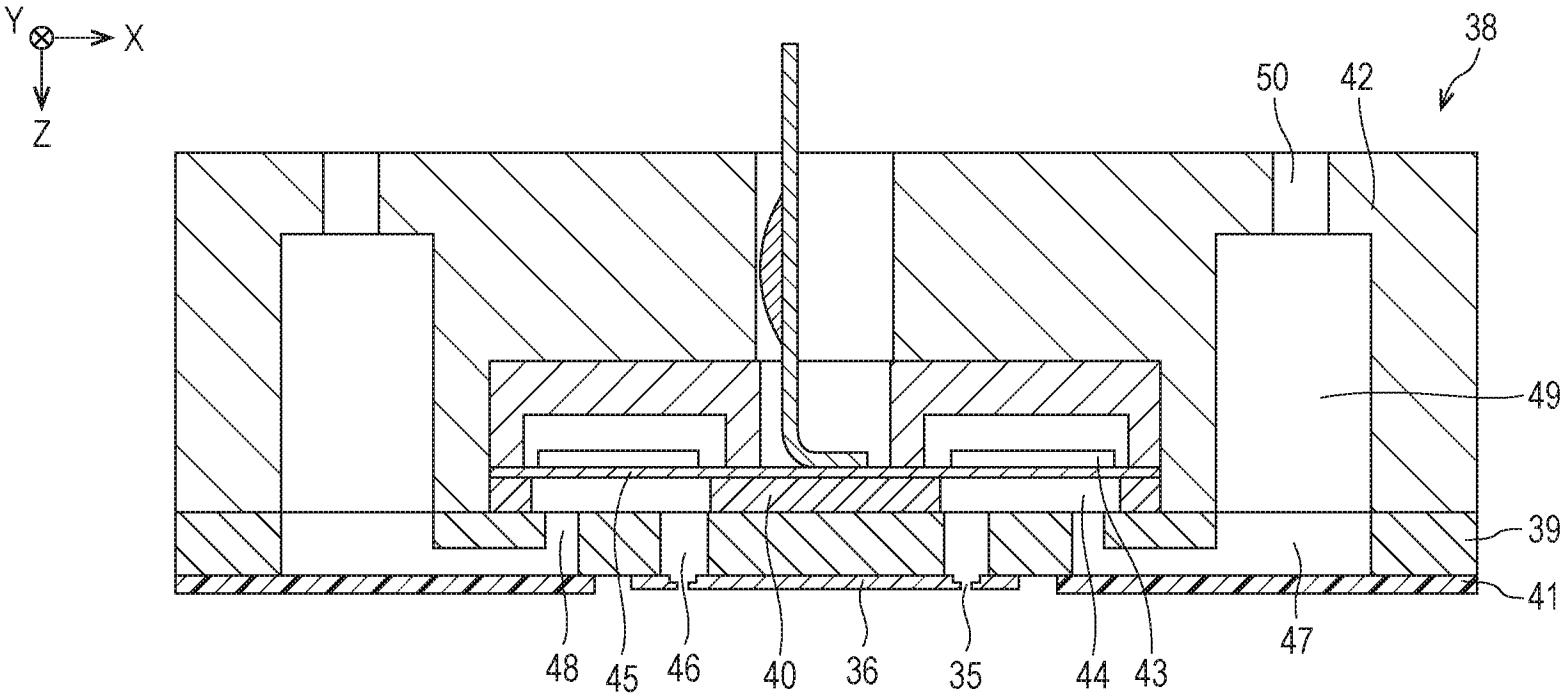
FIG. 10 is a sectional view of a head chip according to Embodiment 1.

The following describes the head chip 38 in the present embodiment with reference to FIG. 10. FIG. 10 is a sectional view of an example of the head chip.

The head chip 38 in the present embodiment is a unitized body including mainly the nozzle plate 36, a communication plate 39, a pressure chamber forming substrate 40, a vibration plate 45, a compliance substrate 41, the piezoelectric actuators 43, and a holder 42. These constituent members are stacked on one another and bonded to each other with an adhesive.

The pressure chamber forming substrate 40 in the present embodiment includes pressure chambers 44, each of which communicates with the corresponding one of the nozzles 35 formed in the nozzle plate 36. Each of the piezoelectric actuators 43 is provided for the corresponding one of the pressure chambers 44. The piezoelectric actuators 43 cause fluctuations in the pressure of ink in the respective pressure chambers 44; that is, the piezoelectric actuators 43 are energy generating elements that generate energy needed for ejection of ink from the nozzles 35 communicating with the pressure chambers 44, and the piezoelectric actuators 43 are also regarded as pressure generating elements. Each pressure chamber 44 and the corresponding piezoelectric actuator 43 are disposed with the vibration plate 45 therebetween. The vibration plate 45 defines part of each pressure chamber 44, whose opening on the −Z side is sealed with the vibration plate 45. In some embodiments, the pressure chamber forming substrate 40 and the vibration plate 45 may be formed as one member. The piezoelectric actuators 43 are stacked on top of the vibration plate 45 in a manner so as to correspond to the respective pressure chambers 44. Each of the piezoelectric actuators 43 in the present embodiment includes, for example, a first electrode (not illustrated), a piezoelectric layer (not illustrated), and a second electrode (not illustrated) stacked on the vibration plate 45 in the stated order. The piezoelectric actuator 43 designed as above is bent and distorted when an electric field is applied across the first and second electrodes according to the potential difference between the first and second electrodes.

The surface of the pressure chamber forming substrate 40 on the +Z side is bonded to the communication plate 39. When the communication plate 39 and the pressure chamber forming substrate 40 are viewed in plan in the direction from the −Z side to the +Z side, the area of the communication plate 39 is larger than the area of the pressure chamber forming substrate 40. The communication plate 39 in the present embodiment includes nozzle communication ports 46, common liquid chambers 47, and individual communication ports 48. Through the nozzle communication ports 46, the pressure chambers 44 communicate with the nozzles 35. Each of the common liquid chambers 47 is shared by the pressure chambers 44. Through the individual communication ports 48, the common liquid chamber 47 communicates with the pressure chambers 44. The common liquid chambers 47 are spaces extending in the ±Y directions, in which the nozzles 35 are aligned. In the present embodiment, two common liquid chambers 47 are provided for two respective rows of nozzles 35 formed in the nozzle plate 36. The individual communication ports 48 correspond to the pressure chambers 44 and are thus aligned in the ±Y directions, in which the nozzles are aligned. Each of the individual communication ports 48 communicates with an end portion of the corresponding pressure chamber 44, the end portion being opposite to another end portion communicating with the nozzle communication port 46.

The nozzle plate 36 having the nozzles 35 formed therein is bonded to a substantially middle part of the surface of the communication plate 39 on the +Z side. When the nozzle plate 36 and the communication plate 39 in the present embodiment are viewed in plan in the direction from the +Z side to the −Z side, the outside dimensions of the nozzle plate 36 are smaller than the outside dimensions of the communication plate 39. The nozzle plate 36 is bonded with, for example, an adhesive to a region being part of the surface of the communication plate 39 on the +Z side. The region is discretely located away from the openings of the common liquid chambers 47 and has the nozzle communication ports 46 provided thereon, with the nozzle communication ports 46 communicating with the nozzles 35. The nozzle plate 36 in the present embodiment has two rows of nozzles 35 aligned in the +Y direction. The compliance substrate 41 is bonded to a region being part of the surface of the communication plate 39 on the +Z side. The region is discretely located away from the nozzle plate 36. The compliance substrate 41 is positioned on the surface of the communication plate 39 on the +Z side and is bonded to the communication plate 39. The openings of the common liquid chambers 47 on the +Z side are sealed with the compliance substrate 41 accordingly. The compliance substrate 41 can be flexibly deformed to accommodate pressure fluctuations in the paths of ink, and in particular, pressure fluctuations in the common liquid chambers 47.

The pressure chamber forming substrate 40 and the communication plate 39 are fixed to the holder 42. The holder 42 accommodates introduction liquid chambers 49, which are located on opposite sides with the pressure chamber forming substrate 40 therebetween and communicate with the respective common liquid chambers 47 formed in the communication plate 39. The holder 42 has, on its surface on the −Z side, introduction ports 50, which communicate with the respective introduction liquid chambers 49. The introduction ports 50 communicate with the respective valve mechanism units 27 through channels of a channel member (not illustrated) accommodated in the second case 34. Ink fed from the valve mechanism unit 27 is introduced into the channel member, the introduction ports 50, the introduction liquid chambers 49, and the common liquid chambers 47. Ink in the common liquid chambers 47 is then drawn into the pressure chambers 44 through the individual communication ports 48.

The head chip 38 designed as above works as follows: the channels extending from the introduction liquid chamber 49, passing through the common liquid chambers 47 and the pressure chambers 44, and leading to the nozzles 35 are filled with ink, and the piezoelectric actuators 43 are then driven to cause fluctuations in the pressure of ink in the pressure chambers 44. The pressure fluctuations cause the ejection of ink from the specific nozzles 35. The head chip 38 is not limited to this example, and various well-known designs may be adopted into the head chip 38. An example of the energy generating elements that cause fluctuations in the pressure of ink in the pressure chamber 44 is a piezoelectric actuator including a piezoelectric material serving as an electromechanical transducer. When the piezoelectric actuator undergoes distortion, the volumetric capacity of a channel changes. This causes fluctuations in the pressure of ink in the channel, and consequently, ink droplets are discharged from the nozzle 35. Another example of the energy generating element is a heating element disposed in a channel. The heating element generates heat to form bubbles, which in turn cause the discharge of ink droplets from the nozzle 35. Still another example of the energy generating element is an electrostatic actuator that generates electrostatic force between the vibration plate and an electrode. The electrostatic force creates distortion in the vibration plate, which in turn causes the discharge of ink droplets from the nozzle 35.

As illustrated in FIG. 6, the head chips 38 (four head chips 38 in the present embodiment) are held in the head case 32. The direction in which the nozzles are aligned coincides with the +Y direction, and the positions of the head chips 38 are shifted (i.e., staggered) in the +X direction and are aligned in the +Y direction. Specifically, two rows of the head chips 38 aligned in the +Y direction lie side by side in the +X direction, with a predetermined pitch in the ±Y directions. With the head chips 38 being aligned in the +Y direction and being staggered, the nozzles 35 of the head chips 38 are partially redundant in the +Y direction, and continuous rows of the nozzle 35 in the +Y direction may be provided accordingly.

As illustrated in FIG. 7, the recording head 20 viewed in the −Z direction (i.e., the second direction), that is, the recording head 20 viewed in plan in the direction from the −Z side to the +Z side has an outer shape that conforms to the layout of the head chips 38. In the present embodiment, the outermost periphery of the recording head 20 is the outer periphery of the head case 32 (i.e., the housing portion), and the outer shape of the recording head 20 thus coincides with the outer shape of the head case 32 (i.e., the housing portion). FIG. 7 is a plan view of the recording head 20 viewed in the direction from the −Z side to the +Z side.

Specifically, when viewed in plan in the direction from the −Z direction to the +Z direction, the recording head 20 includes, as illustrated in FIG. 7, a first portion P1, a second portion P2, and a third portion P3. The second portion P2 adjoins the first portion P1 and protrudes in the +Y direction (i.e., the third direction) from the first portion P1. The third portion P3 adjoins the first portion P1 and protrudes in the −Y direction (i.e., the fourth direction) from the first portion P1. The first portion P1 in FIG. 7 is hatched.

The dimension of the second portion P2 and the dimension of the third portion P3 in the −X direction (i.e., the fifth direction) are each not more than half the dimension of the first portion P1 in the −X direction. That is, $W_2$ is not more than half of $W_1$ ($W_2 \leq W_1/2$), and $W_3$ is not more than half of $W_1$ ($W_3 \leq W_1/2$), where $W_1$ denotes the width of the first portion P1 in the −X direction, $W_2$ denotes the width of the second portion P2 in the −X direction, and $W_3$ denotes the width of the third portion P3 in the −X direction. In the present embodiment, the width $W_2$ of the second portion P2 is less than half the width $W_1$ of the first portion P1 ($W_2 < W_1/2$), and the width $W_3$ of the third portion P3 is less than half the width $W_1$ of the first portion P1 ($W_3 < W_1/2$).

The second portion P2 is located on the −X side (i.e., the side to which the −X direction leads, namely, the fifth side to which the fifth direction leads) relative to a center Cv, which is the center of the first portion P1 in the −X direction (i.e., the fifth direction). The third portion P3 is located on the +X side (i.e., the side to which the +X direction leads, namely, the sixth side to which the sixth direction leads) relative to the center Cv of the first portion P1 in the −X direction (i.e., the fifth direction). Referring to FIG. 7, a center line C passes through the center Cv and extends in the Y direction. In the present embodiment, the second portion P2 is located on the −X side relative to the center line C, and the third portion P3 is located on the +X side relative to the center line C. When viewed in plan in the +Z direction, the first portion P1 in the present embodiment is rectangular in shape with the center Cv in the −X direction. In some embodiments, the first portion P1 viewed in plan in the +Z direction may have a shape other than a rectangular shape. For example, the first portion P1 may be in the shape of a polygon such as a triangle or a pentagon or may be in the shape of a parallelogram. In such a case, the center of the first portion P1 in the −X direction refers to the center of the maximum width of the first portion P1 viewed in plan in the +Z direction. The second portion P2 is located on the −X side relative to the center, and the third portion P3 is located on the +X side relative to the center.

The first shaft portion 71A is provided to an end of the second portion P2 on the +Y side. A second shaft portion 71B is provided to an end of the third portion P3 on the −Y side. The first shaft portion 71A and the second shaft portion 71B will be described later.

The outer shape of the recording head 20 viewed in plan in the +Z direction may be described as follows. R denotes an imaginary rectangle having the minimum possible area that can enclose the recording head 20. The rectangle R has a long side E1 and a short side E2. The long side E1 coincides with a side of the head case 32 in the ±Y directions. The short side E2 coincides with another side of the head case 32 in the ±X directions. Referring to FIG. 7, C denotes the center line (i.e., the imaginary center line) passing through the center Cv (i.e., the imaginary center) of the rectangle R and being parallel to the long side E1 of the rectangle R.

With Cv as the center, the head case 32 viewed in plan includes the first portion P1 having the center line C passing therethrough, the second portion P2, and the third portion P3. The center line C passes through neither the second portion P2 nor the third portion P3. The dimension of the second portion P2 in the −X direction and the dimension of the third portion P3 in the −X direction, namely, the widths $W_2$ and $W_3$ are each not more than half the width $W_1$, that is, not more than half the dimension of the first portion P1 in the −X direction ($W_2 \leq W_1/2$, $W_3 \leq W_1/2$). In the present embodiment, the dimension of the second portion P2 in the −X direction and the dimension of the third portion P3 in the −X direction, namely, the widths $W_2$ and $W_3$ are each less than half the width $W_1$, that is, less than half the dimension of the first portion P1 in the −X direction ($W_2 < W_1/2$, $W_3 < W_1/2$). The second portion P2 is located on the +Y side relative to the first portion P1 and on the −X side relative to the center line C. The third portion P3 is located on the −Y side relative to the first portion P1 and on the +X side relative to the center line C. The third portion P3 is diagonally opposite to the second portion P2 with the center Cv therebetween. When viewed in plan in the +Z direction, the recording head 20 in the present embodiment is substantially symmetric about Cv, with two diagonally opposite corners cut out in substantially rectangular shapes from the rectangle R presented as a reference shape.

Each of the second portion P2 and the third portion P3 protrudes from the corresponding one of the opposite sides in the ±X directions, and the head chips 38 aligned in the +Y direction and staggered as above may fit in the second portion P2 and the third portion P3 accordingly. When the recording heads 20 are aligned in the ±Y directions, two adjacent ones of the recording heads 20 are positioned in such a manner that the position of the head chip 38 in the third portion P3 of one recording head 20 and the position of the head chip 38 in the second portion P2 of the other recording head 20 coincide with each other in the ±X directions. Owing to this layout, the nozzle 35 of the recording heads 20 are arranged in straight lines extending in the ±Y directions.

As illustrated in FIG. 6, the first case 33 includes accommodation portions 52, which are recessed in the first case 33 and define openings in a surface of the first case 33 in the +Z direction. The head chips 38 are fixed to a fixing plate 51 and fit in the accommodation portions 52. The openings defined by the accommodation portions 52 are sealed with the fixing plate 51. That is, each head chip 38 fits in the space defined by the fixing plate 51 and the corresponding accommodation portion 52. The accommodation portions 52 are provided for the respective head chips 38. Alternatively, one accommodation portion 52 may be shared by two or more head chips 38. The fixing plate 51 is, for example, a plate-like member made of metal and has exposure openings 53, which are arranged so as to correspond to the head chips 38. The nozzle plates 36 of the head chips 38 are exposed through the exposure openings 53. The exposure openings 53 in the present embodiment are discretely provided for the respective head chips 38. In the present embodiment, a lower surface of the fixing plate 51 (i.e., a surface that faces the medium S while printing is in progress) and exposed surfaces of the nozzle plates 36 in the exposure openings 53 of the fixing plate 51 correspond to the nozzle surface in the present disclosure. When viewed in plan in the direction from the +Z side to the −Z side, the nozzle surface in the present embodiment is long in the ±Y directions.

As illustrated in FIG. 7, a first flange portion 54 is provided to one of the end portions of the first case 33 in the ±Y directions. The end portion concerned corresponds to the second portion P2 and is located on the +Y side opposite to the side on which the first portion P1 is located. The first flange portion 54 protrudes in the +Y direction. A cylindrical portion 59 protrudes from a surface of the first flange portion 54 on the −Z side. A screw insertion hole 54*a* is formed in the cylindrical portion 59. The screw insertion hole 54*a* extends through the first flange portion 54 and the cylindrical portion 59 in the +Z direction. The screw insertion hole 54*a* defines openings on the +Z side and the −Z side in the Z direction. A second flange portion 55 is provided to one of the end portions of the first case 33 in the ±Y directions. The end concerned corresponds to the third portion P3 and is located on the −Y side opposite to the side on which the first portion P1 is located. The second flange portion 55 protrudes in the −Y direction. As with the cylindrical portion 59 on the first flange portion 54, another cylindrical portion 59 protrudes from a surface of the second flange portion 55 on the −Z side. A screw insertion hole 55*a* is formed in the cylindrical portion 59. The screw insertion hole 55*a* extends through the second flange portion 55 and the cylindrical portion 59 in the +Z direction. The screw insertion hole 54*a* of the first flange portion 54 corresponds to one of first through-holes in the preset disclosure. The screw insertion hole 55*a* of the second flange portion 55 corresponds to one of third through-holes in the present disclosure.

The first holding member 13A in the present embodiment has the fastening screw holes 62, which are screw holes corresponding to the screw insertion holes 54*a* and 55*a*. With the recording head 20 being locked in place, the position of each of the fastening screw holes 62 and the position of the corresponding one of the screw insertion holes 54*a* and 55*a* coincide with each other in the +Z direction. Specifically, the fastening screw holes 62 are blind holes extending partway through the first holding member 13A in its thickness direction from a surface of the first holding member 13A on the −Z side, that is, from a holding face 79 toward another surface of the first holding member 13A on the +Z side (see FIG. 14). The recording head 20 is held on the holding face 79. Alternatively, the fastening screw holes 62 may be through-holes extending through the first holding member 13A in the +Z direction. In place of the fastening screw holes 62 corresponding to the screw insertion holes 54*a* and 55*a*, the second through-holes 86 are provided in the second holding member 13B, which will be described later. The second through-holes 86 extend through the second holding member 13B in its thickness direction toward the +Z side. The recording head 20 in the present embodiment may be fixed to the first holding member 13A in the following manner. A first external threaded section 78 of the first shaft portion 71A, which will be described later, is inserted so as to pass through the screw insertion hole Ma and then fits into one of the fastening screw holes 62. Furthermore, a third external thread of the second shaft portion 71B is inserted so as to pass through the screw insertion hole 55*a*, which will be described later, and then fits into the other fastening screw hole 62. That is, the recording head 20 in the present embodiment is fixed to the first holding member 13A through screw fitting of the two shaft portions 71 in the first holding member 13A. The recording head 20 in the present embodiment may be fixed to the second holding member 13B in the following manner. A fastening screw 85 is inserted into the second through-hole 86 from the +Z side and then fits into a first internal threaded section 77 of the first shaft portion 71A in the second through-hole 86. Furthermore, another fastening screw 85 is inserted into the second through-hole 86 from the +Z side and then fits into a second internal thread of the second shaft portion 71B in the second through-hole 86. That is, the recording head 20 in the present embodiment is fixed to the second holding member 13B through screw fitting of the two shaft portions 71 in the second holding member 13B. The first shaft portion 71A and the second shaft portion 71B will be described later.

As mentioned above, the first flange portion 54 is provided to the end of the second portion P2, and the second flange portion 55 is provided to the end of the third portion P3. The first flange portion 54 has the screw insertion hole 54*a*, and the second flange portion 55 has the screw insertion hole 55*a*. This enables an increase in the center-to-center distance of the screw insertion holes 54*a* and 55*a* in the opposite end portions. With the nozzle surface being long in the ±Y directions, the screw insertion holes 54*a* and 55*a* are provided on the +Y side and the −Y side, respectively. The recording head 20 is fixed to the holding member 13 in such a manner that the first shaft portion 71A and the second shaft portions 71B are inserted into the screw insertion holes 54*a* and 55*a*, respectively. This enables accurate positioning of the recording head 20 on the holding member 13. Furthermore, the recording head 20 is securely fixed to the holding member 13. This is particularly advantageous when more than one recording head 20 is fixed to the holding member 13, in which the nozzles 35 of the individual recording heads 20 may be positioned with greater accuracy. The screw insertion holes 54*a* and 55*a* are provided in the first flange portion 54 and the second flange portion 55, which do not protrude from the main body of the recording head 20 in the ±X directions, that is, in the direction of short sides of the nozzle surface of the recording head 20. The head modules 18 including the recording heads 20 aligned in the ±Y directions, that is, in the directions of long sides of the recording heads 20 may thus be small in size in the ±X directions. The head unit 2 including the head modules 18 may also be small in size in the ±X directions accordingly.

The second flange portion 55 differs from the first flange portion 54 in that the second flange portion 55 has a cutout 56 and a positioning hole 61. The cutout 56 is left after a portion corresponding to a corner portion of the rectangle R is cut out. The positioning hole 61 is provided between the cutout 56 and a main body of the first case 33 and extends through the second flange portion 55 in the +Z direction. The cutout 56 of the second flange portion 55 is opposite to a third flange portion 57 in the ±Y directions with the first portion P1 therebetween. The third flange portion 57 is provided on one side of the first portion P1, that is, on the +Y side of the first portion P1. The positioning hole 61 of the second flange portion 55 is opposed to another positioning hole 61, which extends through the third flange portion 57 in the +Z direction. The positioning holes 61 correspond to positioning through-holes 63, which extend through the holding member 13 in the +Z direction (see FIG. 4). When the recording head 20 is fixed to the holding member 13, positioning pins (not illustrated) on a jig or the like may be inserted into the positioning through-holes 63 and the positioning holes 61 to lock the recording head 20 in place relative to the holding member 13. This enables positioning of the recording head 20. Alternatively, the positioning holes 61 or the positioning through-holes 63 corresponding to the positioning holes 61 may be replaced with positioning pins, each of which may be inserted into the corresponding one of the holes. This enables positioning of the recording head 20.

When viewed in plan in the direction from the −Z side to the +Z side, the cutout 56 of the second flange portion 55 is shaped to conform to the shape of the third flange portion 57. More specifically, the cutout 56 and the third flange portion 57 are geometrically similar, and the cutout 56 is slightly larger than the third flange portion 57. When the recording heads 20 are aligned in the ±Y directions, two adjacent ones of the recording heads 20 are positioned in such a manner that the third flange portion 57 of one recording head 20 fits in the cutout 56 of the second flange portion 55 of the other recording head 20, without the flange portions becoming a hindrance to each other.

The first flange portion 54, the second flange portion 55, and the third flange portion 57 are provided on one side in the ±Z directions, that is, on the −Z side of the first case 33 adjoining the second case 34. In the state in which the nozzle surface side of the recording head 20 is inserted in the aperture 30 of the holding member 13, the first flange portion 54, the second flange portion 55, and the third flange portion 57 lie off the aperture 30. When the nozzle surface side of the recording head 20 is inserted into the aperture 30 of the holding member 13, the first flange portion 54, the second flange portion 55, and the third flange portion 57 come into contact with the holding face 79 of the holding member 13 on the −Z side, and the recording head 20 is locked in place relative to the holding member 13 in the +Z direction accordingly.

The second case 34 accommodates mainly wiring (not illustrated) electrically coupled to the piezoelectric actuators 43 of the head chip 38 and the aforementioned channel member (not illustrated) through which ink is fed into the head chips 38. The second case 34 in the present embodiment is provided with a connection portion 64, which protrudes from the surface of the second case 34 on the −Z side and is coupled to external wiring.

The second case 34 is also provided with a first protrusion 66 and a second protrusion 67, which are located on an end portion of the second case 34 on the +Y side, that is, to an end of the portion corresponding to the second portion P2. When viewed in plan in the direction from the −Z side to the +Z side, the first protrusion 66 and the second protrusion 67 are geometrically identical to the first flange portion 54. The first protrusion 66 and the second protrusion 67 are aligned and discretely located away from each other in the ±Z directions. The first protrusion 66 and the second protrusion 67 are each thicker than the first flange portion 54 in the ±Z directions. The first protrusion 66 and the second protrusion 67 each have, on both sides in the ±X directions, thin-walled portions 70, which are recessed for weight reduction. Similarly, the second case 34 is also provided with a third protrusion 68 and a fourth protrusion 69, which are located on an end portion of the second case 34 on the −Y side, that is, to an end of the portion corresponding to the third portion P3. When viewed in plan in the direction from the −Z side to the +Z side, each of the third protrusion 68 and the fourth protrusion 69 and the corresponding one of the first protrusion 66 and the second protrusion 67 are mirror images of each other in the ±Y directions. The third protrusion 68 and the fourth protrusion 69 are aligned and discretely located away from each other in the ±Z directions. As with the first protrusion 66 and the second protrusion 67, the third protrusion 68 and the fourth protrusion 69 are each thicker than the second flange portion 55 in the ±Z directions and each have, on both side in the ±X directions, thin walled portions 70.

The first flange portion 54, the first protrusion 66, and the second protrusion 67 are provided on the +Y side of the head case 32 and protrude in the +Y direction. The second flange portion 55, the third protrusion 68, and the fourth protrusion 69 are provided on the −Y side of the head case 32 and protrude in the −Y direction. The first flange portion 54, the second flange portion 55, the first protrusion 66, the second protrusion 67, the third protrusion 68, and the fourth protrusion 69 may hereinafter also collectively referred to as protrusions where appropriate.

The head case 32 in the present embodiment is provided with two shaft portions 71, which are attached to the respective end portions opposite to each other in the ±Y direction. In the present embodiment, the shaft portion 71 on the +Y side is referred to as the first shaft portion 71A, and the shaft portion 71 on the −Y side is referred to as the second shaft portion 71B. The first shaft portion 71A and the second shaft portion 71B in the present embodiment are structurally the same. The first shaft portion 71A is inserted in a screw insertion hole 66*a*, a screw insertion hole 67*a*, and the screw insertion hole 54*a*, which extend in the ±Z directions through the first protrusion 66, the second protrusion 67, and the first flange portion 54 on the +Y side of the head case 32. The second shaft portion 71B is inserted in a screw insertion hole 68*a*, a screw insertion hole 69*a*, and the screw insertion hole 55*a*, which extend in the ±Z directions through the third protrusion 68, the fourth protrusion 69, and the second flange portion 55 on the −Y side of the head case 32. The screw insertion holes 66*a*, 67*a*, and 54*a* in the present embodiment correspond to the first through-holes in the present disclosure. The screw insertion holes 68*a*, 69*a*, and 55*a* in the present embodiment correspond to the third through-holes in the present disclosure.

Figure 14:
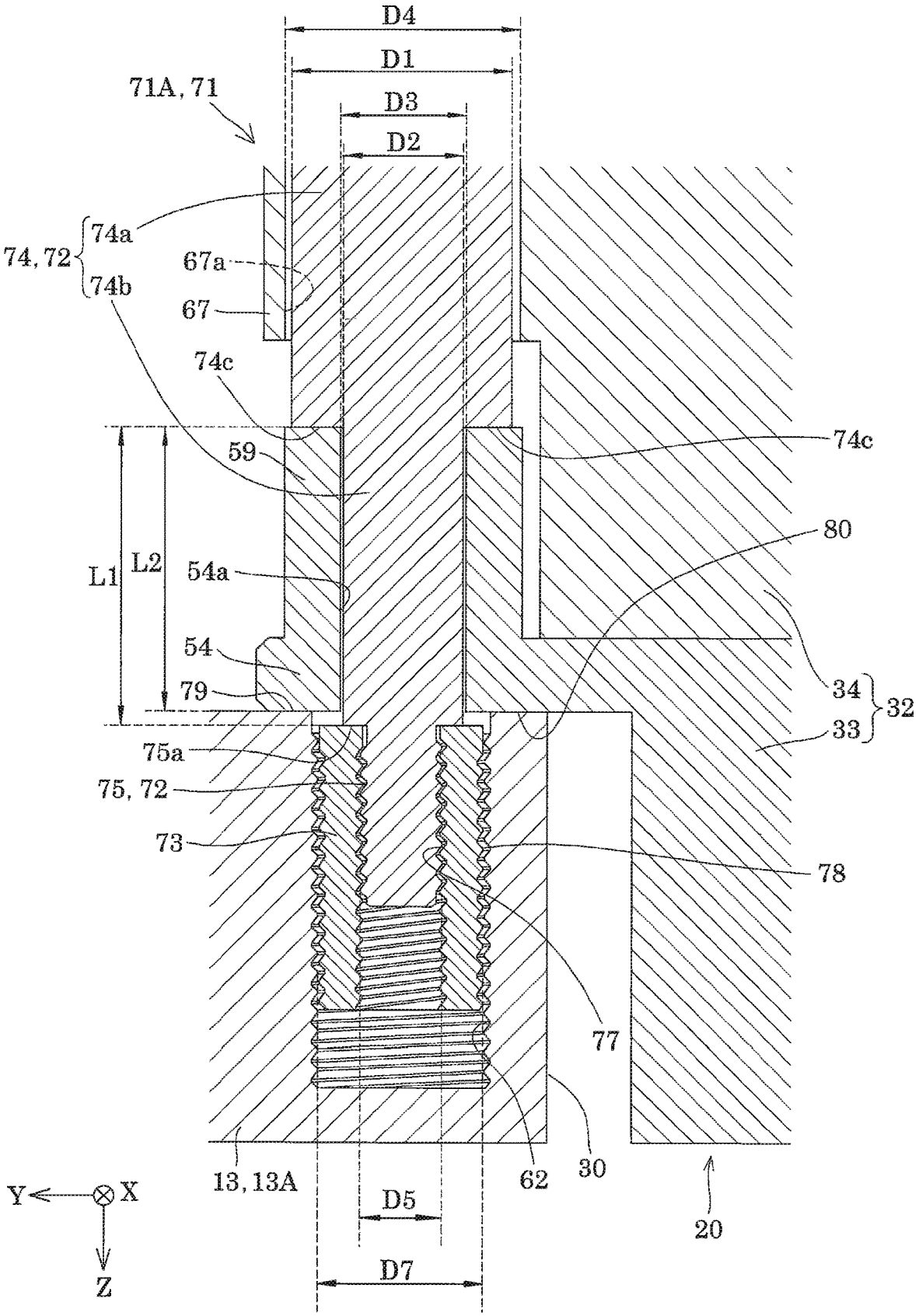
FIG. 14 is a sectional view of a first flange portion fitted with structuring elements adjacent thereto, illustrating a state in which the recording head according to Embodiment 1 is fixed to a first holding member.

The following describes, with reference to FIG. 14, the first shaft portion 71A, which is one of the shaft portions 71 in the present embodiment and is located on the end portion of the head case 32 on the +Y side. FIG. 14 is an enlarged sectional view of Region XIV in FIG. 9. As illustrated in FIGS. 9 and 14, the first shaft portion 71A in the present embodiment includes a shaft main body 72 and a cylindrical member 73. The shaft main body 72 extends in the +Z direction (i.e., the first direction) and includes a main body section 74, a second external threaded section 75, and a knob section 76. In the present embodiment, the main body section 74, the second external threaded section 75, and the knob section 76 constituting the shaft main body 72 are inseparable, that is, provided as a single component. In some embodiments, these sections may be discrete components and may be bonded to each other or screwed so as to be combined into one piece.

The main body section 74 includes a large-diameter section 74*a* and a small-diameter section 74*b*. The large-diameter section 74*a* is located on the −Z side, and the small-diameter section 74*b* is located on the +Z side relative to the large-diameter section 74*a*. D1 is greater than D2, where D1 denotes the outside diameter of the large-diameter section 74*a* and D2 denotes the outside diameter of the small-diameter section 74*b*. The large-diameter section 74*a* and the small-diameter section 74*b* have a common axis. Owing to the difference in outside diameter, a step face facing the +Z side lies between the large-diameter section 74*a* and the small-diameter section 74*b*. The step face lying between the large-diameter section 74*a* and the small-diameter section 74*b* and facing the +Z side is a first face 74*c*, which comes into contact with an opening face in which an opening on the −Z side is defined by the screw insertion hole 54*a* of the first flange portion 54. The outside diameter D1 of the large-diameter section 74*a* is greater than D3, which denotes the inside diameter of the screw insertion hole 54*a* of the first flange portion 54. The outside diameter D2 of the small-diameter section 74*b* is smaller than the inside diameter D3 of the screw insertion hole 54*a*. When the shaft main body 72 is inserted into the screw insertion hole 54*a* through the opening on −Z side, the first face 74*c* comes into contact with the opening face in which the opening on the −Z side is defined by the screw insertion hole 54*a* of the first flange portion 54. The movement of the shaft main body 72 in the +Z direction is restricted accordingly. The main body section 74 is inserted in the screw insertion hole 66*a* of the first protrusion 66, the screw insertion hole 67*a* of the second protrusion 67, and the screw insertion hole 54*a* of the first flange portion 54. Specifically, the large-diameter section 74*a* of the main body section 74 is inserted in the screw insertion hole 66*a* of the first protrusion 66 and the screw insertion hole 67*a* of the second protrusion 67. D4, which denotes the inside diameter of each of the screw insertion holes 66*a* and 67*a*, is slightly larger than the outside diameter D1 of the large-diameter section 74*a*. The inside diameter D4 of the screw insertion holes 66*a* and 67*a* is larger than the inside diameter D3 of the screw insertion hole 54*a* of the first flange portion 54. It is not required that the inside diameter D4 of the screw insertion hole 66*a* be equal to the inside diameter D4 of the screw insertion hole 67*a*; however, it is required that each of the inside diameter D4 of the screw insertion holes 66*a* and the inside diameter D4 of the screw insertion hole 67*a* be larger than the outside diameter D1 of the large-diameter section 74*a*.

The second external threaded section 75 is provided to a tip of the main body section 74 in the Z direction, that is, an end portion of the small-diameter section 74*b* on the +Z side and has an external thread, that is, threads are cut on an outer circumferential surface of the second external threaded section 75. The second external threaded section 75 of the shaft main body 72 in the present embodiment corresponds to a second external thread. D5, which denotes the major diameter of the second external threaded section 75, is smaller than the inside diameter D3 of the screw insertion hole 54*a* of the first flange portion 54. The insertion of the second external threaded section 75 into the screw insertion hole 54*a* of the first flange portion 54 from the −Z side to the +Z side is thus possible. The second external threaded section 75 inserted in the screw insertion hole 54*a* is located on the +Z side relative to the screw insertion hole 54*a*, that is, on the +Z side relative to an opening face in which an opening on the +Z side is defined by the screw insertion hole 54*a* of the first flange portion 54. The major diameter D5 of the second external threaded section 75 is the diameter of the largest part of the second external threaded section 75.

The outside diameter D2 of the small-diameter section 74*b* of the main body section 74 is greater than the major diameter D5 of the second external threaded section 75. Owing to the difference in outside diameter, a step face facing the +Z side lies between the small-diameter section 74*b* and the second external threaded section 75. The step face lying between the small-diameter section 74*b* and the second external threaded section 75 and facing the +Z side is a second face 75*a*, which comes into contact with the an end face of the cylindrical member 73 on the −Z side when the second external threaded section 75 fits into the cylindrical member 73. The second face 75*a* restricts the movement of the cylindrical member 73 in the −Z direction accordingly.

The knob section 76 is provided to a proximal end of the main body section 74 in the Z direction, that is, an end of the large-diameter section 74*a* on the −Z side. The knob section 76 is located on the −Z side relative to the screw insertion hole 66*a* of the first protrusion 66. D6, which denotes the outside diameter of the knob section 76 in the present embodiment, is greater than the outside diameter D1 of the large-diameter section 74*a* of the main body section 74. The outside diameter D6 of the knob section 76 is greater than the inside diameter D4 of the screw insertion holes 66*a* and 67*a*. When the shaft main body 72 is inserted into the screw insertion hole 66*a* of the first protrusion 66 from the −Z side, the knob section 76 comes into contact with a face in which an opening on the −Z side is defined by the screw insertion hole 66*a* of the first protrusion 66. The movement of the shaft main body 72 in the +Z direction is restricted accordingly. The shaft main body 72 is thus kept from moving in the +Z direction beyond the screw insertion hole 66*a*, and the shaft main body 72 is kept from slipping through the screw insertion holes 66*a*, 67*a*, and 54*a* in the +Z direction.

The knob section 76 has, on an outer circumferential surface thereof, fine protrusions and recesses, namely, knurls. The knurls on the surface of the knob section 76 reduce the possibility that the knob section 76 pinched to rotate the shaft main body 72 will slip out of fingers. Instead having knurls, the surface of the knob section 76 may be embossed or may have irregular asperities.

The knob section 76 has, on its face on the −Z side, a cross recess 76*a*, which may be a cross recess for screws that is specified in Japanese Industrial Standard (JIS) B 1012: 1985 and is commonly called "plus". A tool such as a screwdriver can be received in the cross recess 76*a* in the face of the knob section 76 on the −Z side, and the first shaft portion 71A can be securely fastened to the holding member 13 accordingly. Instead of having the cross recess 76*a*, the knob section 76 may have, on its face on the −Z side, a slot (i.e., a straight groove commonly called "minus"), a plus-minus slot (having two crossing recess, one of which is a slot longer than the other recess), a hexagon socket (i.e., a hexagonal opening), a square socket (i.e., a square opening), or a specially-designed groove or recess in which commonly used screwing tools cannot be received.

Figure 11:
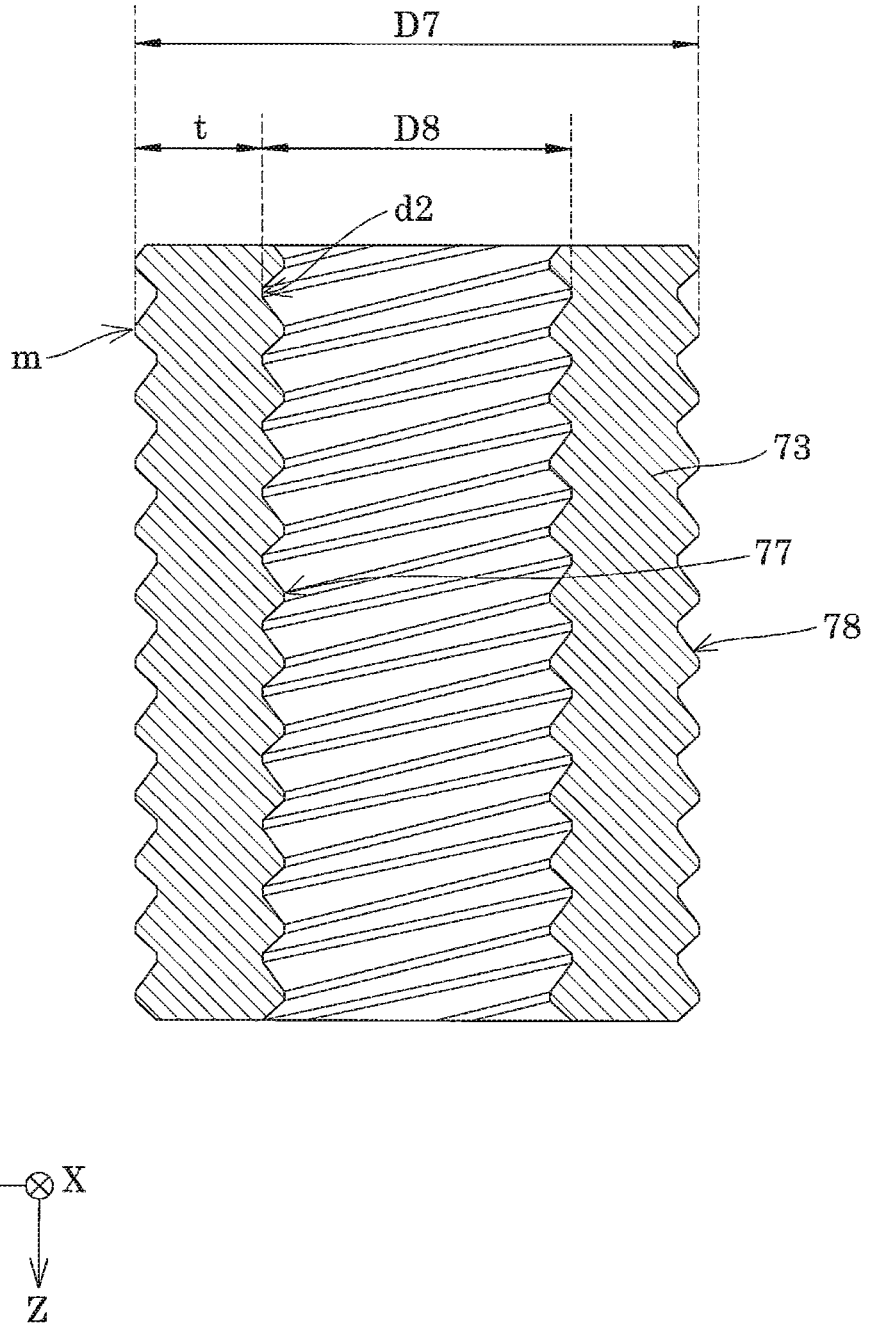
FIG. 11 is a sectional view of a cylindrical member according to Embodiment 1.

The following describes the cylindrical member 73 in the present embodiment with reference to FIG. 11. FIG. 11 is a sectional view of the cylindrical member.

As illustrated in FIGS. 9, 11, and 14, the cylindrical member 73 is a hollow structure having openings at its end portions in the axial direction, that is, in the ±Z directions. The cylindrical member 73 has the first internal threaded section 77, into which the second external threaded section 75 of the shaft main body 72 fits. The first internal threaded section 77 has an internal thread, namely, valley-shaped grooves, which are provided on an inner circumferential surface of the cylindrical member 73. The thread of the second external threaded section 75 can be fit in the grooves. The first internal threaded section 77 of the cylindrical member 73 in the present embodiment corresponds to a first internal thread. As the second external threaded section 75 of the shaft main body 72 fits into the first internal threaded section 77 of the cylindrical member 73, the cylindrical member 73 moves in the −Z direction with respect to the shaft main body 72. Consequently, the end face of the cylindrical member 73 on the −Z side comes into contact with the second face 75*a* of the shaft main body 72, and the movement of the cylindrical member 73 in the −Z direction with respect to the shaft main body 72 is restricted, as mentioned above. The second face 75*a* and the end face of the cylindrical member 73 constitute a restriction section of the first shaft portion 71A in the present embodiment. The restriction section restricts the movement of the cylindrical member 73 in the −Z direction with respect to the shaft main body 72. The restriction section included in the first shaft portion 71A to restrict the movement of the cylindrical member 73 in the −Z direction with respect to the shaft main body 72 offers an advantage in that the shaft main body 72 and the cylindrical member 73 are securely fastened to each other. Another advantage of the restriction section is that the cylindrical member 73 is rotated in conjunction with the shaft main body 72, which is in turn kept from turning free.

The cylindrical member 73 has the first external threaded section 78. The first external threaded section 78 has a first external thread, that is, threads are cut on an outer circumferential surface of the cylindrical member 73. The threads of the first external threaded section 78 can be fit in the fastening screw hole 62. The first external threaded section 78 of the cylindrical member 73 in the present embodiment corresponds to the first external thread. That is, the cylindrical member 73 includes the first internal threaded section 77 on its inner circumferential surface and the first external threaded section 78 on its outer circumferential surface. The cylindrical member 73 is, for example, ILISERT (registered trademark). The use of ILISERT (registered trademark) as the cylindrical member 73 eliminates the need for in-house manufacturing of the cylindrical member 73. ILISERT is widely available and low in price.

The cylindrical member 73 is fastened to a tip of the shaft main body 72 in such a manner that the first internal threaded section 77 on the inner circumferential surface of the cylindrical member 73 fits onto the second external threaded section 75 at the tip of the shaft main body 72. Thus, the first shaft portion 71A has the first external threaded section 78 (i.e., the first external thread) and the first internal threaded section 77 (i.e., the first internal thread) on the +Z side (i.e., the first side to which the first direction leads). The cylindrical member 73 fits onto the second external threaded section 75 provided to the end portion of the shaft main body 72 on the +Z side when the shaft main body 72 is inserted into the screw insertion holes 66*a*, 67*a*, and 54*a*. The cylindrical member 73 is thus located on the +Z side relative to the screw insertion holes 66*a*, 67*a*, and 54*a*. D7, which denotes the outside diameter of the cylindrical member 73, is greater than the inside diameter of the screw insertion hole that is located on the +Z side relative to the other screw insertion holes. That is, the outside diameter D7 of the cylindrical member 73 is greater than the inside diameter D3 of the screw insertion hole 54*a* of the first flange portion 54. The outside diameter of the cylindrical member 73 is the major diameter of the first external threaded section 78. The cylindrical member 73 having the outside diameter D7 greater than the inside diameter D3 of the screw insertion hole 54*a* offers the following advantages. When the shaft portion 71 is lifted with the knob section 76 being pinched, the end face of the cylindrical member 73 on the −Z side comes into contact with an opening face in which the an opening on the +Z side is defined by the screw insertion hole 54*a* of the first flange portion 54, the movement of the first shaft portion 71A in the −Z direction is restricted accordingly. This minimizes the possibility of accidental withdrawal of the first shaft portion 71A from the head case 32. Pinching the knob section 76 is all that is required of the user to lift the recording head 20. This provides ease of handling and positioning of the recording head 20, which may be readily locked in place relative to the holding member 13. This is particularly advantageous in that the recording heads 20 densely aligned on the holding member 13 may be handled with the knob sections 76 being pinched by the user. The recording head 20 may thus be readily positioned and locked in place relative to the holding member 13. As mentioned above, the recording head 20 that need replacing may be easily removed with the knob section 76 being pinched.

The shaft main body 72 is designed in such a manner that L1 is greater than L2. L1 denotes the distance between the first face 74*c* and the second face 75*a* in the axial direction, that is, in the ±Z directions. L2 denotes the length of the screw insertion hole 54*a* of the first flange portion 54. When the cylindrical member 73 fits onto the second external threaded section 75 of the shaft main body 72 inserted in the screw insertion hole 54*a*, the end face of the cylindrical member 73 on the −Z side comes into contact with the second face 75*a*, and the cylindrical member 73 and the shaft main body 72 are securely fastened to each other. The cylindrical member 73 may thus be rotated in conjunction with the shaft main body 72.

In the present embodiment, the outside diameter D7 of the cylindrical member 73 is greater than the inside diameter D3 of the screw insertion hole 54*a*, which is located on +Z side relative to the other screw insertion holes. In some embodiments, the outside diameter D7 of the cylindrical member 73 may be greater than the inside diameter of at least one of the first through-holes (i.e., the screw insertion holes 66*a*, 67*a*, and 54*a*). This enables the cylindrical member 73 to come into contact with at least one of the first protrusion 66, the second protrusion 67, and the first flange portion 54 and to minimize the possibility of withdrawal of the first shaft portion 71A from the head case 32 accordingly. The way the cylindrical member 73 is attached to the shaft main body 72 will be described in detail later. In brief, the shaft main body 72 is inserted into the screw insertion holes 66*a*, 67*a*, and 54*a* from the −Z side, and the second external threaded section 75 of the shaft main body 72 protrudes on the +Z side relative to the first flange portion 54 accordingly. The cylindrical member 73 then fits onto the second external threaded section 75.

Referring to FIG. 11, the difference between the outside diameter D7 (i.e., the major diameter of the first external threaded section 78) of the cylindrical member 73 and D8, which denotes the major diameter of the first internal threaded section 77, is preferably not less than 1.0 mm (D7−D8≥1.0 mm). When the difference between the outside diameter D7 (i.e., the major diameter of the first external threaded section 78) of the cylindrical member 73 and the major diameter D8 of the first internal threaded section 77 of the cylindrical member 73 is not less than 1.0 mm, the cylindrical member 73 has increased rigidity. The first external threaded section 78 of the cylindrical member 73 is preferably at least one size larger than the first internal threaded section 77 of the cylindrical member 73. The nominal diameter of the first internal threaded section 77 may be M3, which denotes a nominal diameter for matric threads specified in JIS B 0205: 2001; that is, the major diameter D8 of the first internal threaded section 77 may be 3.0 mm. In this case, the nominal diameter of the first external threaded section 78 is preferably not smaller than M4, that is, the outside diameter D7 (i.e., the major diameter of the first external threaded section 78) is preferably not less than 4.0 mm. Specifically, the expression "the first external threaded section 78 is at least one size larger than the first internal threaded section 77" herein means that the nominal diameter of the first external threaded section 78 is at least one size larger than screws having a nominal diameter indicated by an integer numerical number, such as M1, M2, M3, M4, M5, M6, M8, M10, M12, M14, or M16. When the difference between the outside diameter D7 (i.e., the major diameter of the first external threaded section 78) and the major diameter D8 of the first internal threaded section 77 is not less than 1.0 mm, t is not less than 0.5 mm, where t denotes the thickness of the cylindrical member 73 in the X-Y plane between a crest m and a root d2. The crest m defines the outside diameter D7 (i.e., the major diameter of the first external threaded section 78) of the cylindrical member 73, and the root d2 defines the major diameter of the first internal threaded section 77 of the cylindrical member 73.

The target tightening torque on the first internal threaded section 77 having a nominal diameter of M3 is 1.1 N·m, and the target tightening torque on the first external threaded section 78 having a nominal diameter of M4 is 2.7 N·m. ILISERT (registered trademark) that yields strength greater than or equal to the target tightening torque may be used as the cylindrical member 73. For example, the strength of ILISERT (registered trademark) that is M4 threaded on the outer circumferential surface and M3 threaded on the inner circumferential surface is 3.3 N·m of torque on M3 and 5.0 N·m M4. It is required that the cylindrical member 73 be a component that yields strength greater than or equal to the target tightening torque.

The second shaft portion 71B, which is the other one of the shaft portions 71 in the present embodiment and is located on the end portion of the head case 32 on the −Y side, is structurally identical to the first shaft portion 71A. The first protrusion 66, the second protrusion 67, and the first flange portion 54 correspond to the third protrusion 68, the fourth protrusion 69, and the second flange portion 55, respectively. The first shaft portion 71A is inserted in the screw insertion hole 66*a* of the first protrusion 66, the screw insertion hole 67*a* of the second protrusion 67, and the screw insertion hole 54*a* of the first flange portion 54. Similarly, the second shaft portion 71B is inserted in the screw insertion hole 68*a* of the third protrusion 68, the screw insertion hole 69*a* of the fourth protrusion 69, and the screw insertion hole 55*a* of the second flange portion 55. As with the first shaft portion 71A, the second shaft portion 71B includes a shaft main body 72 and a cylindrical member 73. The first external threaded section 78 (i.e., the first external thread) and the first internal threaded section 77 (i.e., the first internal thread) of the first shaft portion 71A correspond to the third external thread and the second internal thread of the second shaft portion 71B, respectively. The dimensional relationship between the second shaft portion 71B and each of the screw insertion holes 68*a*, 69*a*, and 55*a* provided for the second shaft portion 71B is identical to the dimensional relationship between the first shaft portion 71A and each of the screw insertion holes 66*a*, 67*a*, and 54*a* provided for the first shaft portion 71A.

Figure 12:
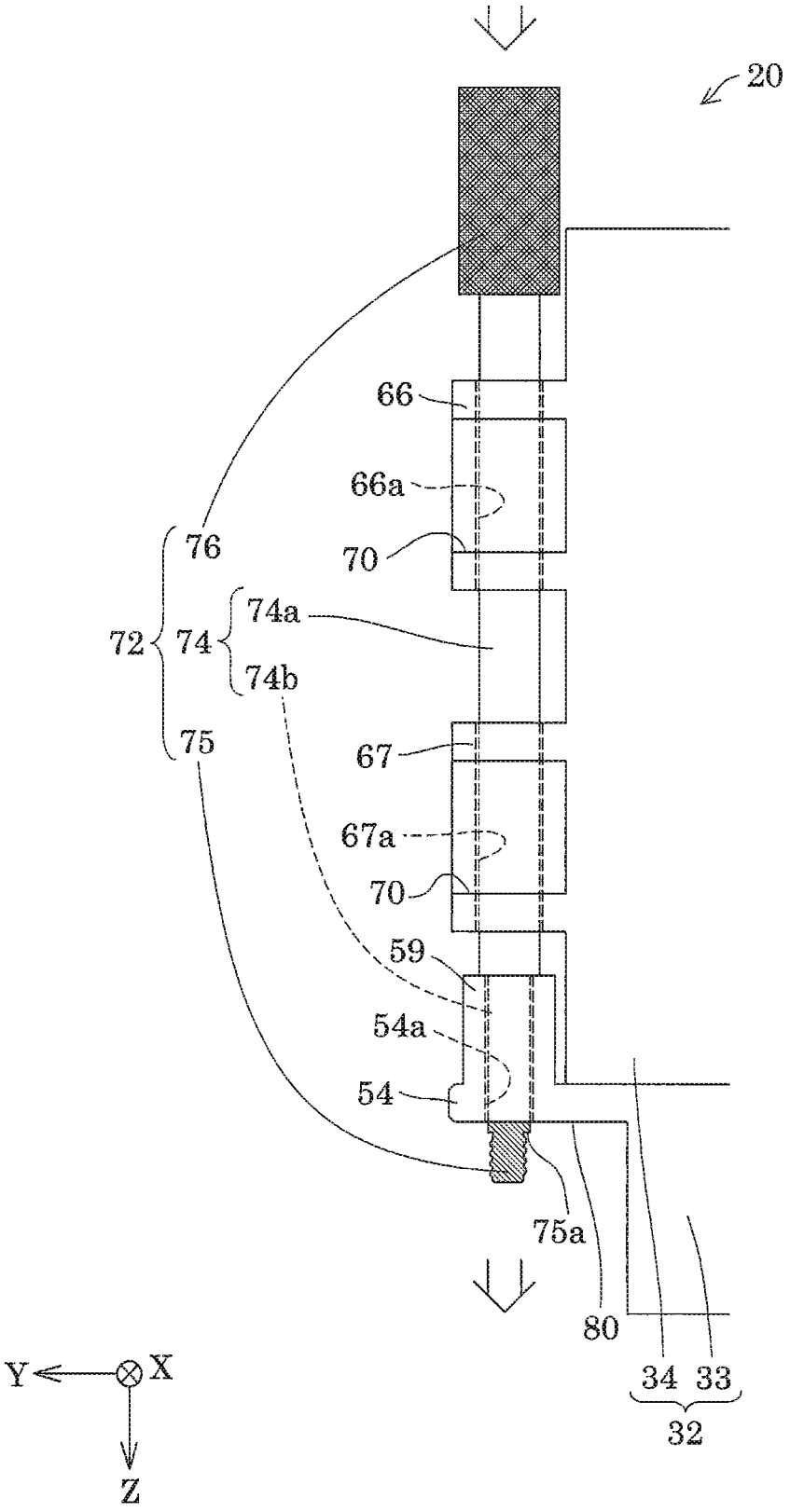
FIG. 12 is a side view of a principal portion of the recording head according to Embodiment 1, illustrating a method for producing a recording head.
Figure 13:
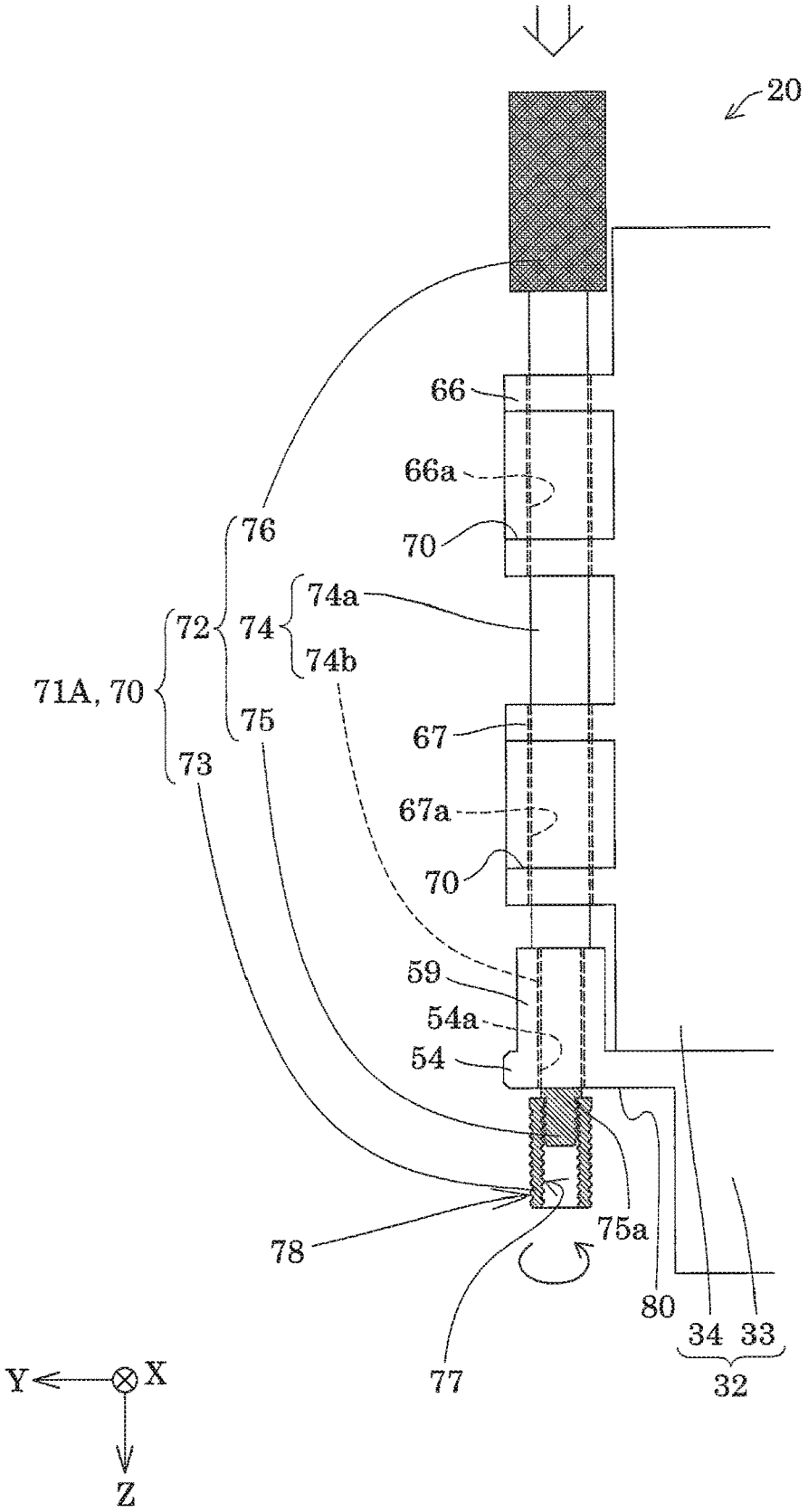
FIG. 13 is a side view of a principal portion of the recording head according to Embodiment 1, illustrating the method for producing a recording head.

The following describes a method for producing the recording head 20 in the present embodiment with reference to FIGS. 12 and 13. Each of FIGS. 12 and 13 is a side view of a principal portion of an ink jet recording head, illustrating a method for producing an ink jet recording head that is an example of the liquid ejecting head according to the present embodiment.

Referring to FIG. 12, the second external threaded section 75 of the shaft main body 72 of the first shaft portion 71A is inserted from the −Z side so as to pass through the screw insertion holes 66*a*, 67*a*, and 54*a*.

Consequently, the second external threaded section 75 passes through the screw insertion hole 54*a* and is located on the +Z side relative to the screw insertion hole 54*a* as illustrated in FIG. 13. The first internal threaded section 77 of the cylindrical member 73 then fits onto the second external threaded section 75.

In this way, the recording head 20 including the first shaft portion 71A is set up as illustrated in FIGS. 8 and 9. The recording head 20 set up as above offers the following advantages. The cylindrical member 73 comes into contact with the first flange portion 54, and the movement of the first shaft portion 71A toward the −Z side relative to the head case 32 is restricted accordingly. Pinching the knob section 76 of the first shaft portion 71A is all that is required of the user to carry the recording head 20. Furthermore, the knob section 76 of the first shaft portion 71A comes into contact with the first protrusion 66, and the movement of the first shaft portion 71A toward the +Z side relative to the head case 32 is restricted accordingly. This minimizes the possibility of accidental withdrawal of the first shaft portion 71A from the head case 32. The second shaft portion 71B may be attached to the head case 32 in like manner with the first shaft portion 71A.

The following describes the way the recording head 20 is fixed to the first holding member 13A. FIG. 14 is an enlarged sectional view of Region XIV in FIG. 9. With the recording head 20 being fixed to the first holding member 13A, the first flange portion 54 fitted with the structuring elements adjacent thereto is as illustrated in FIG. 14. The first flange portion 54 fitted with the structuring elements adjacent thereto and the second flange portion 55 fitted with the structuring elements adjacent thereto have left-right symmetry and are substantially identical to each other.

Referring to FIG. 14, the first flange portion 54 has, on the +Z side, a contact face 80, which comes into contact with the first holding member 13A.

The recording head 20 is fixed to the first holding member 13A in the following manner. The knob section 76 of the first shaft portion 71A viewed in plan in the direction from the −Z side to the +Z side is turned clockwise. Consequently, the cylindrical member 73 is rotated in conjunction with the shaft main body 72, and the first external threaded section 78 of the cylindrical member 73 fits into the fastening screw hole 62 of the first holding member 13A. With additional screwing of the first shaft portion 71A, the first flange portion 54 is fitted between the first face 74*c* and the holding face 79, and the contact face 80 of the first flange portion 54 comes into contact with the holding face 79 of the first holding member 13A accordingly. The second shaft portion 71B on the −Y side is screwed in like manner, and the second flange portion 55 is fitted between the first face 74*c* and the holding face 79. The recording head 20 is fixed to the first holding member 13A accordingly. Specifically, the recording head 20 in the present embodiment is fixed to the holding member 13 with two shaft portions 71 (i.e., the first shaft portion 71A and the second shaft portion 71B) on the opposite sides in the ±Y directions. In this state, the recording head 20, or more specifically, each of the first flange portion 54 and the second flange portion 55 is sandwiched between the first holding member 13A and the first face 74*c* of the corresponding one of the first shaft portion 71A and the second shaft portion 71B. In the present embodiment, the first shaft portion 71A is disposed on the +Y side in the ±Y directions, (i.e., the longitudinal direction of the nozzle surface of the recording head 20), and the second shaft portion 71B is disposed on the −Y side. More specifically, the first shaft portion 71A in the present embodiment is provided to the end of the second portion P2 on the +Y side, and the second shaft portion 71B in the present embodiment is provided to the end of the third portion P3 on the −Y side.

This layout allows maximization of the distance between the first shaft portion 71A and the second shaft portion 71B. The recording head 20 may be securely fixed to the first holding member 13A accordingly.

Figure 15:
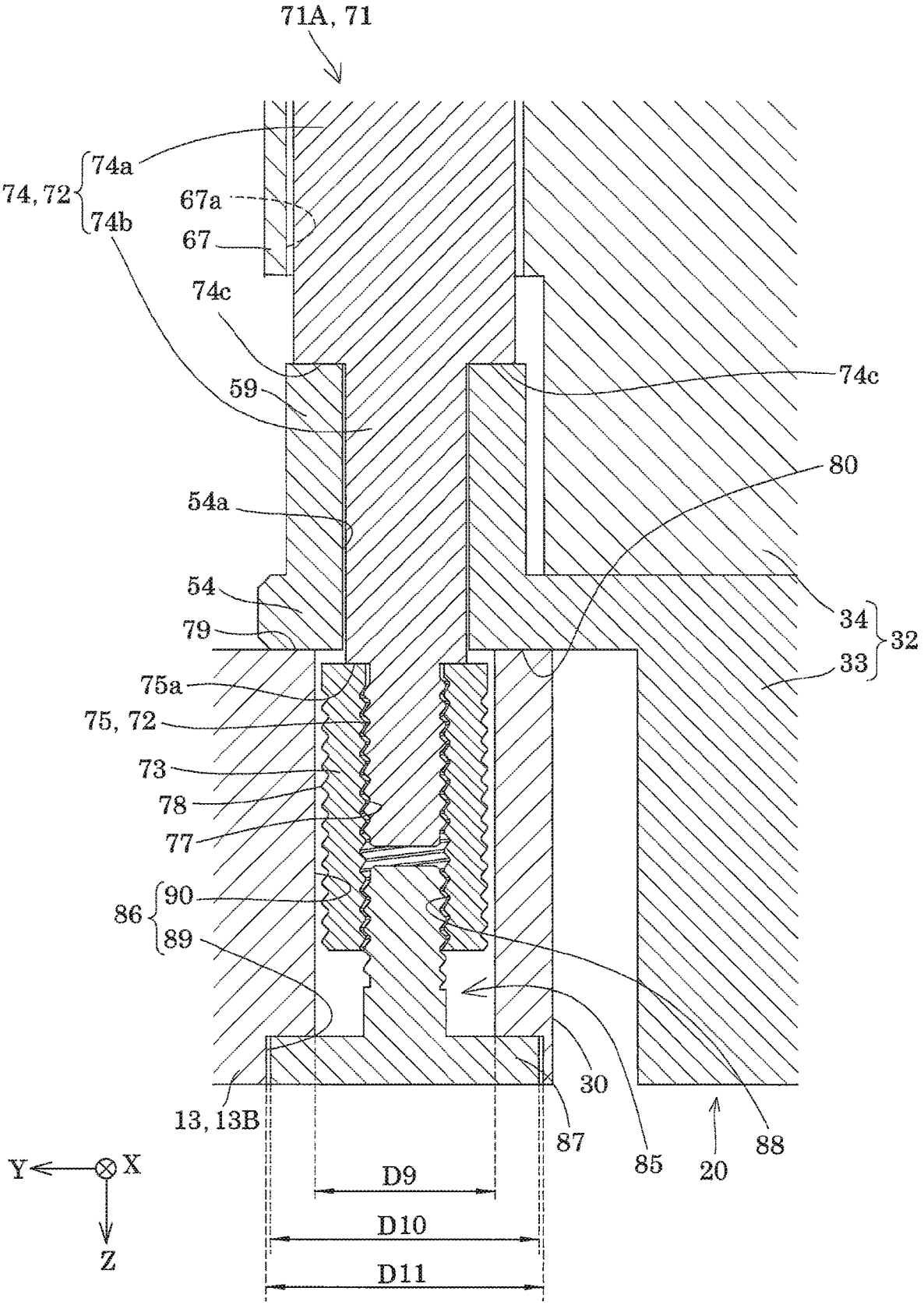
FIG. 15 is a sectional view of the first flange portion fitted with the structuring elements adjacent thereto, illustrating a state in which the recording head according to Embodiment 1 is fixed to a second holding member.

The following describes the way the recording head 20 is fixed to the second holding member 13B. FIG. 15 is a sectional view of the first flange portion 54 fitted with the elements adjacent thereto, illustrating a state in which the recording head 20 is fixed to the second holding member 13B. Each structuring element in FIG. 14 and the corresponding structuring element in FIG. 15 are denoted by the same reference sign, and redundant description thereof will be omitted where appropriate. As with FIG. 14, FIG. 15 illustrates the first flange portion 54 fitted with the structuring elements adjacent thereto. The first flange portion 54 fitted with the structuring elements adjacent thereto and the second flange portion 55 fitted with the structuring elements adjacent thereto have left-right symmetry and are substantially identical to each other.

The second holding member 13B has the second through-hole 86, which is provided in the position corresponding to the position of the fastening screw hole 62 of the first holding member 13A. The second through-hole 86 extends through the second holding member 13B in its thickness direction, that is, in the +Z direction. When the second through-hole 86 is viewed in plan in the direction from the −Z side to the +Z side, the position of the second through-hole 86 and the position of the screw insertion hole 54*a* coincide with each other.

The second through-hole 86 includes an insertion section 90 and a recess 89. D9 denotes the inside diameter of the insertion section 90 and is greater than the outside diameter D7 (i.e., the major diameter of the first external threaded section 78) of the cylindrical member 73 (see FIG. 14). D11 denotes the inside diameter of the recess 89 and is greater than the inside diameter D9 of the insertion section 90. The inside diameter D11 is also greater than D10, which denotes the outside diameter of a head portion 87 of the fastening screw 85.

The recess 89 is provided in a surface of the second holding member 13B on the +Z side opposite to the holding face 79 on which the recording head 20 is held. The head portion 87 of the fastening screw 85 inserted into the second through-hole 86 in the direction from the +Z side to the −Z side is received in the recess 89. The recess 89 is a dent that may be circular when viewed in plan in the direction from the +Z side to the −Z side. It is not required that the recess 89 viewed in plan be circular. The recess 89 is shaped in such a manner that the head portion 87 in the recess 89 can rotate about the axis of an external threaded section 88 of the fastening screw 85 when the external threaded section 88 in the second through-hole 86 fits into the first internal threaded section 77 of the first shaft portion 71A or when the external threaded section 88 is removed from the first internal threaded section 77. The depth of the recess 89 in the Z direction is substantially equal to or greater than the thickness of the head portion 87 in the Z direction.

The insertion section 90 is a through-hole extending in the +Z direction from a surface of the recess 89 on the −Z side to the holding face 79. D9 denotes the inside diameter of the insertion section 90 and is constant throughout the insertion section 90. The insertion section 90 and the recess 89 have a common axis. The head portion 87 may be, for example, circular or hexagonal when viewed in plan. The second holding member 13B is otherwise structurally identical to the first holding member 13A.

The fastening screw 85 is designed to fit in the first internal threaded section 77 of the first shaft portion 71A. The fastening screw 85 has the external threaded section 88 and the head portion 87. The size and the pitch of the external threaded section 88 of the fastening screw 85 are set such that the external threaded section 88 can fit in the first internal threaded section 77 of the cylindrical member 73. The head portion 87 of the fastening screw 85 has a cross recess, a slot, a hexagon socket, or a square socket, into which a tool such as a screwdriver can fit. When being screwed with the tool, the fastening screw 85 turns about the axis of the external threaded section 88.

The length of the external threaded section 88 of the fastening screw 85 in the ±Z directions is set such that the external threaded section 88 does not come into contact with a tip face of the second external threaded section 75 when the external threaded section 88 in the second through-hole 86 fits into the first internal threaded section 77 of the cylindrical member 73. The fastening screw 85 is thus kept from coming into contact with the second external threaded section 75 in the first internal threaded section 77 of the cylindrical member 73 before the head portion 87 of the fastening screw 85 comes into contact with the second holding member 13B. This minimizes the possibility that the recording head 20 will not be securely fixed to the second holding member 13B with the fastening screw 85.

The recording head 20 is fixed to the second holding member 13B in the following manner. With the recording head 20 being positioned on the second holding member 13B in advance, the cylindrical member 73 of the first shaft portion 71A is inserted into the second through-hole 86. Subsequently, the external threaded section 88 of the fastening screw 85 is inserted into the second through-hole 86 from the +Z side of the second holding member 13B, and the fastening screw 85 viewed in plan in the direction from the +Z side to the −Z side is turned clockwise. The fastening screw 85 is turned in the second through-hole 86, and the external threaded section 88 of the fastening screw 85 fits into the first internal threaded section 77 of the cylindrical member 73 in the second through-hole 86 accordingly. With additional screwing of the fastening screw 85, the first flange portion 54 is disposed between the first face 74*c* and the head portion 87 of the fastening screw 85, and the contact face 80 of the first flange portion 54 comes into contact with the holding face 79 of the second holding member 13B. The recording head 20 is fixed to the second holding member 13B accordingly. The same holds true for fixing on the second flange portion 55 side. The fastening screw 85 is inserted into the second through-hole 86 from the +Z side, and the external threaded section 88 fits into the first internal threaded section 77 of the cylindrical member 73 of the second shaft portion 71B in the second through-hole 86. Consequently, the second flange portion 55 is disposed between the first face 74*c* and the head portion 87 of the fastening screw 85. The contact face 80 of the second flange portion 55 comes into contact with the holding face 79 of the second holding member 13B accordingly. That is, the recording head is fixed to the second holding member 13B. Specifically, each recording head 20 in the present embodiment is fixed to the second holding member 13B with two fastening screws 85 on the opposite sides in the ±Y directions and with two respective shaft portions 71 (i.e., the first shaft portion 71A and the second shaft portion 71B).

In this state, the head portion 87 of the fastening screw 85 is entirely received in the recess 89 and does not jut above the surface of the second holding member 13B on the +Z side. This offers an advantage in that the nozzle surface may be smoothly wiped with the wipe member (e.g., the wiper 10) of the ink jet recording apparatus 1. If the head portion 87 of the fastening screw 85 juts above the nozzle surface toward the +Z side, that is, if the head portion 87 juts toward the medium S (i.e., above the surface that faces the medium S while printing is in progress), the wipe member (e.g., the wiper 10) can come into contact with the head portion 87 standing in the way of smooth wiping, and in some instances, the wipe member can become damaged. The head portion 87 of the fastening screw 85 in the present embodiment does not jut above the nozzle surface toward the +Z side. This enables smooth wiping over the nozzle surface and minimizes the possibility that the wipe member will become damaged. Another advantage is a decrease in defective conditions arising from ink on the nozzle surface (e.g., ink that is atomized while being ejected from the nozzle 35) flowing to the head portion 87 and dripping from the head portion 87 onto, for example, the medium S. Still another advantage is that the possibility of jams is reduced; that is, the medium S is less prone to come into contact with the head portion 87 of the fastening screw 85 and is thus kept from getting stuck in the ink jet recording apparatus 1. In the present embodiment, the first shaft portion 71A is disposed on the +Y side in the ±Y directions (i.e., the longitudinal direction of the nozzle surface of the recording head 20), and the second shaft portion 71B is disposed on the −Y side. More specifically, the first shaft portion 71A in the present embodiment is provided to the end of the second portion P2 on the +Y side, and the second shaft portion 71B in the present embodiment is provided to the end of the third portion P3 on the −Y side. This layout allows maximization of the distance between the first shaft portion 71A and the second shaft portion 71B. The recording head 20 may be securely fixed to the second holding member 13B accordingly.

The first external threaded section 78 and the first internal threaded section 77 of the first shaft portion 71A of the recording head 20 according to the present disclosure are both located on the +Z side. This enables screwing from both the +Z side and the −Z side such that the recording head 20 is fixed to the holding member 13. The recording head 20 may be fixed to the first holding member 13A having the fastening screw hole 62, which encloses the first shaft portion 71A when viewed in plan in the direction from the −Z side to the +Z side. In other words, the recording head 20 is fixed to the first holding member 13A with the first shaft portion 71A that is manipulated from the −Z side. The recording head 20 may be fixed to the second holding member 13B having the second through-hole 86, which encloses the first shaft portion 71A when viewed in plan in the direction from the −Z side to the +Z side. In other words, the recording head 20 is fixed to the second holding member 13B with the fastening screw 85 that is inserted into the second through-hole 86 from the +Z side and manipulated from the +Z side. That is, the recording head 20 may be fixed to the first holding member 13A or the second holding member 13B, and the first shaft portion 71A may be used whichever case it may be. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for screw fitting irrespective of the fixation target to which the recording head 20 is to be fixed. This eliminates the inconvenience of disposing of unneeded components.

As described above, the ink jet recording head 20 (i.e., the liquid ejecting head in the present embodiment) includes the nozzle surface, the first shaft portion 71A, and the head case 32 (i.e., the housing portion). The nozzle surface has nozzles from which ink (i.e., liquid) is ejected in the +Z direction (i.e., the first direction). The first shaft portion 71A includes the shaft main body 72 extending in the +Z direction. The head case 32 has the screw insertion holes 66*a*, 67*a*, and 54*a* (i.e., the first through-holes) in which the first shaft portion 71A is inserted. The first shaft portion 71A has the first external threaded section 78 (i.e., the first external thread) and the first internal threaded section 77 (i.e., the first internal thread) on the +Z side.

The first external threaded section 78 and the first internal threaded section 77 of the first shaft portion 71A of the recording head 20 are both located on the +Z side. This enables screwing from both the +Z side and the −Z side such that the recording head 20 is fixed to the holding member 13 (i.e., the fixation target). The use of the recording head 20 does away with the need to produce structurally different recording heads for different fixation targets. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for the screwing process irrespective of the fixation target to which the recording head 20 is to be fixed. This eliminates the inconvenience of disposing of unneeded components.

The ink jet recording head 20 in the present embodiment is preferably structured as follows. The first shaft portion 71A includes the cylindrical member 73. The cylindrical member 73 is hollow and has an inner circumferential surface. The first internal threaded section 77 (i.e., the first internal thread) is provided on the inner circumferential surface of the cylindrical member 73. The shaft main body 72 includes the second external threaded section 75 (i.e., the second external thread) on the +Z side (i.e., the first side to which the first direction leads). The shaft main body 72 and the cylindrical member 73 are fastened to each other with the second external threaded section 75 fitting in the first internal threaded section 77. The first external threaded section 78 is provided on the outer circumferential surface of the cylindrical member 73.

The first shaft portion 71A including the shaft main body 72 and the cylindrical member 73 eliminates the need for the first internal threaded section on the shaft main body 72; that is, the added advantage of the first shaft portion 71A is ease of producibility.

The ink jet recording head 20 in the present embodiment is preferably structured as follows. The cylindrical member 73 is disposed on the +Z (i.e., the first side to which the first direction leads) relative to the screw insertion holes 66*a*, 67*a*, and 54*a* (i.e., the first through-holes). The outside diameter D7 of the cylindrical member 73 is greater than the inside diameter of at least one of the screw insertion holes 66*a*, 67*a*, and 54*a*. For example, the outside diameter D7 is greater than the inside diameter D3 of the screw insertion hole 54*a*. When the first shaft portion 71A is pinched and lifted in the −Z direction, the cylindrical member 73 comes into contact with the opening face in which the opening on the +Z side is defined by the screw insertion hole 54*a*, and the movement of the first shaft portion 71A in the −Z direction is restricted accordingly. Pinching the first shaft portion 71A is all that is required of the user to lift the recording head 20. This provides ease of positioning of the recording head 20 in a relatively small space, in particular a space in which multiple recording heads 20 are tightly packed. Furthermore, the possibility of accidental withdrawal of the first shaft portion 71A from the screw insertion hole 54*a* is minimized. The recording head 20 may be fixed to the holding member 13 through screwing performed from the +Z side or the −Z side. In either of these two cases, the first shaft portion 71A on the −Z side may be used to handle the recording head 20 on the −Z side. This enables a highly dense arrangement of the recording heads 20 on the holding member 13 and contributes to improved workability.

The ink jet recording head 20 in the present embodiment is preferably structured as follows. As the second external threaded section 75 (i.e., the second external thread) fits into the first internal threaded section 77 (i.e., the first internal thread), the cylindrical member 73 moves in the −Z direction (i.e., the second direction) opposite to the +Z direction (i.e., the first direction) with respect to the shaft main body 72. The first face 74*c* of the shaft main body 72 and the end face of the cylindrical member 73 constitute a restriction section of the first shaft portion 71A. The restriction section restricts the movement of the cylindrical member 73 in the −Z direction with respect to the shaft main body 72. The restriction section included in the first shaft portion 71A to restrict the movement of the cylindrical member 73 in the −Z direction with respect to the shaft main body 72 helps fasten the cylindrical member 73 and the shaft main body 72 securely to each other. Owing to the restriction section, the cylindrical member 73 is rotated in conjunction with the shaft main body 72, which is in turn kept from turning free, that is, kept from turning independently of the cylindrical member 73. This provides ease of screwing the cylindrical member 73 into the holding member 13 and ease of screwing the fastening screw 85 into the cylindrical member 73.

The ink jet recording head 20 in the present embodiment is preferably structured as follows: the difference between the outside diameter D7 (i.e., the major diameter of the first external threaded section 78, namely, the first external thread) and the major diameter D8 of the first internal threaded section 77, namely, the first internal thread is not less than 1.0 mm. When the difference between the outside diameter D7 (i.e., the major diameter of the first external threaded section 78) and the major diameter D8 of the first internal threaded section 77 is not less than 1.0 mm, the thickness of the cylindrical member 73 between the first external threaded section 78 and the first internal threaded section 77 is not less than 0.5 mm. The cylindrical member 73 may thus have increased rigidity.

The ink jet recording head 20 in the present embodiment is preferably structured as follows. The first external threaded section 78 (i.e., the first external thread) is to be used to fix the ink jet recording head 20 (i.e., the liquid ejecting head) to the first holding member 13A for holding the ink jet recording head 20. The first internal threaded section 77 (i.e., the first internal thread) is to be used to fix the ink jet recording head 20 to the second holding member 13B for holding the ink jet recording head 20.

The first external threaded section 78 and the first internal threaded section 77 of the first shaft portion 71A of the recording head 20 are both located on the +Z side. This enables screwing from both the +Z side and the −Z side such that the recording head 20 is fixed to the holding member 13 (i.e., the fixation target). According to the example above, the recording head 20 may be fixed to the first holding member 13A with the first shaft portion 71A that is manipulated from the −Z side. The recording head 20 may be fixed to the second holding member 13B with the fastening screw 85 that is inserted into the second through-hole 86 from the +Z side and manipulated from the +Z side. The use of the recording head 20 does away with the need to produce structurally different recording heads for different fixation targets. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for the screwing process irrespective of the fixation target to which the recording head 20 is to be fixed. This eliminates the inconvenience of disposing of unneeded components.

The ink jet recording head 20 in the present embodiment is preferably structured as follows. The ink jet recording head 20 includes the second shaft portion 71B. The second shaft portion 71B includes the shaft main body 72 extending in the +Z direction (i.e., the first direction). The head case 32 (i.e., the housing portion) has the screw insertion holes 68*a*, 69*a*, and 55*a* (i.e., the third through-holes) into which the second shaft portion 71B is inserted. The second shaft portion 71B has the third external thread and the second internal thread on the +Z side. The first shaft portion 71A is located on the +Y side (i.e., the third side to which the third direction leads) in the ±Y directions (i.e., the longitudinal direction of the nozzle surface). The second shaft portion 71B is located on the −Y side (i.e., the fourth side to which the fourth direction leads) opposite to the +Y side of the nozzle surface. That is, the first shaft portion 71A is located on the +Y side in the ±Y directions (i.e., the longitudinal direction of the nozzle surface), and the second shaft portion 71B is located on the −Y side. This layout allows maximization of the distance between the first shaft portion 71A and the second shaft portion 71B that are used to fix the recording head 20 to the fixation target through screw fitting. The two shaft portions 71 enable accurate positioning of the recording head 20 on the fixation target. Furthermore, the recording head 20 is securely fixed to the fixation target. The first shaft portion 71A and the second shaft portion 71B may be disposed in a manner so as not to protrude from the recording head 20 in the ±X directions, that is, in the direction of the short sides of the nozzle surface of the recording head 20. The head modules 18 including the recording heads 20 aligned in the ±Y directions, that is, in the directions of long sides of the recording heads may thus be small in size in the ±X directions. The head unit 2 including the head modules 18 may also be small in size in the ±X directions accordingly.

The ink jet recording head 20 is the present embodiment is preferably structured as follows. When viewed in the +Z direction (i.e., the first direction), the head case 32 (i.e., the housing portion) includes the first portion P1, the second portion P2, and the third portion P3. The second portion P2 adjoins the first portion P1 and protrudes in the +Y direction (i.e., the third direction) from the first portion P1. The third portion P3 adjoins the first portion P1 and protrudes in the −Y direction (i.e., the fourth direction) from the first portion P1. The dimension of the second portion P2 and the dimension of the third portion P3 in the −X direction (i.e., the fifth direction) orthogonal to the +Y direction are each not more than half the dimension of the first portion P1 in the −X direction. The second portion P2 is located on the −X side relative to the center Cv of the first portion P1 in the −X direction. The third portion P3 is located on the +X side (i.e., the sixth side to which the sixth direction leads) relative to the center Cv of the first portion P1 in the −X direction, that is, the third portion P3 is located on the side opposite to the −X side. The first shaft portion 71A is provided to the end of the second portion P2 on the +Y side, and the second shaft portion 71B is provided to the end of the third portion P3 on the −Y side. That is, the first shaft portion 71A is provided to the end of the second portion P2 on the +Y side, and the second shaft portion 71B is provided to the end of the third portion P3 on the −Y side. This layout allows maximization of the distance between the first shaft portion 71A and the second shaft portion 71B that are used to fix the recording head 20 to the fixation target through screw fitting. The two shaft portions 71 enable secure fixation of the recording head 20 to the fixation target. The first shaft portion 71A and the second shaft portion 71B may be disposed in a manner so as not to protrude from the recording head 20 in the ±X directions, that is, in the direction of the short sides of the nozzle surface of the recording head 20. The head modules 18 including the recording heads 20 aligned in the ±Y directions, that is, in the directions of long sides of the recording heads may thus be small in size in the ±X directions. The head unit 2 including the head modules 18 may also be small in size in the ±X directions accordingly.

The ink jet recording apparatus 1, which is an example of the liquid ejecting apparatus in the present embodiment, may include the ink jet recording head 20 mentioned above and the first holding member 13A. The first holding member 13A has the fastening screw hole 62 into which the first external threaded section 78 (i.e., the first external thread) fits. The recording head 20 is held on the first holding member 13A. The first shaft portion 71A of the recording head 20 of the ink jet recording apparatus 1 is manipulated from the −Z side in such a manner that the first external threaded section 78 of the first shaft portion 71A fits in the fastening screw hole 62 of the first holding member 13A. The recording head 20 is fixed to the first holding member 13A accordingly.

The ink jet recording apparatus 1, which is an example of the liquid ejecting apparatus in the present embodiment, may include the ink jet recording head 20 mentioned above, the fastening screw 85, and the second holding member 13B. The fastening screw 85 fits into the first internal threaded section 77 (i.e., the first internal thread). The second holding member 13B has the second through-hole 86 into which the fastening screw 85 is inserted. The recording head 20 is held on the second holding member 13B. The fastening screw 85 of the ink jet recording apparatus 1 is manipulated from the +Z side in such a manner that the fastening screw 85 fits into the first internal threaded section 77 of the first shaft portion 71A. The recording head 20 is fixed to the second holding member 13B accordingly. The fastening screw 85 may also be manipulated from the −Z side. In this case as well, the first shaft portion 71A may be used to handle the recording head 20 on the −Z side. This enables a highly dense arrangement of the recording heads 20 on the second holding member 13B and contributes to improved workability.

The method for producing the ink jet recording head 20 (i.e., the liquid ejecting head in the present embodiment) includes fastening the cylindrical member 73 onto the shaft main body 72 inserted in the screw insertion holes 66*a*, 67*a*, and 54*a* (i.e., the first through-holes). That is, the cylindrical member 73 is fastened onto the shaft main body 72 after the cylindrical member 73 is inserted in the screw insertion holes 66*a*, 67*a*, and 54*a*. The outside diameter D7 of the cylindrical member 73 may thus be greater than the inside diameter of at least one of the screw insertion holes 66*a*, 67*a*, and 54*a*. In other words, the cylindrical member 73 whose outside diameter D7 is greater than the inside diameter of at least one of the screw insertion holes 66*a*, 67*a*, and 54*a* does not become a hindrance to inserting the shaft main body 72 into the screw insertion holes 66*a*, 67*a*, and 54*a*.

The method for producing the ink jet recording head 20 (i.e., the liquid ejecting head in the present embodiment) includes fastening the cylindrical member 73 onto the shaft main body 72 inserted in the screw insertion holes 66*a*, 67*a*, and 54*a* (i.e., the first through-holes). This production method offers an advantage in that the outside diameter D7 of the cylindrical member 73 that is fastened onto the shaft main body 72 inserted in the screw insertion holes 66*a*, 67*a*, and 54*a* may be greater than the inside diameter D3 of at least one of the screw insertion holes 66*a*, 67*a*, and 54*a*. For example, the outside diameter D7 may be greater than the inside diameter D3 of the screw insertion hole 54*a*.

Embodiment 1 of the present disclosure has been described so far. The basic configuration described above should not be construed as limiting the present disclosure.

Figure 16:
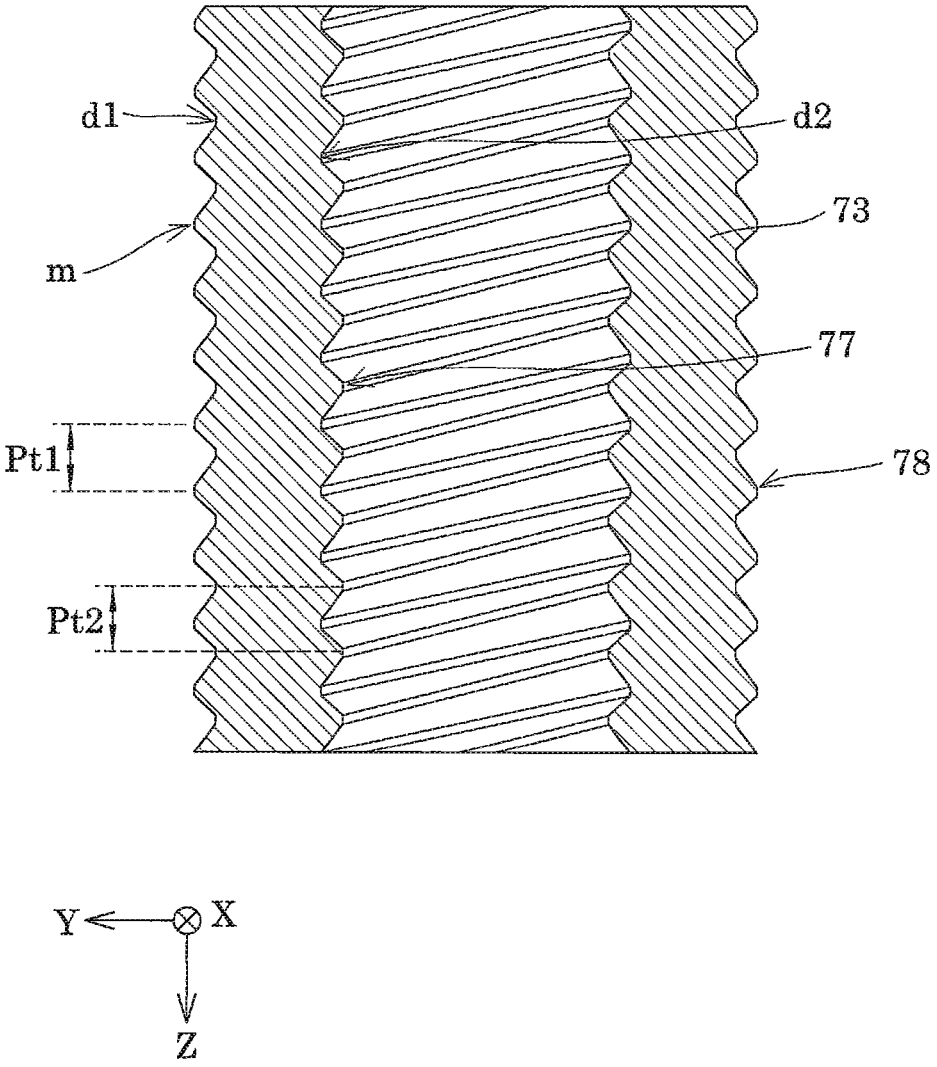
FIG. 16 is a sectional view of a modification of the cylindrical member according to Embodiment 1.
Figure 17:
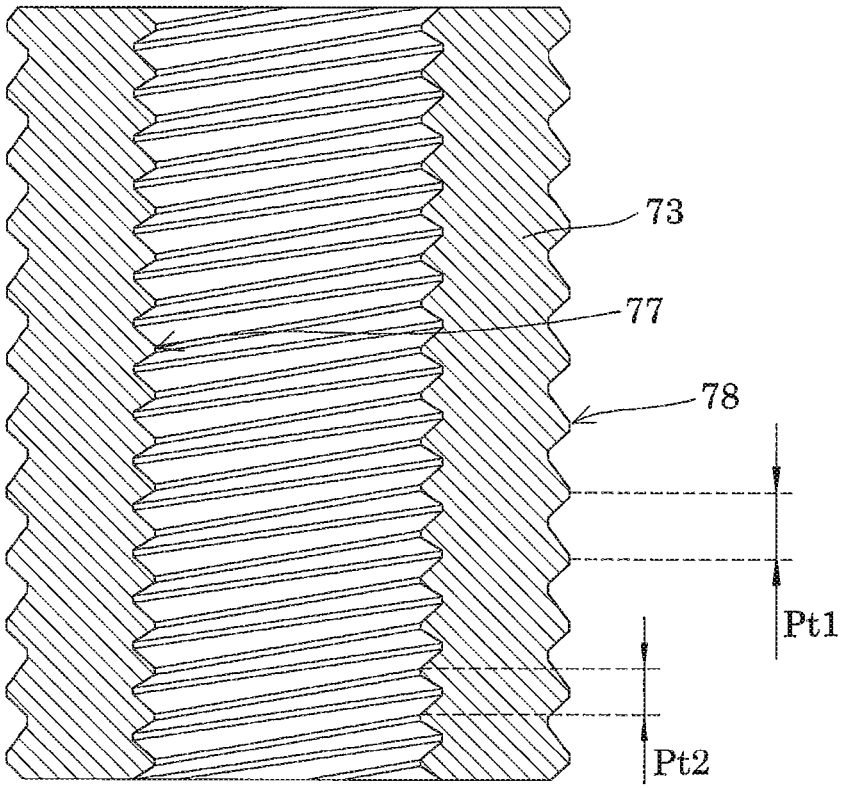
FIG. 17 is a sectional view of another modification of the cylindrical member according to Embodiment 1.
Figure 17:
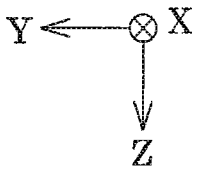

The first external threaded section 78 and the first internal threaded section 77 of the cylindrical member 73 in the present embodiment have the same thread pitch and are provided in the corresponding positions, or more specifically, the position of the root of the first external threaded section 78 and the position of the root of the first internal threaded section 77 coincide with each other in the Z direction. The cylindrical member may be modified as illustrated in FIGS. 16 and 17. FIGS. 16 and 17 are sectional views of modifications of the cylindrical member.

Referring to FIG. 16, $Pt_1$ is equal to $Pt_2$, where $Pt_1$ denotes the pitch of the first external threaded section 78 of the cylindrical member 73 and $Pt_2$ denotes the pitch of the first internal threaded section 77 of the cylindrical member 73. Threads on the cylindrical member 73 are provided in different positions in the ±Z directions; that is, the position of a root d1 of the first external threaded section 78 and the position of the root d2 of the first internal threaded section 77 do not coincide with each other in the +Z direction. In this modification, the position of the crest m of the first external threaded section 78 and the position of the root d2 of the first internal threaded section 77 coincide with each other in the +Z direction. Owing to the resultant decrease in the proportion of thin-walled sections, the cylindrical member 73 increases in strength. When the position of the root d1 of the first external threaded section 78 and the position of the root d2 of the first internal threaded section 77 coincide with each other in the +Z direction, the section between the roots d1 and d2 is thinner than any other section of the cylindrical member 73, and stress can concentrate on the section between the roots d1 and d2, making the cylindrical member 73 prone to deformation and breakage. When the position of the root d1 of the first external threaded section 78 and the position of the root d2 of the first internal threaded section 77 do not coincide with each other in the +Z direction, the resultant increase in thickness makes the cylindrical member 73 less prone to deformation and breakage that can be cause by the concentration of stress. The cylindrical member 73 having high strength may be fastened to the shaft main body 72 or the holding member 13 in a manner so as to eliminate or reduce misalignment that can be produced between the recording head 20 and the holding member 13 due to deformation of the cylindrical member 73 or insufficient tightening torque. Although it is required that the position of the root d1 of the first external threaded section 78 and the position of the root d2 of the first internal threaded section 77 do not coincide with each other in the +Z direction, the position of the crest m of the first external threaded section 78 and the position of the root d2 of the first internal threaded section 77 may or may not coincide with each other in the +Z direction.

That is, the recording head 20 in the present embodiment is preferably structured as follows: the position of the root d1 of the first external threaded section 78 (i.e., the first external thread) and the position of the root d2 of the first internal threaded section 77 (i.e., the first internal thread) do not coincide with each other in directions orthogonal to the +Z direction (i.e., the first direction). Owing to the resultant decrease in the proportion of thin-walled sections, the cylindrical member 73 increases in strength and is less prone to deformation and breakage.

It is not required that the pitch of the first external threaded section 78 of the cylindrical member 73 be equal to the pitch of the first internal threaded section 77 of the cylindrical member 73. This is specifically illustrated in FIG. 17. The cylindrical member 73 includes the first external threaded section 78 and the first internal threaded section 77. The pitch $Pt_2$ of the first internal threaded section 77 is smaller than the pitch $Pt_1$ of the first external threaded section 78 ($Pt_1>Pt_2$). The pitch $Pt_1$ of the first external threaded section 78 and the pitch $Pt_2$ of the first internal threaded section 77 preferably take on values such that $Pt_1/Pt_2$ is not an integer. When $Pt_1/Pt_2$ is not an integer, the position of the root d1 of the first external threaded section 78 and the position of the root d2 of the first internal threaded section 77 are less likely to coincide with each other in the +Z direction; that is, the position of the root d1 and the position of the root d2 are less likely to coincide with each other in directions orthogonal to the +Z direction (i.e., directions in the X-Y plane). The cylindrical member 73 increases in strength accordingly. When the pitch $Pt_1$ of the first external threaded section 78 is an integer multiple of the pitch $Pt_2$ of the first internal threaded section 77, the coincidence of the position of the root d2 of the first internal threaded section 77 with the position of the root d1 of the first external threaded section 78 in directions orthogonal to the +Z direction occurs at intervals of several recesses. Adjusting the pitches such that $Pt_1/Pt_2$ is not an integer enables a reduction in the number of sites in which the position of the root d1 of the first external threaded section 78 and the position of the root d2 of the first internal threaded section 77 coincide with each other in directions orthogonal to the +Z direction. Consequently, the proportion of weak sections in the cylindrical member 73 is reduced, and the cylindrical member 73 is less prone to deformation and breakage that can be caused by the concentration of stress.

The pitch $Pt_2$ of the first internal threaded section 77 is preferably greater than half the pitch $Pt_1$ of the first external threaded section 78 and smaller than the pitch $Pt_1$ ($Pt_1/2<Pt_2<Pt_1$). When the pitch $Pt_2$ of the first internal threaded section 77 is greater than half the pitch $Pt_1$ of the first external threaded section 78 and smaller than the pitch $Pt_1$, $Pt_1/Pt_2$ is not an integer. It is not required that the pitch $Pt_1$ of the first external threaded section 78 be, as in the example above, greater than the pitch $Pt_2$ of the first internal threaded section 77. The pitch $Pt_1$ of the first external threaded section 78 may be smaller than the pitch $Pt_2$ of the first internal threaded section 77. In this case, $Pt_2/Pt_1$ is preferably not an integer, and the pitch $Pt_1$ of the first external threaded section 78 is preferably greater than half the pitch $Pt_2$ of the first internal threaded section 77 and smaller than the pitch $Pt_2$ ($Pt_2/2<Pt_1<Pt_2$).

That is, the recording head 20 in the present embodiment is preferably structured as follows: the pitch $Pt_1$ of the first external threaded section 78 (i.e., the first external thread) is not equal to the pitch $Pt_2$ of the first internal threaded section 77 (i.e., the first internal thread). The position of the root d1 of the first external threaded section 78 and the position of the root d2 of the first internal threaded section 77 are thus less likely to coincide with each other in the +Z direction. Owing to the resultant decrease in the proportion of sections of the cylindrical member 73 that are thin in directions orthogonal to the +Z direction, the cylindrical member 73 increases in strength. The cylindrical member 73 having high strength may be fastened to the shaft main body 72 or the holding member 13 in a manner so as to eliminate or reduce misalignment that can be produced between the recording head 20 and the holding member 13 due to deformation of the cylindrical member 73 or insufficient tightening torque.

Figure 18:
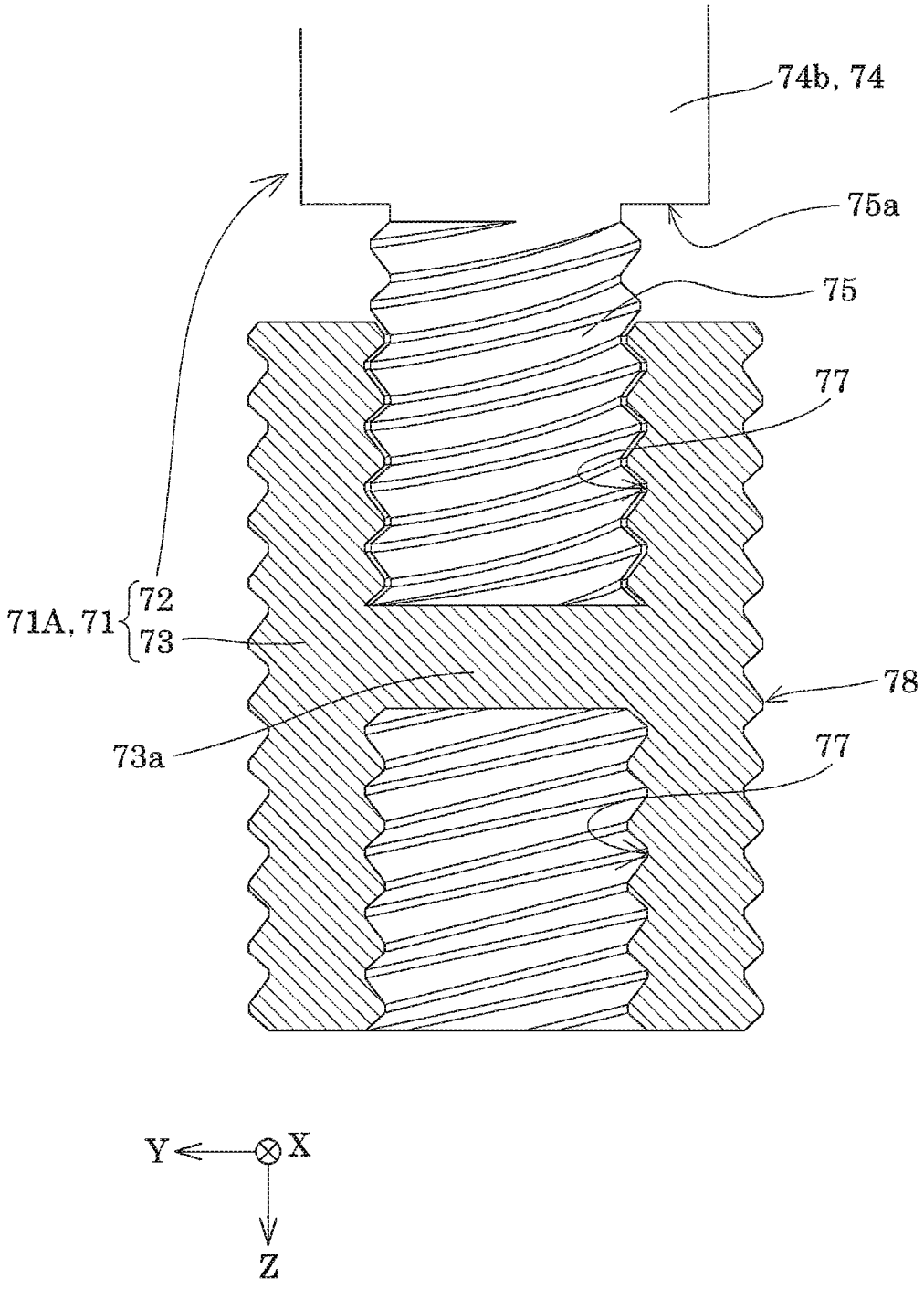
FIG. 18 is a sectional view of a principal portion of a modification of a first shaft portion according to Embodiment 1.
Figure 19:
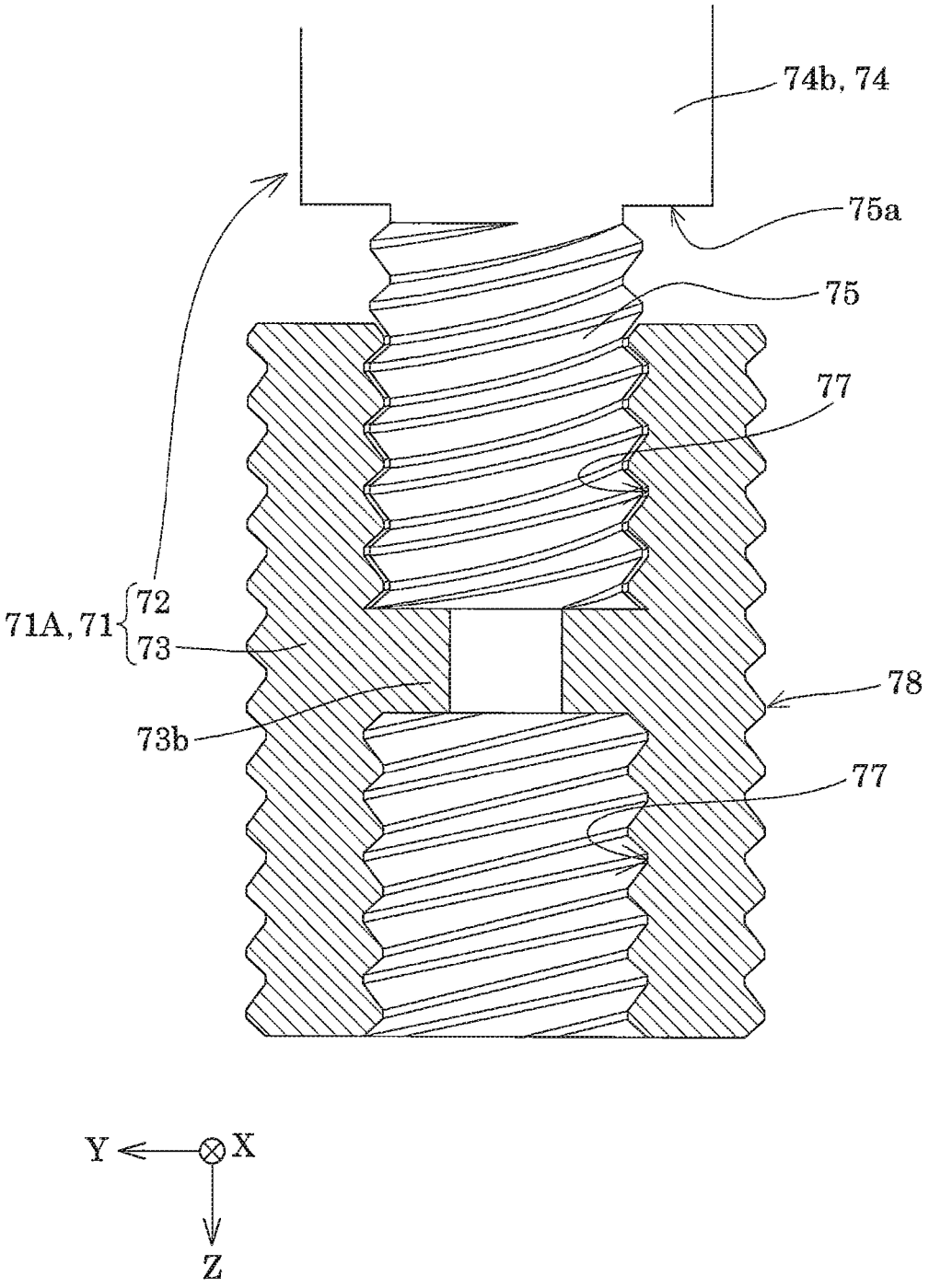
FIG. 19 is a sectional view of a principal portion of another modification of the first shaft portion according to Embodiment 1.
Figure 20:
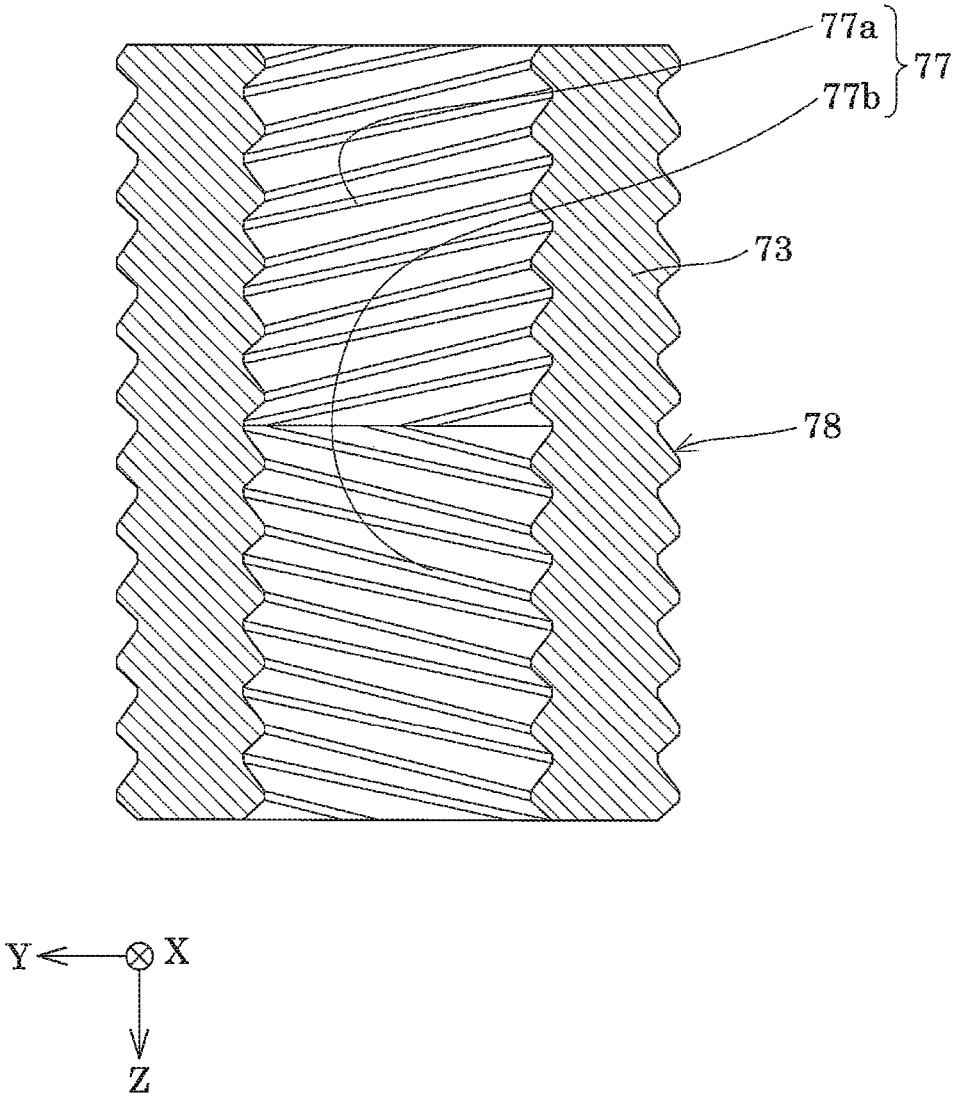
FIG. 20 is a sectional view of a cylindrical member, illustrating still another modification of the first shaft portion according to Embodiment 1.

The cylindrical member 73 in the present embodiment fits onto the second external threaded section 75 and moves in the −Z direction accordingly. Consequently, the end face of the cylindrical member 73 comes into contact with the second face 75*a* of the shaft main body 72, and the movement of the cylindrical member 73 in the −Z direction is restricted. The restriction section that restricts the movement of the cylindrical member 73 in the −Z direction with respect to the shaft main body 72 is not limited to the restriction section mentioned above. The first shaft portion 71A may be modified as illustrated in FIGS. 18 to 20. FIGS. 18 and 19 are sectional views of principal portions of modifications of the first shaft portion. FIG. 20 is a sectional view of a cylindrical member, illustrating still another modification of the first shaft portion.

Referring to FIG. 18, the cylindrical member 73 includes a wall 73*a*, which is a partition between two spaces within the cylindrical member 73. The cylindrical member 73 fits onto the second external threaded section 75 and moves in the −Z direction accordingly. Consequently, the wall 73*a* of the cylindrical member 73 comes into contact with the tip of the second external threaded section 75, and the movement of the cylindrical member 73 in the −Z direction with respect to the shaft main body 72 is restricted. The wall 73*a* of the cylindrical member 73 and the tip face of the second external threaded section 75 on the +Z side constitute a restriction section of the first shaft portion 71A illustrated in FIG. 18. The restriction section restricts the movement of the cylindrical member 73 in the −Z direction with respect to the shaft main body 72.

Referring to FIG. 19, the cylindrical member 73 includes a wall having an opening. That is, the cylindrical member 73 includes a projection 73*b*, which is provided on the inner side of the cylindrical member 73 in a manner so as to project toward the center and to extend continuously in the circumferential direction. It is not required that the projection 73*b* provided on the inner side of the cylindrical member 73 extend continuously in the circumferential direction. The cylindrical member 73 may include discrete projections. The cylindrical member 73 fits onto the second external threaded section 75 and moves in the −Z direction accordingly. Consequently, the projection 73*b* of the cylindrical member 73 comes into contact with the tip of the second external threaded section 75, and the movement of the cylindrical member 73 in the −Z direction with respect to the shaft main body 72 is restricted. The projection 73*b* of the cylindrical member 73 and the tip face of the second external threaded section 75 on the +Z side constitute a restriction section of the first shaft portion 71A. The restriction section restricts the movement of the cylindrical member in the −Z direction with respect to the shaft main body 72.

Referring to FIG. 20, the first internal threaded section 77 on the inner circumferential surface of the cylindrical member 73 may have a thread on the −Z side and a thread on the +Z side. The threads are oriented in opposite directions. Specifically, the first internal threaded section 77 includes a positive threaded section 77*a* (i.e., a positive thread also known as a right-handed thread) on the −Z side and a reverse threaded section 77*b* (i.e., a reverse thread also known as a left-handed thread) on the +Z side. As the positive threaded section 77*a* of the cylindrical member 73 fits onto the second external threaded section 75 (see FIG. 14) of the shaft main body 72, the cylindrical member 73 moves in the −Z direction with respect to the shaft main body 72. The second external threaded section 75 is unable to fit into the reverse threaded section 77*b*. The movement of the cylindrical member 73 in the −Z direction with respect to the shaft main body 72 is restricted at the boundary between the positive threaded section 77*a* and the reverse threaded section 77*b*. That is, the reverse threaded section 77*b* of the first internal threaded section 77 of the cylindrical member 73 and the second external threaded section 75 (see FIG. 14) of the shaft main body 72 constitute a restriction section of the first shaft portion 71A. The restriction section restricts the movement of the cylindrical member 73 in the −Z direction with respect to the shaft main body 72.

Any of the aforementioned restriction sections that may be included in the first shaft portion 71A helps fasten the shaft main body 72 and the cylindrical member 73 securely to each other and enables the cylindrical member 73 to rotate autonomously in conjunction with the shaft main body 72 turned about its axis. The shaft main body 72 of the first shaft portion 71A may thus be manipulated to fasten the cylindrical member 73 to the holding member 13.

Figure 21:
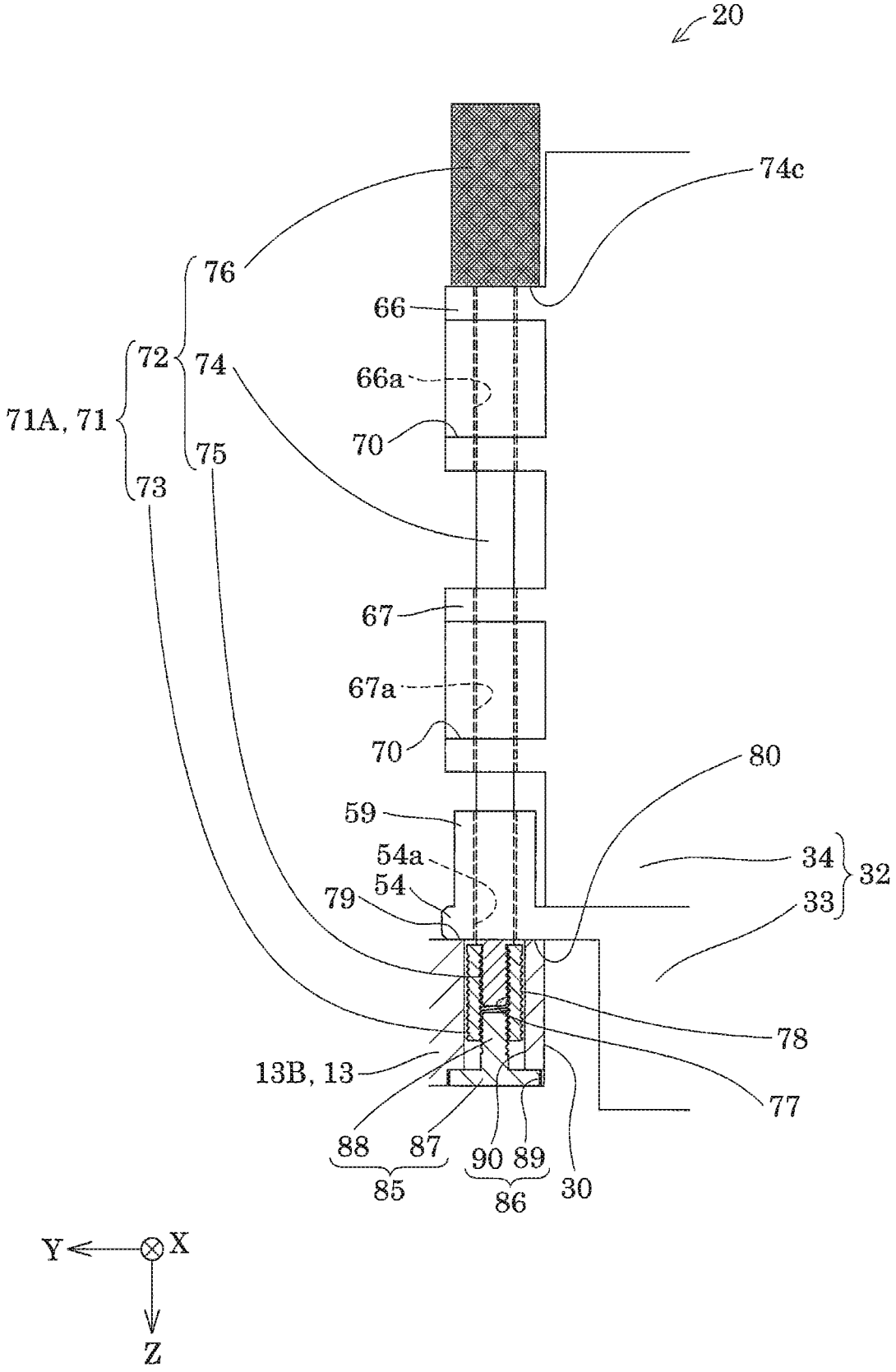
FIG. 21 is a sectional view of a principal portion of a modification of the recording head according to Embodiment 1.
Figure 22:
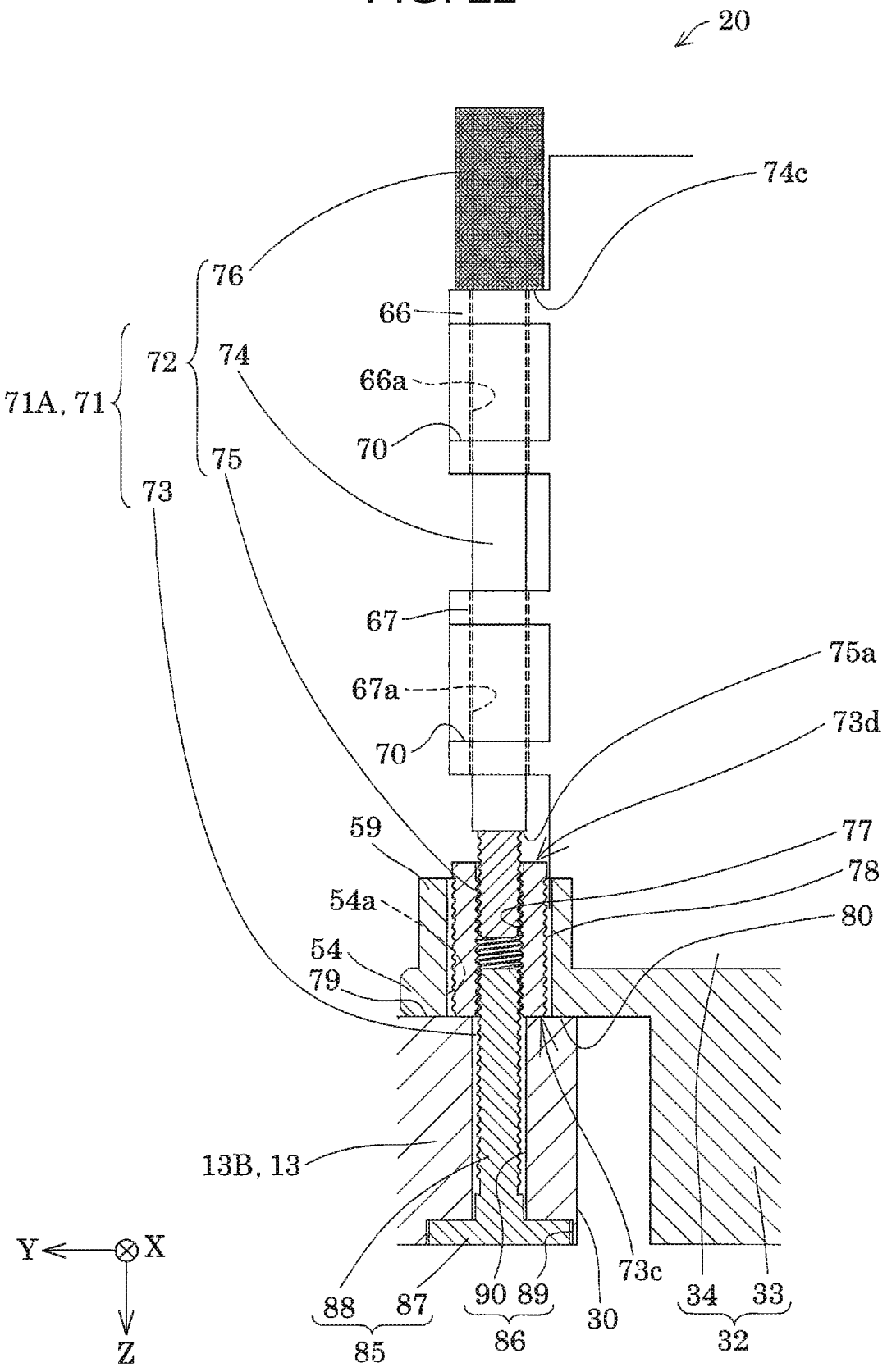
FIG. 22 is a sectional view of a principal portion of another modification of the recording head according to Embodiment 1.

The main body section 74 of the shaft main body 72 of the first shaft portion 71A in the present embodiment has the first face 74*c*. The recording head 20 may be modified as illustrated in FIGS. 21 and 22. FIGS. 21 and 22 are sectional views of principal portions of modifications of the recording head.

Referring to FIG. 21, the first shaft portion 71A includes the shaft main body 72 and the cylindrical member 73. The shaft main body 72 has the main body section 74, the second external threaded section 75, and the knob section 76. The outside diameter of the main body section 74 is constant in the Z direction. The outside diameter of the knob section 76 is greater than the outside diameter of the main body section 74. Owing to the difference in the outside diameter, a step face lies between the knob section 76 and the main body section 74. The outside diameter of the knob section 76 is greater than the inside diameter of the screw insertion hole 66*a*. The step face lying between the knob section 76 and the main body section 74 is thus regarded as the first face 74*c* and comes into contact with the face in which an opening on the −Z side is defined by the screw insertion hole 66*a* of the first protrusion 66. The recording head 20 including the first shaft portion 71A may be fixed to the second holding member 13B in the following manner: the first external threaded section 78 of the first shaft portion 71A is inserted into the second through-hole 86 of the second holding member 13B from the −Z side, and the fastening screw 85 is inserted into second through-hole 86 from the +Z side so as to fit in the first internal threaded section 77. The first protrusion 66 is disposed between the first face 74*c* and the head portion 87 of the fastening screw 85, and the contact face 80 of the first flange portion 54 comes into contact with the holding face 79 of the second holding member 13B accordingly. That is, the recording head 20 is fixed to the second holding member 13B. The recording head 20 may be fixed to the first holding member 13A in like manner with the recording head 20 fixed to the second holding member 13B through screw fitting illustrated in FIG. 21.

Meanwhile, the constituent components of the recording head 20 fixed to the second holding member 13B through the use of the first shaft portion 71A and the fastening screw 85 are less prone to distortion and warpage when the site at which the head portion 87 of the fastening screw 85 comes into contact with the second holding member 13B and the site at which the first face 74*c* comes into contact with the head case 32 are relatively close to each other in the ±Z directions than would be the case if these sites are relatively far from each other. If the site at which the first face 74*c* comes into contact with the head case 32 and the site at which the head portion 87 of the fastening screw 85 comes into contact with the second holding member 13B are relatively far from each other in the +Z direction, the components between these sites would become warped or distorted and would accordingly impose stress on the constituent components, in which consequent faulty connections of channels can develop ink leakage or cause ink discharge in wrong directions. As a workaround to these defective conditions, the first face 74*c* and the head portion 87 of the fastening screw 85 may be provided in such a manner that the first flange portion 54 is fitted therebetween as illustrated in FIG. 15. The head case 32 may thus be securely and accurately held between the first face 74*c* and the fastening screw 85 that are relatively close to each other in the +Z direction. The head case 32 structured as illustrated in FIG. 15 is less prone to deformation accordingly. The stress and the consequent faulty connections of channels are minimized, and resultant ink leakage and resultant ink discharge in wrong directions are eliminated or reduced accordingly.

Referring to FIG. 22, the outside diameter D7 (see FIG. 14) of the cylindrical member 73 of the first shaft portion 71A may be greater than the inside diameter of the second through-hole 86 of the second holding member 13B (i.e., the inside diameter D9 (see FIG. 15) of the insertion section 90 in the present embodiment) such that an end face 73*c* of the cylindrical member 73 on the +Z side comes into contact with the holding face 79 of the second holding member 13B. It is required that an end face 73*d* of the cylindrical member 73 on the −Z side does not come into contact with the second face 75*a* when the end face 73*c* of the cylindrical member 73 on the +Z side comes into contact with the holding face 79 of the second holding member 13B. The first shaft portion 71A is structurally identical to the first shaft portion 71A illustrated in FIG. 21. Specifically, the first shaft portion 71A includes the shaft main body 72 and the cylindrical member 73. The shaft main body 72 has the main body section 74, the second external threaded section 75, and the knob section 76. The outside diameter of the main body section 74 is constant in the Z direction. The outside diameter of the knob section 76 is greater than the outside diameter of the main body section 74. Owing to the difference in the outside diameter, a step face lies between the knob section 76 and the main body section 74. The outside diameter of the knob section 76 is greater than the inside diameter of the screw insertion hole 66*a*. The step face lying between the knob section 76 and the main body section 74 is regarded as the first face 74*c* and comes into contact with the surface in which the opening on the −Z side is defined by the screw insertion hole 66*a* of the first protrusion 66.

The recording head 20 may be fixed to the second holding member 13B in the following manner. The fastening screw 85 is inserted into the second through-hole 86 from the +Z side, and the cylindrical member 73 is accordingly held with the end face 73*c* being in contact with the holding face 79 of the second holding member 13B. The second external threaded section 75 of the shaft main body 72 fits into the cylindrical member 73 that is fastened to the second holding member 13B through screw fitting. Consequently, the head case 32 is held between the holding face 79 of the second holding member 13B and the first face 74*c* of the shaft main body 72, and the contact face 80 of the first flange portion 54 comes into contact with the holding face 79. The recording head 20 is fixed to the second holding member 13B accordingly.

That is, the end face 73*c* of the cylindrical member 73 on the +Z side comes into contact with the holding face 79 of the second holding member 13B. This structure enables a reduction in the distance between the end face 73*c* of the cylindrical member 73 and the head portion 87 of the fastening screw 85 in the ±Z directions. The cylindrical member 73 is securely and accurately fastened to the second holding member 13B accordingly.

The inside diameter of the second through-hole 86 may be relatively small when the aforementioned structure is adopted such that the end face 73*c* of the cylindrical member 73 on the +Z side comes into contact with the holding face 79 of the second holding member 13B. The second through-holes 86 thus take up less space. This eliminates or reduces the possibility that the second through-holes 86 will overlap each other and that the second holding member 13B will have reduced rigidity in regions between the second through-hole 86 and the apertures 30.

That, the ink jet recording apparatus 1, which is an example of the liquid ejecting apparatus in the present embodiment, is preferably structured as follows. The ink jet recording apparatus 1 includes the ink jet recording head 20 mentioned above, the fastening screw 85, and the second holding member 13B. The fastening screw 85 fits into the first internal threaded section 77 (i.e., the first internal thread). The second holding member 13B has the second through-hole 86 into which the fastening screw 85 is inserted. The recording head 20 is held on the second holding member 13B. The outside diameter D7 of the cylindrical member 73 is greater than the inside diameter of the second through-hole 86. When the outside diameter D7 of the cylindrical member 73 is greater than the inside diameter of the second through-hole 86, the cylindrical member 73 may be fastened to the second holding member 13B with the end face 73*c* of the cylindrical member 73 on the +Z side being in contact with the holding face 79 of the second holding member 13B on the −Z side. The distance between the end face 73*c* of the cylindrical member 73 and the head portion 87 of the fastening screw 85 is reduced in the ±Z directions, and stable fixation is achieved accordingly. The area of openings defined by the second through-holes 86 may be relatively small. The second through-holes 86 thus take up less space. This eliminates or reduces the possibility that the second through-holes 86 will overlap each other and that the second holding member 13B will have reduced rigidity in regions between the second through-hole 86 and the apertures 30.

Figure 23:
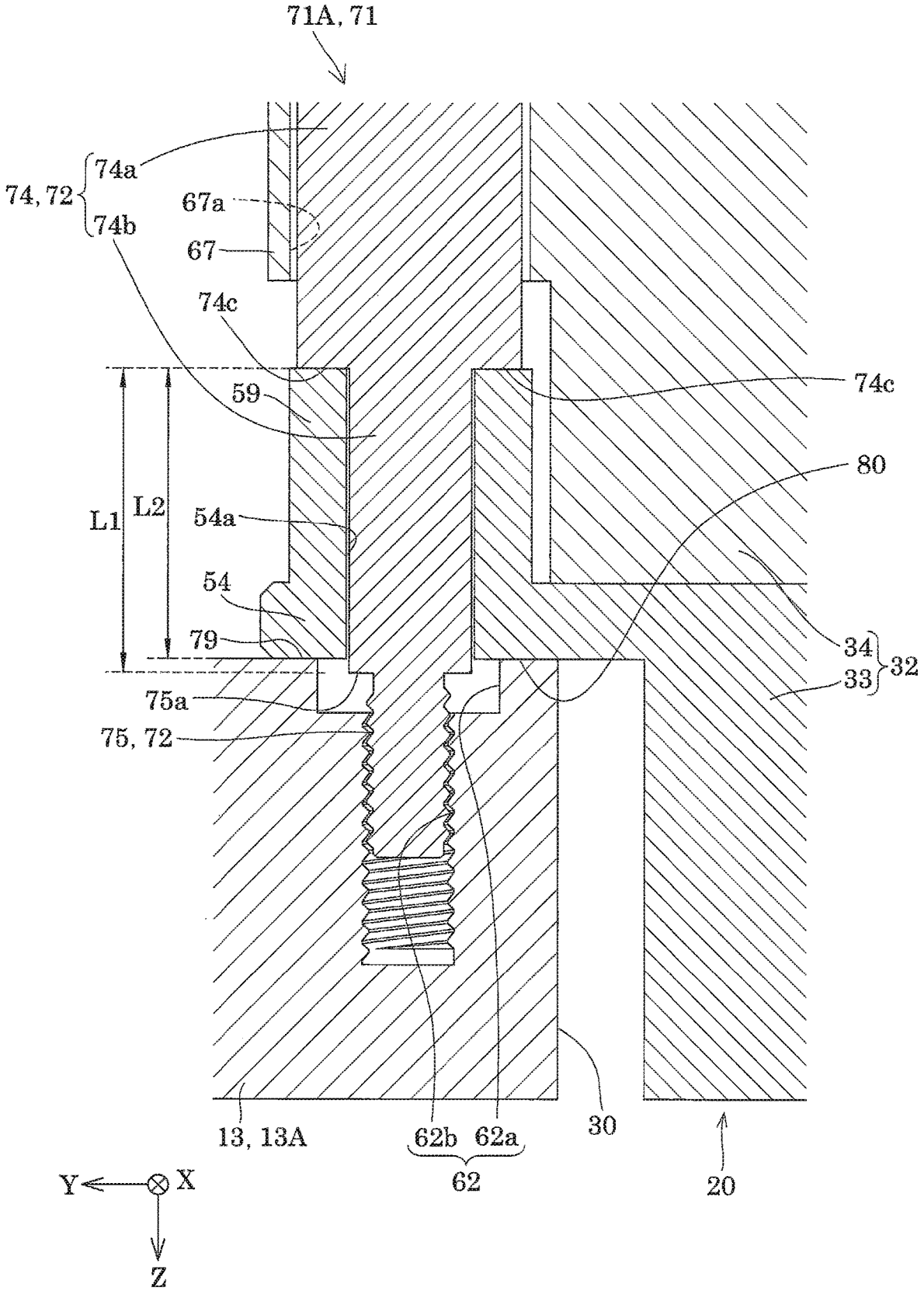
FIG. 23 is a sectional view of a principal portion of still another modification of the recording head according to Embodiment 1.

The recording head 20 in the present embodiment is fixed to the first holding member 13A in such a manner that the first external threaded section 78 of the cylindrical member 73 of the first shaft portion 71A fits into the fastening screw hole 62 of the first holding member 13A. The recording head 20 in the present embodiment may be modified as illustrated in FIG. 23. FIG. 23 is a sectional view of a principal portion of still another modification of the recording head.

Referring to FIG. 23, the recording head 20 is fixed to the first holding member 13A in the following manner: the cylindrical member 73 is removed from the shaft main body 72 of the first shaft portion 71A of the recording head 20, and the second external threaded section of the shaft main body fits into the fastening screw hole 62 of the first holding member 13A. The second external threaded section 75 of the shaft main body 72 in the example illustrated in FIG. 23 corresponds to the first external thread of the first shaft portion 71A.

The fastening screw hole 62 of the first holding member 13A has a recess 62*a* and an internal threaded section 62*b*. The recess 62*a* is provided on the −Z side of the first holding member 13A and has a bottom face in which an opening is defined by the internal threaded section 62*b*.

The inside diameter of the recess 62*a* is greater than the outside diameter of the main body section 74 of the shaft main body 72, or more specifically, is greater than the outside diameter of the small-diameter section 74*b*. The size and the pitch of the internal threaded section 62*b* are set such that the second external threaded section 75 of the shaft main body 72 can fit in the internal threaded section 62*b*. When the inside diameter of the recess 62*a* is greater than the outside diameter of the small-diameter section 74*b*, the second external threaded section 75 can fit into the internal threaded section 62*b* without the second face 75*a* of the shaft main body 72 coming into contact with the holding face 79 of the first holding member 13A. The shaft main body 72 in this modification is structured such that L1 is greater than L2, where L1 denotes the distance between the first face 74*c* and the second face 75*a* in the +Z direction (i.e., the axial direction) and L2 denotes the length of the screw insertion hole 54*a* of the first flange portion 54 in the Z direction. This necessitates the recess 62*a* in the first holding member 13A. When L1 is smaller than L2, the recess 62*a* in the first holding member 13A is not necessary.

The inside diameter of the internal threaded section 62*b* of the fastening screw hole 62 may be smaller than the inside diameter of the fastening screw hole 62 in which the cylindrical member 73 of the first holding member 13A illustrated in FIG. 14 is screwed. The fastening screw holes 62 thus take up less space. This eliminates or reduces the possibility that the fastening screw holes 62 will overlap each other and that the first holding member 13A will have reduced rigidity in regions between the fastening screw holes 62 and the apertures 30.

The recording head 20 is fixed to the second holding member 13B as illustrated in FIG. 15. Specifically, the shaft main body 72 with the cylindrical member 73 fastened thereto (i.e., the first shaft portion 71A) is used such that the fastening screw 85 fits into the first internal threaded section 77 of the cylindrical member 73, and the recording head 20 is fixed to the second holding member 13B accordingly.

As mentioned above, the cylindrical member 73 is removed from the shaft main body 72 when the recording head 20 is fixed to the first holding member 13A. Nevertheless, the recording head 20 including the first shaft portion 71A is target-independent. This eliminates the need to supply different recording heads for different fixation targets and simplifies production, inventory management, and shipment of the recording heads 20.

That is, the ink jet recording head 20 (i.e., the liquid ejecting head) in the modification illustrated in FIG. 23 includes the nozzle surface, the first shaft portion 71A, and the head case 32 (i.e., the housing portion). The nozzle surface has the nozzles 35 from which ink (i.e., liquid) is ejected in the +Z direction (i.e., the first direction). The first shaft portion 71A includes the shaft main body 72 extending in the +Z direction. The head case 32 has the screw insertion holes 66*a*, 67*a*, and 54*a* (i.e., the first through-holes) in which the first shaft portion 71A is inserted. The shaft main body 72 of the first shaft portion 71A has the second external threaded section 75 (i.e., the first external thread) on the +Z side. The second external threaded section 75 can fit in the first internal threaded section 77 (i.e., the first internal thread) for fastening of the shaft main body 72 to the cylindrical member 73 (see FIG. 14) that is hollow and has the inner circumferential surface. The second external threaded section 75 is provided on the inner circumferential surface of the cylindrical member 73. The second external threaded section 75 is to be used to fix the ink jet recording head 20 to the first holding member 13A for holding the ink jet recording head 20 or to fasten the cylindrical member 73 and the shaft main body 72 to each other. The first internal threaded section 77 is to be used to fasten the cylindrical member 73 and the shaft main body 72 to each other and to fix the ink jet recording head 20 to the second holding member 13B for holding the ink jet recording head 20.

The shaft main body 72 of the recording head 20 alone may be fastened to the first holding member 13A from the −Z side. The shaft main body 72 with the cylindrical member 73 fastened thereto (i.e., the first shaft portion 71A) may be fastened to the second holding member 13B from the +Z side. The addition of the cylindrical member 73 allows switchover from screwing in the −Z direction to screwing in the +Z direction; that is, screwing from the −Z side into the first holding member 13A and screwing from the +Z side into the second holding member 13B that is a fixation target different from the first holding member 13A are possible. The use of the recording head 20 does away with the need to produce structurally different recording heads for different fixation targets. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for the screwing process irrespective of the fixation target to which the recording head 20 is to be fixed. This eliminates the inconvenience of disposing of unneeded components.

The ink jet recording head 20 in this modification is preferably structured as follows. The cylindrical member 73 is disposed on the +Z side (i.e., the first side to which the first direction leads) relative to the screw insertion holes 66*a*, 67*a*, and 54*a* (i.e., the first through-holes). The outside diameter D7 of the cylindrical member 73 is greater than the inside diameter of at least one of the screw insertion holes 66*a*, 67*a*, and 54*a*. For example, the outside diameter D7 is greater than the inside diameter D3 of the screw insertion hole Ma. When the first shaft portion 71A is pinched and lifted in the −Z direction, the cylindrical member 73 comes into contact with the opening surface in which the opening on the +Z side is defined by the screw insertion hole 54*a*, and the movement of the first shaft portion 71A in the −Z direction is restricted accordingly. Pinching the first shaft portion 71A is all that is required of the user to lift the recording head 20. This provides ease of positioning of the recording head 20 in a relatively small space, in particular a space in which multiple recording heads 20 are tightly packed. Furthermore, the possibility of accidental withdrawal of the first shaft portion 71A from the screw insertion hole 54*a* is minimized.

The ink jet recording head 20 in this modification may be preferably structured as follows. As the second external threaded section 75 (i.e., the first external thread) fits into the first internal threaded section 77 (i.e., the first internal thread), the cylindrical member 73 moves in the −Z direction (i.e., the second direction) opposite to the +Z direction (i.e., the first direction) with respect to the shaft main body 72. The first face 74*c* of the shaft main body 72 and the end face of the cylindrical member 73 constitute a restriction section of the first shaft portion 71A. The restriction section restricts the movement of the cylindrical member 73 in the −Z direction with respect to the shaft main body 72. The restriction section included in the first shaft portion 71A to restrict the movement of the cylindrical member 73 in the −Z direction with respect to the shaft main body 72 helps fasten the cylindrical member 73 and the shaft main body 72 securely to each other. Owing to the restriction section, the cylindrical member 73 is rotated in conjunction with the shaft main body 72, which is in turn kept from turning free, that is, kept from turning independently of the cylindrical member 73. This provides ease of screwing the cylindrical member 73 into the holding member 13 and ease of screwing the fastening screw 85 into the cylindrical member 73.

The ink jet recording head 20 in this modification may be preferably structured as follows. The recording head 20 is fixed to the first holding member 13A in such a manner that the second external threaded section 75 (i.e., the first external thread) inserted to the fastening screw hole 62 of the first holding member 13A in the +Z direction (i.e., the first direction) fits in the fastening screw hole 62. The recording head 20 is fixed to the second holding member 13B in such a manner that the first internal threaded section 77 fits onto the fastening screw 85 inserted into the second through-hole 86 of the second holding member 13B in the −Z direction opposite to the +Z direction. The first shaft portion 71A of the recording head 20 enables screwing from both the +Z side and the −Z, that is, screwing from the −Z side into the first holding member 13A and screwing from the +Z side into the second holding member 13B that is a fixation target different from the first holding member 13A.

Embodiment 2

Figure 24:
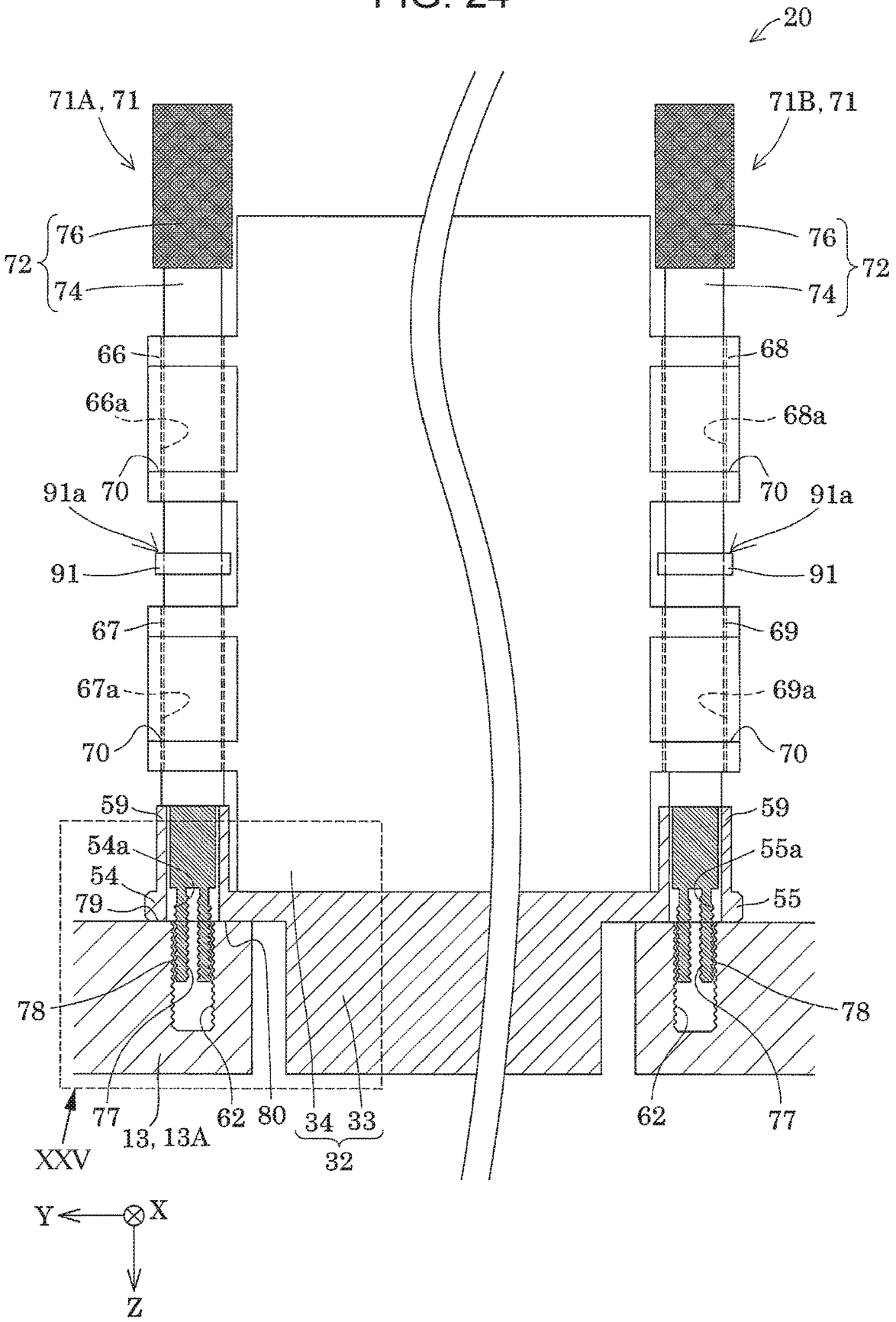
FIG. 24 is a side view of a recording head according to Embodiment 2.
Figure 25:
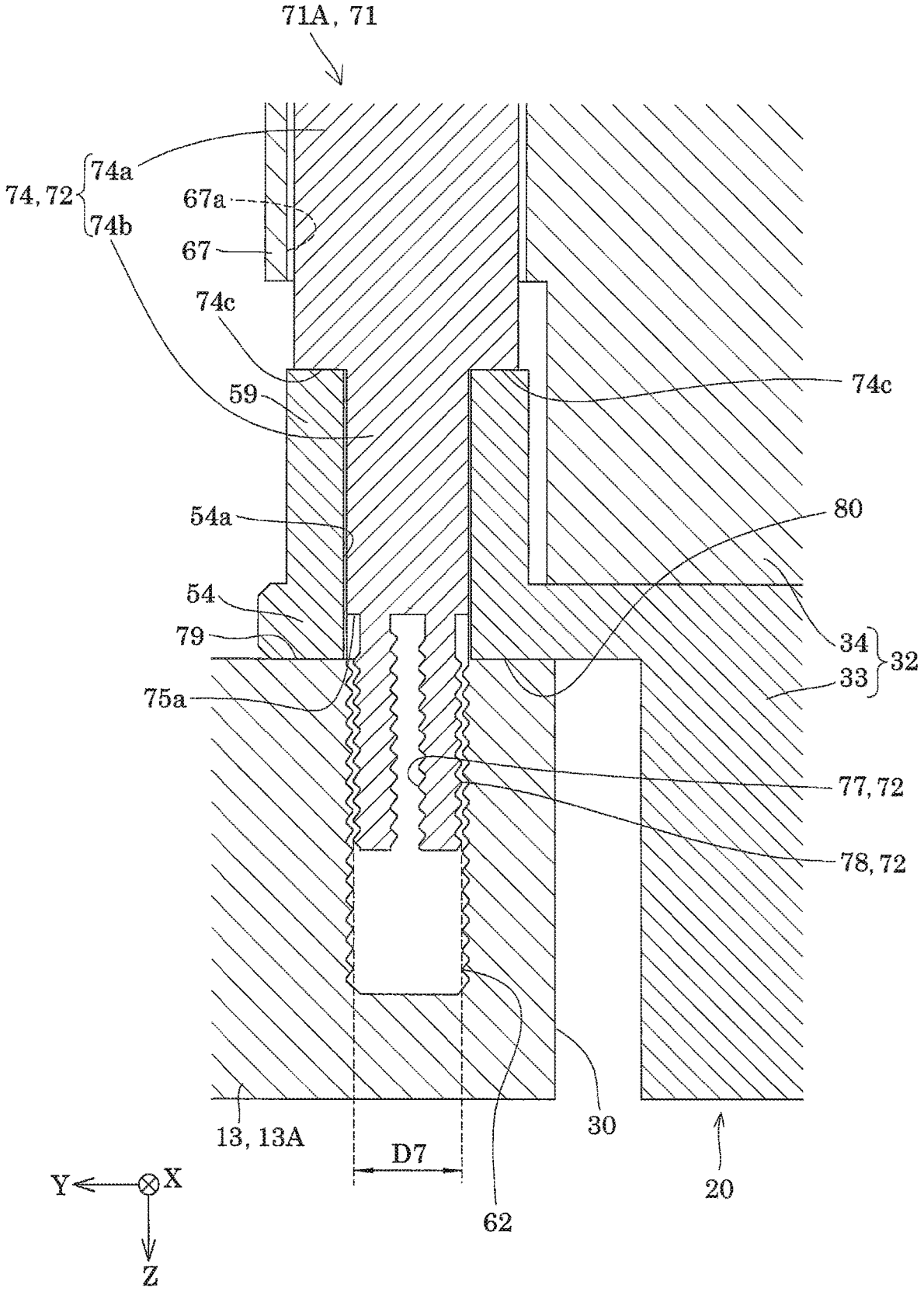
FIG. 25 is a sectional view of the first flange portion fitted with the structuring elements adjacent thereto, illustrating a state in which the recording head according to Embodiment 2 is fixed to the first holding member.
Figure 26:
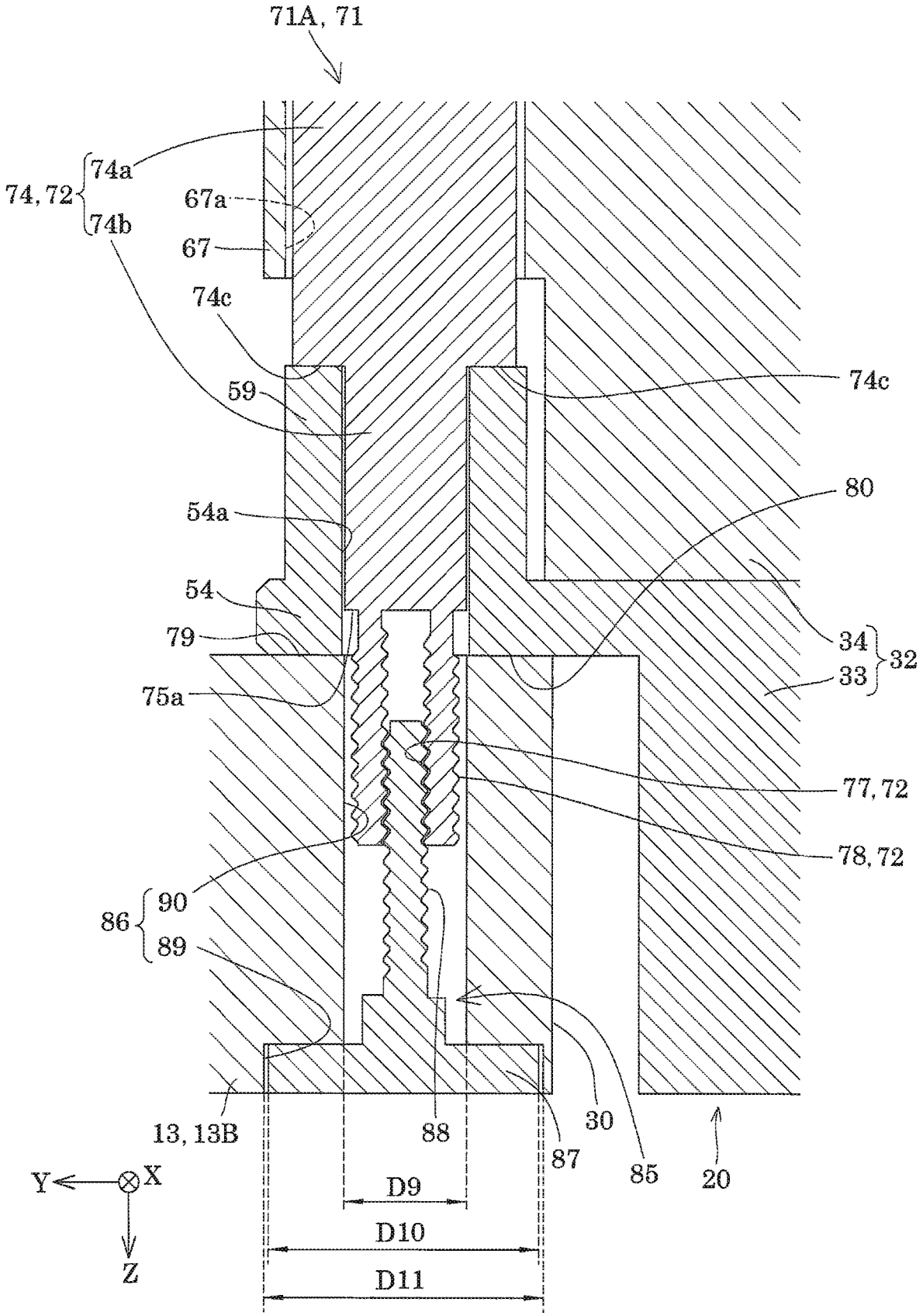
FIG. 26 is a sectional view of the first flange portion fitted with the structuring elements adjacent thereto, illustrating a state in which the recording head according to Embodiment 2 is fixed to the second holding member.

FIG. 24 is a side view of an ink jet recording head that is an example of a liquid ejecting head according to Embodiment 2 and the first holding member. FIG. 25 is an enlarged sectional view of a principal portion in FIG. 24. FIG. 26 is an enlarged sectional view of a principal portion of the recording head and a principal portion of the second holding member. Each member in the present embodiment and the corresponding element in the embodiment above are denoted by the same reference sign, and redundant description thereof will be omitted.

As illustrated in FIGS. 24 to 26, the first shaft portion 71A in the present embodiment includes only the shaft main body 72. That is, the first shaft portion 71A does not include the cylindrical member 73 and includes only the shaft main body 72. The shaft main body 72 of the first shaft portion 71A has the main body section 74, the first external threaded section 78, and the knob section 76. The first external threaded section 78 is provided on the outer circumferential surface of the end portion of the main body section 74 on the +Z side. The end face of the shaft main body 72 on the +Z side has an opening defined by the first internal threaded section 77. The knob section 76 is provided to the end portion of the main body section 74 on the −Z side. The first internal threaded section 77 has an internal thread, namely, valley-shaped grooves, which are provided on the inner circumferential surface of an end portion of the main body section 74 on the +Z side. The first external threaded section 78 and the first internal threaded section 77 are integrally provided on the end portion of the shaft main body 72 (i.e., the first shaft portion 71A) on the +Z side. The first external threaded section 78 of the shaft main body 72 in the present embodiment corresponds to the first external thread. The first internal threaded section 77 of the shaft main body 72 in the present embodiment corresponds to the first internal thread.

As in Embodiment 1, the main body section 74 includes the large-diameter section 74*a* and the small-diameter section 74*b*. The first face 74*c* lies between the large-diameter section 74*a* and the small-diameter section 74*b*.

The outside diameter D7 (i.e., the major diameter of the first external threaded section 78) is smaller than the inside diameter D3 of the screw insertion hole 54*a*. As in Embodiment 1, the inside diameter D4 of the screw insertion holes 66*a* and 67*a* is greater than the inside diameter D3 of the screw insertion hole 54*a*. The insertion of the shaft main body 72 into the screw insertion hole 66*a* of the first protrusion 66, the screw insertion hole 67*a* of the second protrusion 67, and the screw insertion hole 54*a* of the first flange portion 54 from the −Z side to the +Z side is thus possible.

The shaft main body 72 is provided with a stopper 91, which is located on the outer circumference of the shaft main body 72 between the screw insertion holes 66*a* and 67*a*. The stopper 91 is a retaining ring such as an E-type retaining ring and is fixed to the outer circumference of the shaft main body 72 (the outer circumference of the large-diameter section 74*a* of the main body section 74 in the present embodiment) in a manner so as to fit in a groove (not illustrated) on the outer circumference of the large-diameter section 74*a*. The outside diameter of the stopper 91 is greater than the inside diameter D4 of the screw insertion holes 66*a* and 67*a*. The stopper 91 projects outward from the groove (not illustrated) of the large-diameter section 74*a*. When viewed in plan in the direction from the −Z side to the +Z side, the stopper 91 includes a projection 91*a*, which projects on the outside of the shaft main body 72. When the shaft main body 72 is moved in the −Z direction, the projection 91*a* of the stopper 91 comes into contact with an opening face in which an opening on the +Z side is defined by the screw insertion hole 66*a* of the first protrusion 66, and the movement of the shaft main body 72 in the −Z direction with respect to the head case 32 is restricted accordingly. Specifically, the head case 32 (i.e., the housing portion) has the screw insertion hole 66*a* (i.e., the third through-hole) and the opening face. The first shaft portion 71A is inserted into the screw insertion hole 66*a*. The opening of the screw insertion hole 66*a* on the +Z side is defined in the opening face. The knob section 76, which is part of the first shaft portion 71A, is located on the −Z side relative to the opening face in which an opening on the −Z side is defined by the screw insertion hole 66*a*, which is located on the −Z side relative to the other screw insertion holes. The knob section 76 is thus kept from getting into the screw insertion hole 66*a* and becoming less capable of being pinched. The knob section 76, which is part of the first shaft portion 71A, is preferably located on the −Z side relative to a face that is located on the −Z side relative to the other faces of the head case 32. In the present embodiment, the knob section 76 is preferably located on the −Z side relative to the face of the head case 32 (exclusive of the connection portion 64) on the −Z side. The knob section 76 located on the −Z side relative to the face that is located on the −Z side relative to the other faces of the head case 32 is easily pinched. This improves the handleability of the recording head 20. The stopper 91 is located between the end portion on the +Z side and the end portion on the −Z side of the shaft main body 72 such that the movement of the first shaft portion 71A in the −Z direction with respect to the head case 32 is restricted. When viewed in plan in the direction from the −Z side to the +Z side, the stopper 91 includes the projection 91*a* projecting on the outside of the shaft main body 72. The projection 91*a* is located on the +Z side relative to the screw insertion hole 66*a* and comes into contact with the opening face in which the opening on the +Z side is defined by the screw insertion hole 66*a*.

When the recording head 20 is lifted in the −Z side with the first shaft portion 71A being pinched, the projection 91*a* of the stopper 91 on the first shaft portion 71A comes into contact with the opening face in which the opening on the +Z is defined by the screw insertion hole 66*a* of the first protrusion 66, and the movement of the first shaft portion 71A to the −Z side relative to the screw insertion hole 66*a* is restricted accordingly. This enables the user to carry the recording head 20 in such a manner that the first shaft portion 71A is kept from being withdrawn from the first shaft portion 71A that is pinched to lift the recording head 20 in the −Z direction. That is, the first shaft portion 71A may be used to carry the recording head 20. This provides ease of handling and positioning of the recording head 20, which may be readily locked in place relative to the holding member 13 through the use of the knob section 76 pinched by the user. This is particularly advantageous in that the recording heads 20 densely aligned on the holding member 13 may be handled with the knob sections 76 being pinched by the user. The recording head 20 may thus be readily positioned and locked in place relative to the holding member 13. The second shaft portion 71B, which is the other one of the shaft portions 71 in the present embodiment and is located on the end portion of the head case 32 on the −Y side, is structurally identical to the first shaft portion 71A.

The following describes the way the recording head 20 is fixed to the first holding member 13A. FIG. 25 is a sectional view of Region XXV in FIG. 24. With the recording head 20 being fixed to the first holding member 13A, the first flange portion 54 fitted with the structuring elements adjacent thereto is as illustrated in FIG. 25. The first flange portion 54 fitted with the structuring elements adjacent thereto and the second flange portion 55 fitted with the structuring elements adjacent thereto have left-right symmetry and are substantially identical to each other.

Referring to FIG. 25, the recording head 20 is fixed to the first holding member 13A in the following manner. The knob section 76 of the shaft main body 72 of the first shaft portion 71A viewed in plan in the direction from the −Z side to the +Z side is turned clockwise. Consequently, the first external threaded section 78 fits into the fastening screw hole 62 of the first holding member 13A. With additional screwing of the first shaft portion 71A, the first flange portion 54 is fitted between the first face 74*c* and the holding face 79, and the contact face 80 of the first flange portion 54 comes into contact with the holding face 79 of the first holding member 13A accordingly. The second shaft portion 71B on the −Y side is screwed in like manner, and the second flange portion 55 is fitted between the first face 74*c* and the holding face 79.

The recording head 20 is fixed to the first holding member 13A accordingly. Specifically, the recording head 20 in the present embodiment is fixed to the holding member 13 with two shaft portions 71 (i.e., the first shaft portion 71A and the second shaft portion 71B) on the opposite sides in the ±Y directions. In this state, the recording head 20, or more specifically, each of the first flange portion 54 and the second flange portion 55 is sandwiched between the first holding member 13A and the first face 74*c* of the corresponding one of the first shaft portion 71A and the second shaft portion 71B. In the present embodiment, the first shaft portion 71A is disposed on the +Y side in the ±Y directions (i.e., the longitudinal direction of the nozzle surface of the recording head 20), and the second shaft portion 71B is disposed on the −Y side. More specifically, the first shaft portion 71A in the present embodiment is provided to the end of the second portion P2 on the +Y side, and the second shaft portion 71B in the present embodiment is provided to the end of the third portion P3 on the −Y side (see FIG. 7). This layout allows maximization of the distance between the first shaft portion 71A and the second shaft portion 71B. The recording head 20 may be securely fixed to the first holding member 13A accordingly. The major diameter of the first external threaded section 78 provided directly on the shaft main body 72 in Embodiment 2 may be smaller than the major diameter of the first external threaded section 78 provided on the cylindrical member 73 in Embodiment 1. The first external threaded section 78 fits into the fastening screw hole 62 of the first holding member 13A, and the inside diameter of the fastening screw hole 62 may be relatively small correspondingly. The fastening screw holes 62 thus take up less space. This eliminates or reduces the possibility that the fastening screw holes 62 will overlap each other and that the first holding member 13A will have reduced rigidity in regions between the fastening screw holes 62 and the apertures 30.

The following describes the way the recording head 20 is fixed to the second holding member 13B. FIG. 26 is a sectional view of the first flange portion 54 fitted with the structuring elements adjacent thereto, illustrating a state in which the recording head 20 is fixed to the second holding member 13B. Each structuring element in FIG. 25 and the corresponding structuring element in FIG. 26 are denoted by the same reference sign, and redundant description thereof will be omitted where appropriate. As with FIG. 25, FIG. 26 illustrates the first flange portion 54 fitted with the structuring elements adjacent thereto. The first flange portion 54 fitted with the structuring elements adjacent thereto and the second flange portion 55 fitted with the structuring elements adjacent thereto have left-right symmetry and are substantially identical to each other.

The second holding member 13B has the second through-holes 86, which are provided in the positions corresponding to the positions of the fastening screw holes 62 of the first holding member 13A. The second through-holes 86 extend through the second holding member 13B in its thickness direction, that is, in the Z direction. When viewed in plan in the direction from the −Z side to the +Z side, the second through-hole 86 is enclosed with the screw insertion hole 54*a*.

The second through-hole 86 includes the insertion section 90 and the recess 89. The inside diameter D9 of the insertion section 90 is greater than the outside diameter D7 (i.e., the major diameter of the first external threaded section 78) (see FIG. 25). The inside diameter D11 of the recess 89 is greater than the outside diameter D10 of the head portion 87 of the fastening screw 85. The second holding member 13B is otherwise structurally identical to the first holding member 13A.

The recording head 20 is fixed to the second holding member 13B in the following manner. With the recording head 20 being positioned on the second holding member 13B in advance, the first internal threaded section 77 of the first shaft portion 71A is inserted into the second through-hole 86. Subsequently, the external threaded section 88 of the fastening screw 85 is inserted into the second through-hole 86 from the +Z side of the second holding member 13B, and the fastening screw 85 viewed in plan in the direction from the +Z side to the −Z side is turned clockwise. The external threaded section 88 fits into the first internal threaded section 77 in the second through-hole 86 accordingly. With additional screwing of the fastening screw 85, the first flange portion 54 is disposed between the first face 74*c* and the head portion 87 of the fastening screw 85, and the contact face 80 of the first flange portion 54 comes into contact with the holding face 79 of the second holding member 13B. The recording head 20 is fixed to the second holding member 13B accordingly. The same holds true for fixing on the second flange portion 55 side. The fastening screw 85 is inserted into the second through-hole 86 from the +Z side, and the external threaded section 88 then fits into the first internal threaded section 77 of the second shaft portion 71B inserted in the second through-hole 86. The second flange portion 55 is disposed between the first face 74*c* and the head portion 87 of the fastening screw 85, and the contact face 80 of the second flange portion 55 comes into contact with the holding face 79 of the second holding member 13B accordingly. That is, the recording head is fixed to the second holding member 13B. Specifically, each recording head 20 in the present embodiment is fixed to the second holding member 13B with two fastening screws 85 on the opposite sides in the ±Y directions and with two respective shaft portions 71 (i.e., the first shaft portion 71A and the second shaft portion 71B).

In this state, the head portion 87 of the fastening screw 85 is entirely received in the recess 89 and does not jut above the surface of the second holding member 13B on the +Z side, as in Embodiment 1.

The first external threaded section 78 and the first internal threaded section 77 of the first shaft portion 71A of the recording head 20 according to the present disclosure are both located on the +Z side. This enables screwing from both the +Z side and the −Z side such that the recording head 20 is fixed to the holding member 13. The recording head 20 may be fixed to the first holding member 13A having the fastening screw hole 62, which is enclosed with the first shaft portion 71A when viewed in plan in the direction from the −Z side to the +Z side. In other words, the recording head 20 is fixed to the first holding member 13A with the first shaft portion 71A that is manipulated from the −Z side. The recording head 20 may be fixed to the second holding member 13B having the second through-hole 86, which is enclosed with the first shaft portion 71A when viewed in plan in the direction from the −Z side to the +Z side. In other words, the recording head 20 is fixed to the second holding member 13B with the fastening screw 85 that is inserted into the second through-hole 86 from the +Z side and manipulated from the +Z side. That is, the recording head 20 may be fixed to the first holding member 13A or the second holding member 13B, and the first shaft portion 71A may be used whichever case it may be. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for the screwing process irrespective of the fixation target to which the recording head 20 is to be fixed. This eliminates the inconvenience of disposing of unneeded components.

As described above, the ink jet recording head 20 (i.e., the liquid ejecting head in the present embodiment) includes the nozzle surface, the first shaft portion 71A, and the head case 32 (i.e., the housing portion). The nozzle surface has nozzles from which ink (i.e., liquid) is ejected in the +Z direction (i.e., the first direction). The first shaft portion 71A includes the shaft main body 72 extending in the +Z direction. The head case 32 has the screw insertion holes 66*a*, 67*a*, and 54*a* (i.e., the first through-holes) in which the first shaft portion 71A is inserted. The first shaft portion 71A has the first external threaded section 78 (i.e., the first external thread) and the first internal threaded section 77 (i.e., the first internal thread) on the +Z side.

The first external threaded section 78 and the first internal threaded section 77 of the first shaft portion 71A of the recording head 20 are both located on the +Z side. This enables screwing from both the +Z side and the −Z side such that the recording head 20 is fixed to the holding member 13 (i.e., the fixation target). The use of the recording head 20 does away with the need to produce structurally different recording heads for different fixation targets. The recording head 20 including the first shaft portion 71A is thus target-independent. This eliminates the need to supply different recording heads for different fixation targets and simplifies production, inventory management, and shipment of the recording heads 20. The first shaft portion 71A is indispensable for screw fitting irrespective of the fixation target to which the recording head 20 is to be fixed. This eliminates the inconvenience of disposing of unneeded components.

The ink jet recording head 20 in the present embodiment is preferably structured as follows: the first external threaded section 78 (i.e., the first external thread) and the first internal threaded section 77 (i.e., the first internal thread) are provided on the shaft main body 72. The first external threaded section 78 and the first internal threaded section 77 that are provided on shaft main body 72 are conducive to the reduction in the number of components. This enables a reduction in costs.

The first external threaded section 78 and the first internal threaded section 77 of the first shaft portion 71A in the present embodiment have the same thread pitch and are provided in the corresponding positions, or more specifically, the position of the root of the first external threaded section 78 and the position of the root of the first internal threaded section 77 coincide with each other in the ±Z direction. In some embodiments, the first external threaded section 78 and the first internal threaded section 77 may be structured as illustrated in FIG. 16 or 17; that is, the structure of the first external threaded section 78 and the first internal threaded section 77 in the present embodiment may be identical to the structure of the cylindrical member 73 in either of FIGS. 16 and 17 illustrating the modifications of Embodiment 1. Owing to this structure, the section being part of the shaft main body 72 and having the first external threaded section 78 and the first internal threaded section 77 provided thereon increases in strength.

Other Embodiments

Embodiments of the present disclosure have been described so far. The basic configuration described above should not be construed as limiting the present disclosure.

Unlike the first shaft portion 71A in the embodiments and the modifications described above, the first shaft portion 71A in some embodiments is not inserted in the screw insertion hole 66*a* of the first protrusion 66 and the screw insertion hole 67*a* of the second protrusion 67. Similarly, unlike the second shaft portion 71B the embodiments and the modifications described above, the second shaft portion 71B in some embodiments is not inserted in the screw insertion hole 68*a* of the third protrusion 68 and the screw insertion hole 69*a* of the fourth protrusion 69.

The knob section 76 of the first shaft portion 71A in the embodiments and the modification described above is optional. Similarly, the knob section 76 of the second shaft portion 71B is optional. With the knob section 76 of the first shaft portion 71A in Embodiment 2 being omitted, the stopper 91 comes into contact with the opening face in which the opening on the −Z side is defined by the screw insertion hole 67*a* of the second protrusion 67, and the movement of the first shaft portion 71A in the +Z direction with respect to the screw insertion hole 67*a* is restricted accordingly. The possibility of withdrawal of the first shaft portion 71A from the screw insertion hole 67*a* is minimized. As in Embodiment 2, the first shaft portion 71A in Embodiment 1 is preferably provided with the stopper 91 when the knob section 76 of the first shaft portion 71A is omitted.

Unlike the first external threaded section 78 and the first internal threaded section 77 in the embodiments and the modifications described above, the first external threaded section 78 and the first internal threaded section 77 in some embodiments are not provided in positions corresponding to each other in the X direction; that is, the first external threaded section 78 and the first internal threaded section 77 are staggered in the Z direction such that they do not fit perfectly with each other in the X direction. The cylindrical member 73 or the shaft main body 72 increases in rigidity accordingly. That is, the expression "the first external thread and the first internal thread of the first shaft portion are both located on the +Z side of the first shaft portion 71A" may also mean that the first external thread and the first internal thread on the +Z side of the first shaft portion 71A are staggered in the Z direction.

Unlike the first shaft portion 71A and the second shaft portion 71B (i.e., the shaft portions 71) in the embodiments and the modifications described above, the first shaft portion 71A and the second shaft portion 71B in some embodiments are structurally different from each other. For example, the first shaft portion 71A in Embodiment 1 and the second shaft portion 71B that is structurally identical to the first shaft portion 71A in Embodiment 2 may be provided on the opposite sides of the recording head 20 in the Y direction.

The present application is widely applicable to any liquid ejecting head. Example applications include recording heads such as various types of ink jet recording heads that are to be incorporated in printers or other image recording apparatuses, coloring material injecting heads for use in producing color filters for liquid crystal displays, electrode material ejection heads for use in forming electrodes that are to be incorporated in organic electroluminescent (EL) displays or field emission displays (FEDs), and bioorganic matter ejecting heads for use in producing biochips.

The ink jet recording apparatus 1 has been described above as an example of the liquid ejecting apparatus. The other liquid ejecting heads mentioned above also find use in liquid ejecting apparatuses.

Examples of the liquid ejecting apparatus include line-head printers with print widths greater than the width of the medium S in the ±X direction. Such a line-head printer incorporates liquid ejecting heads arranged linearly in the ±X directions orthogonal to the ±Y directions in which the medium S is transported. The liquid ejecting heads may be arranged linearly in such a manner that the longitudinal direction of the individual liquid ejecting heads coincides with the ±X directions.

The embodiments and the modifications described herein may be employed in combination as appropriate, to the extent not inconsistent with each other.

What is claimed is:

1. A liquid ejecting head comprising:

a nozzle surface having nozzles configured to eject liquid in a first direction;

a first shaft portion including a shaft main body extending in the first direction, the first shaft portion having a first external thread and a first internal thread on a first side to which the first direction leads, the first internal thread being configured for receiving a screw from the first side toward a second side opposite the first side; and a housing portion having a first through-hole in which the first shaft portion is inserted.

2. The liquid ejecting head according to claim 1, wherein the first external thread and the first internal thread are provided on the shaft main body.

3. The liquid ejecting head according to claim 1, wherein the first shaft portion includes a cylindrical member that is hollow and that has an inner circumferential surface and an outer circumferential surface, the first internal thread being provided on the inner circumferential surface of the cylindrical member, the shaft main body has a second external thread on the first side, the shaft main body and the cylindrical member are fastened to each other with the second external thread fitting in the first internal thread, and the first external thread is provided on the outer circumferential surface of the cylindrical member.

4. The liquid ejecting head according to claim 3, wherein the cylindrical member is located on the first side relative to the first through-hole, and an outside diameter of the cylindrical member is greater than an inside diameter of the first through-hole.

5. A method for producing the liquid ejecting head according to claim 4, the method comprising fastening the cylindrical member onto the shaft main body inserted in the first through-hole.

6. The liquid ejecting head according to claim 3, wherein as the second external thread fits into the first internal thread, the cylindrical member moves in a second direction with respect to the shaft main body, the second direction being opposite to the first direction, and the first shaft portion has a restriction section that restricts movement of the cylindrical member in the second direction with respect to the shaft main body.

7. A liquid ejecting apparatus comprising:

the liquid ejecting head according to claim 3;

a screw that fits in the first internal thread; and a second holding member having a second through-hole in which the screw is inserted, the liquid ejecting head being held on the second holding member, wherein an outside diameter of the cylindrical member is greater than an inside diameter of the second through-hole.

8. The liquid ejecting head according to claim 1, wherein the first external thread and the first internal thread have different pitches.

9. The liquid ejecting head according to claim 1, wherein a position of a root of the first external thread and a position of a root of the first internal thread do not coincide with each other in directions orthogonal to the first direction.

10. The liquid ejecting head according to claim 1, wherein a difference between a major diameter of the first external thread and a major diameter of the first internal thread is not less than 1.0 mm.

11. The liquid ejecting head according to claim 1, wherein the first external thread is to be used to fix the liquid ejecting head to a first holding member for holding the liquid ejecting head, and the first internal thread is to be used to fix the liquid ejecting head to a second holding member for holding the liquid ejecting head.

12. The liquid ejecting head according to claim 1, further comprising a second shaft portion including a shaft main body extending in the first direction, the second shaft portion having a third external thread and a second internal thread on the first side, wherein the housing portion has a third through-hole in which the second shaft portion is inserted, the first shaft portion is located on a third side relative to the nozzle surface that is long in a third direction leading to the third side, the third direction being opposite to a fourth direction leading to a fourth side, and the second shaft portion is located on the fourth side relative to the nozzle surface.

13. The liquid ejecting head according to claim 12, wherein when viewed in the first direction, the housing portion includes a first portion, a second portion, and a third portion, the second portion adjoining the first portion and protruding in the third direction from the first portion, the third portion adjoining the first portion and protruding in the fourth direction from the first portion, dimensions of the second and third portions in a fifth direction orthogonal to the third direction are each not more than half a dimension of the first portion in the fifth direction, the second portion is located on a fifth side relative to a center of the first portion in the fifth direction leading to the fifth side, the fifth direction being opposite to a sixth direction leading to a sixth side, the third portion is located on the sixth side relative to the center of the first portion in the fifth direction, the first shaft portion is provided to an end of the second portion on the third side, and the second shaft portion is provided to an end of the third portion on the fourth side.

14. A liquid ejecting apparatus comprising:

the liquid ejecting head according to claim 1; and a first holding member having a screw hole in which the first external thread fits, the liquid ejecting head being held on the first holding member.

15. A liquid ejecting apparatus comprising:

the liquid ejecting head according to claim 1;

a screw that fits in the first internal thread; and a second holding member having a second through-hole in which the screw is inserted, the liquid ejecting head being held on the second holding member.

16. A liquid ejecting head comprising:

a nozzle surface having nozzles from which liquid is ejected in a first direction;

a first shaft portion including a shaft main body extending in the first direction, the shaft main body having a first external thread on a first side to which the first direction leads, the first external thread being configured to fit in a first internal thread for fastening of the shaft main body to a cylindrical member that is hollow and that has an inner circumferential surface, the first internal thread being provided on the inner circumferential surface of the cylindrical member; and a housing portion having a first through-hole in which the first shaft portion is inserted, wherein the first external thread is to be used to fix the liquid ejecting head to a first holding member for holding the liquid ejecting head or to fasten the cylindrical member and the shaft main body to each other, and the first internal thread is to be used to fasten the cylindrical member and the shaft main body to each other and to fix the liquid ejecting head to a second holding member for holding the liquid ejecting head.

17. The liquid ejecting head according to claim 16, wherein the cylindrical member is located on the first side relative to the first through-hole, and an outside diameter of the cylindrical member is greater than an inside diameter of the first through-hole.

18. The liquid ejecting head according to claim 16, wherein as the first external thread fits into the first internal thread, the cylindrical member moves in a second direction with respect to the shaft main body, the second direction being opposite to the first direction, and the first shaft portion has a restriction section that restricts movement of the cylindrical member in the second direction with respect to the shaft main body.

19. The liquid ejecting head according to claim 16, wherein the liquid ejecting head is fixed to the first holding member in such a manner that the first external thread fits in a screw hole of the first holding member, the first external thread being inserted into the screw hole in the first direction, and the liquid ejecting head is fixed to the second holding member in such a manner that the first internal thread fits onto a screw in a second through-hole of the second holding member, the screw being inserted into the second through-hole in a second direction opposite to the first direction.

20. A liquid ejecting apparatus comprising:

the liquid ejecting head according to claim 16;

a screw that fits in the first internal thread; and a second holding member having a second through-hole in which the screw is inserted, the liquid ejecting head being held on the second holding member, wherein an outside diameter of the cylindrical member is greater than an inside diameter of the second through-hole.

* * * * *